US010593302B2

(12) United States Patent
Suk et al.

(10) Patent No.: US 10,593,302 B2
(45) Date of Patent: Mar. 17, 2020

(54) FLEXIBLE TELEVISION AND METHOD THEREOF

(71) Applicant: LG ELECTRONICS INC., Seoul (KR)

(72) Inventors: Jihe Suk, Seoul (KR); Heesoo Park, Seoul (KR); Wonbin Jang, Seoul (KR); Gowoon Choi, Seoul (KR); Hanseok Hwangbo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/118,036

(22) Filed: Aug. 30, 2018

(65) Prior Publication Data

US 2019/0355328 A1 Nov. 21, 2019

Related U.S. Application Data

(60) Provisional application No. 62/673,138, filed on May 18, 2018.

(51) Int. Cl.
*G09G 5/38* (2006.01)

(52) U.S. Cl.
CPC ..... *G09G 5/38* (2013.01); *G09G 2320/08* (2013.01); *G09G 2354/00* (2013.01); *G09G 2380/02* (2013.01)

(58) Field of Classification Search
CPC .. G09G 5/38; G09G 2380/02; G09G 2320/08; G09G 2354/00
USPC ..... 345/156–184
See application file for complete search history.

(56) References Cited

U.S. PATENT DOCUMENTS

2005/0040962 A1* 2/2005 Funkhouser ..... G06F 1/1601 340/815.4
2013/0300682 A1* 11/2013 Choi ..... H04M 1/0268 345/173
2015/0220118 A1* 8/2015 Kwak ..... G09F 9/301 345/667
2016/0029474 A1* 1/2016 Cho ..... H05K 1/028 361/749
2017/0103735 A1* 4/2017 Oh ..... G06F 1/1626
2017/0127535 A1* 5/2017 Shin ..... G02F 1/1333
2017/0140504 A1* 5/2017 Jeong ..... G06F 1/1677
2017/0212607 A1* 7/2017 Yoon ..... G06F 3/0346
2018/0129250 A1* 5/2018 La ..... G06F 1/1652

OTHER PUBLICATIONS

PCT International Application No. PCT/KR2019/001253, Notification of Transmittal of the International Search Report and the Written Opinion of the International Searching Authority, or Declaration dated May 8, 2019, 14 pages.

* cited by examiner

*Primary Examiner* — Carolyn R Edwards
(74) *Attorney, Agent, or Firm* — Lee, Hong, Degerman, Kang & Waimey PC

(57) ABSTRACT

A flexible TV is disclosed. The flexible TV includes a housing, a user interface configured to receive at least one command, a flexible display positioned in the housing, and a controller configured to control a door and a motor. In particular, the controller determines a range of the flexible display exposed to an outside of the housing by controlling at least one of the door or the motor according to a type of the command.

22 Claims, 43 Drawing Sheets

FIG. 13
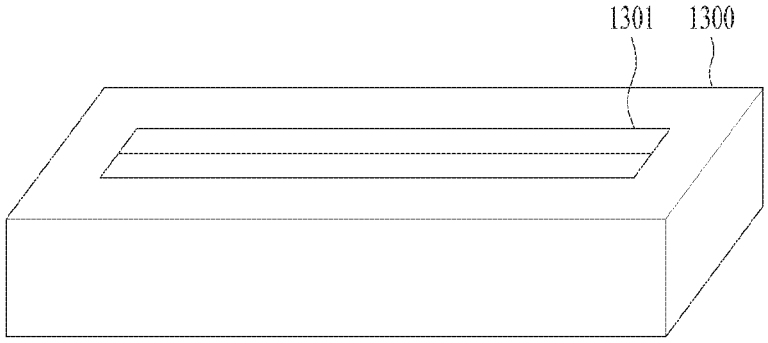
(a)
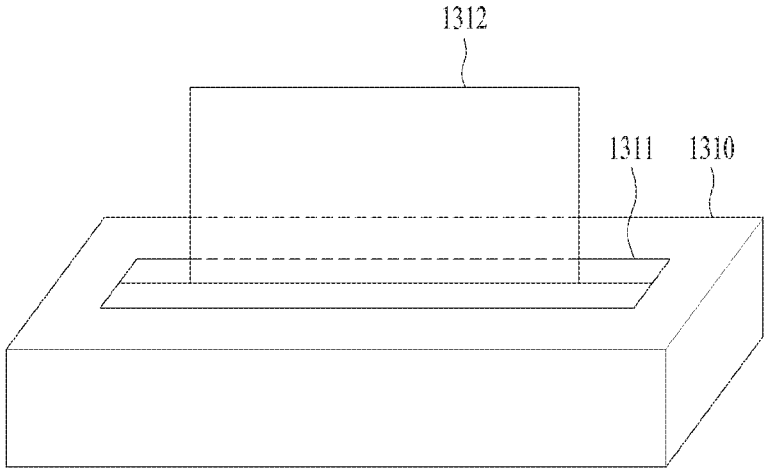
(b)

FIG. 18

| | Operation Status | |
|---|---|---|
| button | Zero View | Partial View |
| TV Power | O | O |
| STB Power | O | O |
| Number | X | X |
| Quick Access | X | O<br>Limited to long-press of mapped number<br>For the setting screen X |
| - / List | X | X |
| Screen Remote | X | X |
| Vol + - | O | O |
| CH + - | X | X |
| Mute | O | O |
| Home | X | O<br>Invoking/ending partial view-specific menus |
| Settings | X | X |
| Inputs | X | X |
| 4-direction ▲ | X | O |
| 4-direction ▼ | X | O |
| 4-direction ◀ | X | O |
| 4-direction ▶ | X | O |
| OK / Wheel | X | O |
| Back | X | O |
| Voice | O | O |
| Color Key | X | X |
| Netflix | O | O |
| Amazon | O | O |
| Focus | X | X |
| Play | O | O |
| Pause | O | O |
| STB Menu | X | X |
| Recents | X | X |
| TEXT | X | X |
| T.OPT | X | X |
| UP / DOWN (Specialized Button) | O | O |

| | Operation Status |
|---|---|
| button | Changing view type |
| Power | O |
| Vol. | O |
| Others | X<br>(Audio Guidance) "View type is being changed. Please try again after changing is completed." |

FIG. 21

○ LED Off
◎ ⊘ ◎ LED On

| State | Description | Lighting Operation | Display |
|---|---|---|---|
| Awake | Indicates that the TV has woken up Immediately connecting to standby state lighting | Light shifts from inside to outside.<br><br>1. Lights are turned on starting with the innermost light.<br>2. The entire lights are turned off after all lights are turned on. | ON starting with innermost light<br>○...○ ◎ ○...○<br>◎...◎ ◎ ◎...◎<br>○...○ ○ ○...○ 800ms |
| Standby | Indicates that the TV is awake and waiting | Light moves back and forth between inside and outside<br><br>1. Lights are turned on starting with the innermost light.<br>2. Lights are turned off starting with the outermost lights after all lights are turned on.<br>3. The steps above are repeated. | ON starting with innermost light<br>○...○ ◎ ○...○<br>◎...◎ ◎ ◎...◎<br>OFF starting with outermost light 1 set takes<br>○...◎ ◎ ◎...○ 4000 ms |
| Recognized | Indicates that the user is recognized | Lights behave in the same way as in the standby state<br>Note that brightness is provided only up to 60%.. | Same as above |
| Command Listening | Indicates that the user's speech is being recognized | Light repeats shift from outside to inside.<br><br>1. Lights are turned on starting with the outermost lights.<br>2. Lights are turned off starting with the outermost lights after all lights are turned on.<br>3. The steps above are repeated. | ON starting with outermost light<br>◎...○ ○ ○...◎<br>○...◎ ◎ ◎...◎<br>OFF starting with outermost light 1 set takes<br>○...◎ ◎ ◎...○ 2000ms |
| Command Processing | Indicates that the user's speech is being processed | Light repeats shift from left to right and right to left.<br><br>1. Lights are turned on starting with the leftmost light.<br>If 2/3 or more of the lights are turned on, lights are turned off starting with the leftmost light<br>2. When light reaches the leftmost end, it is held until all lights are turned off<br>3. Lights are turned on and off in the same pattern as above starting with the rightmost light.<br>4. Steps above are repeated. | ON starting with leftmost light<br>◎ ◎ ○ ○ ○<br>OFF starting with leftmost light<br>○...○ ◎ ◎...◎<br>○...○ ○ ○...◎<br>ON starting with rightmost light 1 set takes<br>○...○ ○ ◎...◎ 2000ms |
| Responding | Indicates that the TV is providing a feedback (TTS) | Light repeats shift from inside to outside.<br><br>1. Lights are turned on starting with the innermost light.<br>2. Lights are turned off starting with the innermost light after all lights are turned on.<br>3. Steps above are repeated.<br>※ Light moves in the opposite direction to the command listening. | ON starting with innermost light<br>○...○ ◎ ○...○<br>◎...◎ ◎ ◎...◎<br>OFF starting with the innermost light<br>◎...◎ ○ ◎...◎ 1 set takes<br>2000ms |
| Changing View Type | Zero → Full<br>Partial → Full | The array is brightened from inside to outside<br><br>1. Lights are turned on starting with the innermost light (up to 60% brightness).<br>2. The array becomes brighter (up to 100% brightness) with all lights turned on.<br>3. The lights are held at 100% brightness for 1 second and then turned off simultaneously. | ON starting with innermost light<br>○...○ ◎ ○...○<br>All ON<br>◎...◎ ◎ ◎...◎<br>Held at 100% for 1 second and then OFF<br>15 s (which depends on roll-up time) |
| | Zero → Partial | The array is brightened from inside to outside<br><br>1. Lights are turned on starting with the innermost light (up to 40% brightness).<br>2. The array becomes brighter (up to 60% brightness) with all lights turned on.<br>3. The lights are held at 60% brightness for 1 second and then turned off simultaneously. | ON starting with innermost light<br>○...○ ◎ ○...○<br>All ON<br>◎...◎ ◎ ◎...◎<br>Held at 60% for 1 second and then OFF<br>4 s (depending on roll-up time) |
| | Full/Partial → Zero | The array is dimmed from outside to inside<br><br>1. All lights are turned on simultaneously (up to 60% brightness).<br>2. The lights are turned off starting with the outermost lights. | All ON<br>◎...◎ ◎ ◎...◎ 15 s (which depends on roll-up time)<br>OFF starting with outermost light<br>○..○ ◎ ○.. ○ 4 s (depending on roll-up time) |
| BT Connection | Connected/released | Alternating flickering<br>Lights are turned on at 50% brightness.<br>If voice command cannot be executed, the same color as used for response GUI is used. | Alternatingly ON/OFF<br>○...◎ ○ ◎...○<br>○...○ ○ ○...○<br>⊘...○ ◎ ○...◎ 1000ms |
| Error and Impossible | Indicates that command cannot be executed | Alternating flickering<br>Lights are turned on at 50% brightness.<br>If voice command cannot be executed, the same color as used for response GUI is used. | Alternatingly ON/OFF<br>○...⊘ ○ ⊘...○<br>○...○ ○ ○...○ 1 set takes<br>⊘...○ ⊘ ○...⊘ 2000ms |

FIG. 22

| Full View Operation | Zero View | Partial View |
|---|---|---|
| Displaying voice UI with simple text | Text is read with TTS without view switching. | Reading with TTS |
| Displaying voice UI including content | The view is switched to Partial View and the text is read with TTS. | Voice UI executed |
| Displaying voice UI including widget | If today's weather or time is asked, response is made only through TTS without widget | Voice UI executed |
| Executing Overlay App | Response with "Not supported" But Music Player is supported without view switching | Response with "Not supported" But Music Player is run by App for Partial View without view switching |
| Executing Card Type App | The view is switched to Full View. | The view is switched to Full View. |
| Switching to specific channel or program (including viewing reservation) | The view is switched to Full View. But previous channel which can be supported when the channel is tuned and Channel up/down are not supported. | The view is switched to Full View. But previous channel which can be supported when the channel is tuned and Channel up/down are not supported. |
| Executing setting menu | Response with "Not supported". But sleep reservation, On reservation, and Off reservation, which do not require UI, are supported. | Response with "Not supported". But sleep reservation, On reservation, and Off reservation, which do not require UI, are supported. |
| Volume, playback/stop/fast forward/rewind/navigation | The operation is executed without view switching. But, in the case of Mute, Mute UI is executed by switching to the Partial View after N minutes. | The operation is executed without view switching. But, in the case of Mute, Mute UI is executed. |
| TV Off | Music that is being played is stopped and the warm state is set (and is switched to the cold state depending on time). | TV is turned off, and the view is switched to the Zero View of warm state (and is switched to the cold state depending on time). |

FIG. 28

| Result types of Zero View | | Typical case | Operation |
|---|---|---|---|
| | Lighting only | - Volume Control | Operation executed<br>If Mute lasts for n minutes or more, [Error] lighting is displayed. |
| Sound or TTS | Lighting only Lighting + Sound (e.g., ting-a-ling) | - TV Off<br>- Announcing BT connection | Operation executed |
| | Lighting + TTS | - Q&A (weather, time)<br>- Chatting Speech | TTS response |
| Sound or TTS | Lighting + Sound + Switch to Partial View | - Mode specialized for Partial View (Lighting, Mood, etc.) | Switching to Partial View and executing corresponding mode |
| | Lighting + TTS + Switch to Partial View | - Search (TV Live Program, VOD, etc.) | Switching to Partial View and displaying search result<br>※ If Zero View is restored from Partial View without direct manipulation by the user, switching notice animation is applied. |
| Sound or TTS | Lighting + Sound + Switch to Full View | - TV On | TV On through Last Input |
| | Lighting + TTS + Switch to Full View | - TV On with Shortcut (CP, Web Browser, etc.) | TV On through corresponding Shortcut |

FIG. 30
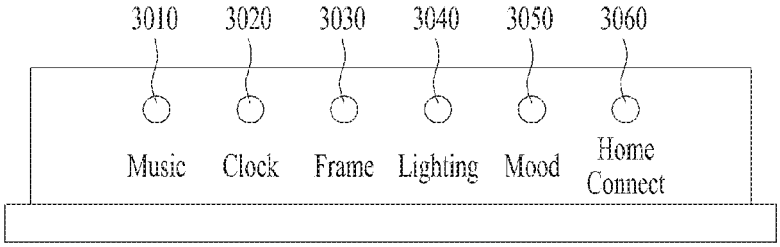
(a)
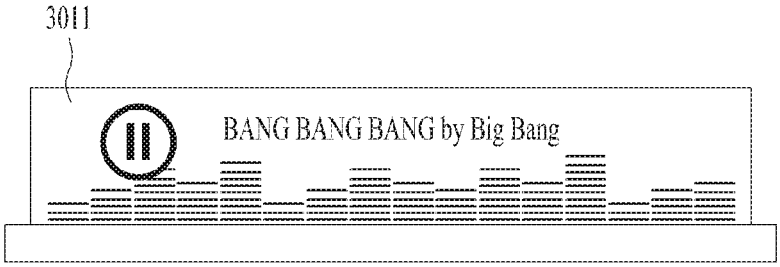
(b)
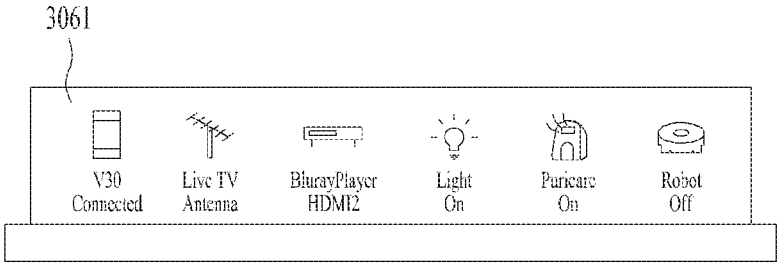
(c)
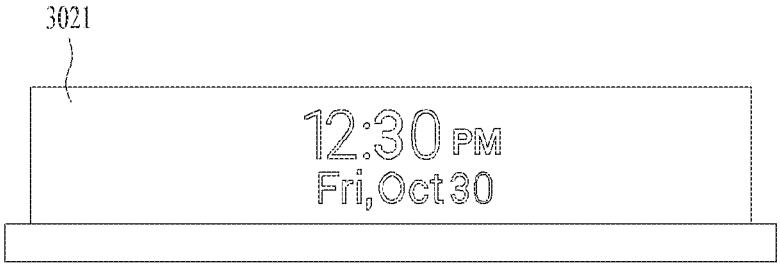
(d)

FIG. 35

| Result types of Zero View | | Typical case | Operation |
|---|---|---|---|
| | Lighting only | - Volume Control | Operation executed<br>For Mute, Mute icon is displayed as in Full View. |
| 음향 또는 TTS | Lighting + Sound | BT connection | Operation executed |
| | Lighting + TTS | - Q&A (weather, time)<br>- Chatting Speech | TTS response |
| UI 변경 | UI change | - Listening to music | Displaying information about content that is being reproduced |
| | Lighting + TTS<br>+ UI change | Search (TV Live Program, VOD, etc.) | Displaying search result along with TTS response<br>※ If no manipulation is performed for N minutes,<br>the screen switches back to the Partial View screen. |
| 음향 또는 TTS | Lighting + Sound<br>+ Switch to Full View | - TV On | Operation executed |
| | Lighting + TTS<br>+ Switch to Full View | - TV On with Shortcut<br>(CP, Web Browser, etc.) | Operation executed |
| 음향 | Lighting + Sound<br>+ Switch to Zero View | - Lowering screen and listening | Operation executed |

| | Warm Standly | Cold |
|---|---|---|
| Power supply module | Microphone/ Speech recognition module/ Network module | Microphone Only |

| Control Target / Command Type | Door | Motor |
|---|---|---|
| First Type | Door Open control | Motor Up |
| Second Type | Door control X | Motor Up/Down |

FIG. 50

| | View State | Command Type |
|---|---|---|
| Determination Condition for First Type | Zero View | Command requiring additional screen (e.g., Is there anything fun on TV now?) |
| Determination Condition for Second Type | Partial View | Command requiring additional screen (e.g., Play specific video content!) |
| | Full View | Command requires only small screen (e.g., Play music file!) |

FLEXIBLE TELEVISION AND METHOD THEREOF

Pursuant to 35 U.S.C. § 119(e), this application claims the benefit of U.S. Provisional Patent Application No. 62/673,138, filed on May 18, 2018, the contents of which are hereby incorporated by reference herein in its entirety.

BACKGROUND OF THE INVENTION

Field of the Invention

The present invention relates to a flexible display (e.g., a television, a mobile device, a tablet, and so on).

Discussion of the Related Art

A flexible display refers to a display that is thin like paper and can be bent or rolled up without damage through a flexible substrate. Technologies for implementing flexible displays include LCD technology using liquid crystals and OLED technology using organic luminous materials.

However, the LCD technology has difficulty in securing flexibility as it requires a backlight unit, and therefore has limited bendability. On the other hand, the OLED technology can secure relatively high flexibility because it does not require a backlight and the OLED is made of an organic material. Thus, the OLED technology is regarded as the most suitable technology for implementing a flexible display.

The OLED-type flexible display has the same basic structure as a typical OLED display, but is distinct in that it uses polyimide, which is a plastic, rather than glass, as a substrate material. Polyimide is a polymer material with excellent resilience and high impact resistance. Polyimide in a liquid state can be cooled into a thin film. That is, since a flexible plastic substrate is used instead of a typical rigid glass substrate, it is thin, light, and free to bend.

As flexible display technology develops, it has been applied to mobile devices which have a small display screen in many cases, and only recently a rollable TV, which is capable of rolling up a large screen, has emerged.

However, there has not been a discussion on UX/UI technology for user convenience, which is required in flexible TVs, assuming a case where flexible technology is incorporated into a smart TV equipped with functions such as speech recognition and various operating systems (OSs).

Further, according to the related art, issues of power consumption reduction and deterioration in image quality, which need to be addressed for flexible TVs, have not been addressed.

SUMMARY OF THE INVENTION

An object of the present invention is to provide a UX/UI technology for user convenience, which is required in a flexible TV.

Another object of the present invention is to specifically define a database in consideration of a type of a command and a view type recognized in a flexible TV.

Another aspect of the present invention is to address power consumption and deterioration in image quality of a specific area of the flexible display caused by switch between the view types of the flexible TV.

It is to be understood that both the foregoing general description and the following detailed description of the present invention are exemplary and explanatory and are intended to provide further explanation of the invention as claimed.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. The above and other aspects, features, and advantages of the present invention will become more apparent upon consideration of the following description of preferred embodiments, taken in conjunction with the accompanying drawing figures. In the drawings:

FIG. 13 shows an outer appearance of a flexible TV according to one embodiment of the present invention;

FIG. 18 shows a database that defines buttons of a remote controller which are enabled in each view type and buttons of the remote controller which are disabled in each view type, according to one embodiment of the present invention;

FIG. 21 shows a database that defines the operations and corresponding states of the lighting module shown in FIG. 20;

FIG. 22 shows a database that defines speech recognition operations for each view type according to one embodiment of the present invention;

FIG. 28 is a database that defines representative functions of a first view type according to one embodiment of the present invention;

FIG. 30 shows specific menus provided in a second view type according to one embodiment of the present invention;

FIG. 35 shows a database that defines representative functions of a second view type according to one embodiment of the present invention;

FIG. 50 shows a database that defines conditions for determining the command type shown in FIG. 49.

DETAILED DESCRIPTION OF THE INVENTION

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

In the following description, various embodiments according to the present invention are explained with reference to attached drawings.

Figure 1:
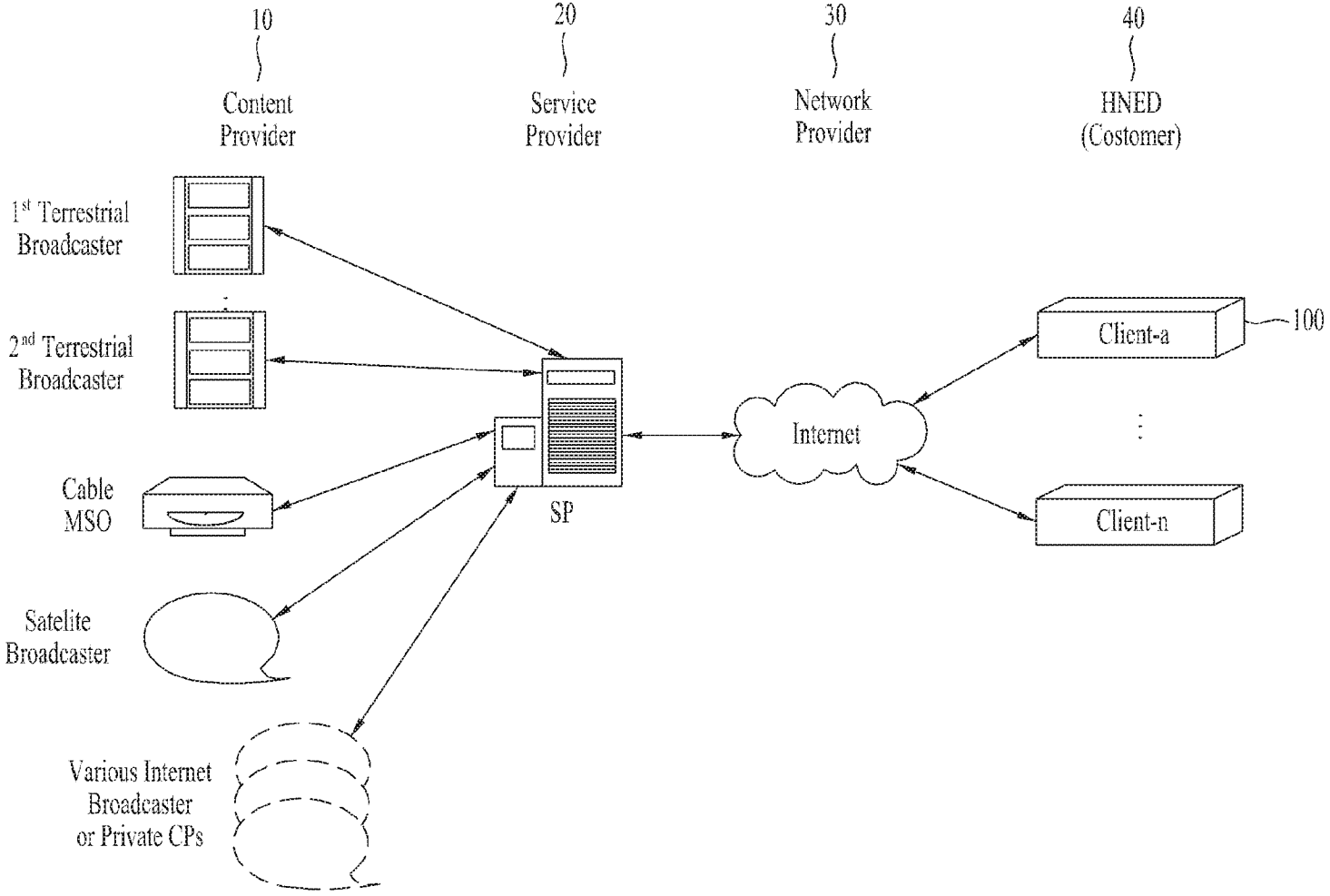
FIG. 1 is a schematic diagram illustrating a service system including a digital device according to one embodiment of the present invention.

FIG. 1 illustrates a broadcast system including a digital receiver according to an embodiment of the present invention.

Referring to FIG. 1, examples of a broadcast system comprising a digital receiver may include a content provider (CP) 10, a service provider (SP) 20, a network provider (NP) 30, and a home network end user (HNED) (Customer) 40. The HNED 40 includes a client 100, that is, a digital receiver.

Each of the CP 10, SP 20 and NP 30, or a combination thereof may be referred to as a server. The HNED 40 can also function as a server. The term 'server' means an entity that transmits data to another entity in a digital broadcast environment. Considering a server-client concept, the server can be regarded as an absolute concept and a relative concept. For example, one entity can be a server in a relationship with a first entity and can be a client in a relationship with a second entity.

The CP 10 is an entity that produces content. Referring to FIG. 1, the CP 10 can include a 1st or 2nd terrestrial broadcaster, a cable system operator (SO), a multiple system operator (MSO), a satellite broadcaster, various Internet broadcasters, private content providers (CPs), etc. The content can include applications as well as broadcast content.

The SP 20 packetizes content provided by the CP 10. Referring to FIG. 1, the SP 20 packetizes content provided by the CP 10 into one or more services available for users.

The SP 20 can provide services to the client 100 in a uni-cast or multi-cast manner.

The CP 10 and the SP 20 can be configured in the form of one entity. For example, the CP 10 can function as the SP 20 by producing content and directly packetizing the produced content into services, and vice versa.

The NP 30 can provide a network environment for data exchange between the server 10 and/or 20 and the client 100. The NP 30 supports wired/wireless communication protocols and constructs environments therefor. In addition, the NP 30 can provide a cloud environment.

The client 100 can construct a home network and transmit/receive data.

The server can use and request a content protection means such as conditional access. In this case, the client 100 can use a means such as a cable card or downloadable CAS (DCAS), which corresponds to the content protection means of the server.

In addition, the client 100 can use an interactive service through a network. In this case, the client 100 can directly serve as the CP 10 and/or the SP 20 in a relationship with another client or indirectly function as a server of the other client.

Figure 2:
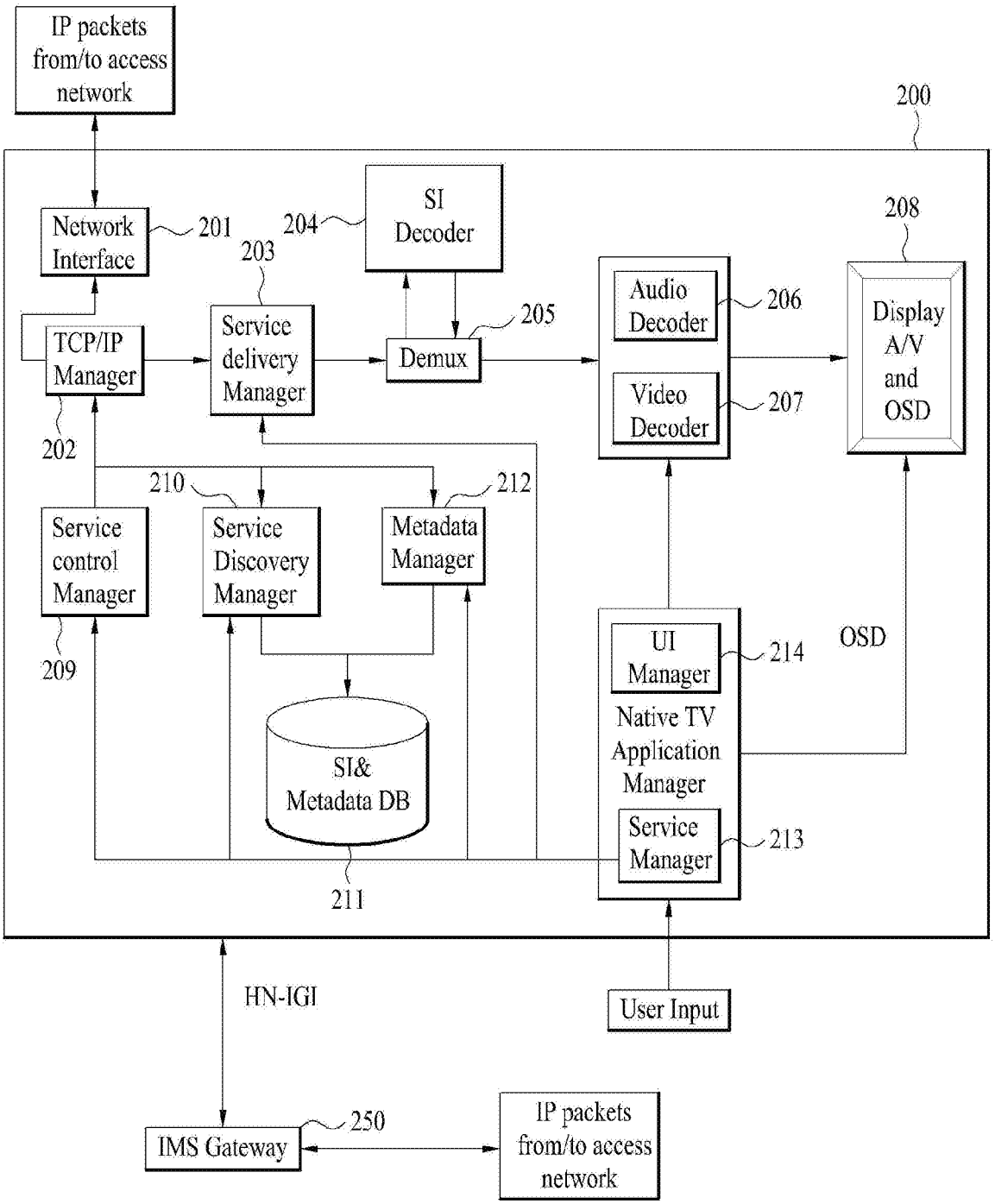
FIG. 2 is a block diagram showing a digital device according to one embodiment of the present invention.

FIG. 2 is a schematic diagram of a digital receiver 200 according to an embodiment of the present invention. The digital receiver 200 may correspond to the client 100 shown in FIG. 1.

The digital receiver 200 may include a network interface 201, a TCP/IP manager 202, a service delivery manager 203, an SI (System Information, Service Information or Signaling Information) decoder 204, a demultiplexer 205, an audio decoder 206, a video decoder 207, a display A/V and OSD (On Screen Display) module 208, a service control manager 209, a service discovery manager 210, a SI & metadata database (DB) 211, a metadata manager 212, an application manager, etc.

The network interface 201 may receive or transmit IP packets including service data through a network. In other words, the network interface 201 may receive IP packets including at least one of text data, image data, audio data, and video data, used for SNS, as well as services and applications from a server connected thereto through a network.

The TCP/IP manager 202 may involve delivery of IP packets transmitted to the digital receiver 200 and IP packets transmitted from the digital receiver 200, that is, packet delivery between a source and a destination. The TCP/IP manager 202 may classify received packets according to an appropriate protocol and output the classified packets to the service delivery manager 205, the service discovery manager 210, the service control manager 209, and the metadata manager 212.

The service delivery manager 203 may control classification and processing of service data. The service delivery manager 203 may control real-time streaming data, for example, using real-time protocol/real-time control protocol (RTP/RTCP). In other words, the service delivery manager 203 may parse a real-time streaming data packet, transmitted on the basis of the RTP, according to the RTP and transmits the parsed data packet to the demultiplexer 205 or store the parsed data packet in the SI & metadata DB 211 under the control of the service manager 213. The service delivery manager 203 can feed back network reception information to the server on the basis of the RTP.

The demultiplexer 205 may demultiplex audio data, video data, SI from a received packet through packet identifier (PID) filtering and transmit the demultiplexed data to corresponding processors, that is, the audio/video decoder 206/207 and the SI decoder 204.

The SI decoder 204 may parse and/or decode SI data such as program specific information (PSI), program and system information protocol (PSIP), digital video broadcast-service information (DVB-SI), etc.

The SI decoder 204 may store the parsed and/or decoded SI data in the SI & metadata DB 211. The SI data stored in the SI & metadata DB 211 can be read or extracted and used by a component which requires the SI data. EPG data can also be read from the SI & metadata DB 211. This will be described below in detail.

The audio decoder 206 and the video decoder 207 respectively may decode audio data and video data, which are demultiplexed by the demultiplexer 205. The decoded audio data and video data may be provided to the user through the display unit 208.

The application manager may include a service manager 213 and a user interface (UI) manager 214, administrate the overall state of the digital receiver 200, provides a UI, and manage other mangers.

The UI manager 214 can receive a key input from the user and provide a graphical user interface (GUI) related to a receiver operation corresponding to the key input through OSD.

The service manager 213 may control and manage service-related managers such as the service delivery manager 203, the service discovery manager 210, the service control manager 209, and the metadata manager 212.

The service manager 213 may configure a channel map and enable channel control at the request of the user on the basis of the channel map.

The service manager 213 may receive service information corresponding to channel from the SI decoder 204 and set audio/video PID of a selected channel to the demultiplexer 205 so as to control the demultiplexing procedure of the demultiplexer 205.

The application manager can configure an OSD image or control configuration of the OSD image to provide a window for SNS on a predetermined region of the screen when the user requests SNS. The application manager can configure the OSD image or control the configuration of OSD image such that the SNS window can be determined and provided at the request of the user in consideration of other services, for example, a broadcast service. In other words, when the digital receiver 200 may provide a service (for example, SNS) through an image on the screen, the digital receiver 200 may configure the image such that it can appropriately cope with requests in consideration of relationship with other services, priority, etc.

The application manager can receive data for SNS from a related external server such as an SNS providing server or a manufacturer-provided server and store the received data in a memory such that the data is used to configure OSD for providing SNS at the request of the user and SNS may be provided through a predetermined area of the screen. Furthermore, the digital receiver 200 can store data, related with a service and input by the user during the service, in the memory in a similar manner such that the data is used to configure the service and, if required, process the data into a form required for another digital receiver and transmit the processed data to the other digital receiver or a related service server.

In addition, the application manager, the controller or the digital receiver can control information or an action corresponding to a request of the user to be executed when the user makes the request while using the SNS. For example, when the user selects input data of another user or a region corresponding to the input data while using the SNS, the application manager, the controller or the digital receiver may control the first process and/or the second process for handling the selected data or region to be performed and control the first result and/or the second result to be output in an appropriate form. The first result and/or the second result can include information, an action, a related UI, etc. and be configured in various forms such as text, an image, audio/video data, etc. The first result and/or the second result can be manually or automatically provided and performed by the digital receiver.

When the user moves the first result (e.g. image data) to a broadcast program or broadcast service output area through drag & drop, the digital receiver can perform the second process (e.g., search process) on data relating to the first result using an electronic program guide (EPG) or electronic service guide (ESG) (referred to as 'broadcast guide' hereinafter) (i.e., a search engine) to provide a second result. Here, the second result can be provided in a form similar to the broadcast guide used as a search engine or provided as a separately configured UI. When the second result is provided in the form of the broadcast guide, other data can be provided with the second result. In this case, the second result can be configured such that it is distinguished from other data so as to allow the user to easily recognize the second data. To discriminate the second result from other data, the second result can be highlighted, hatched, and provided in 3-dimensional (3D) form.

In the execution of the second process, the digital receiver can automatically determine the type of the second process and whether or not to perform the second process on the basis of a position variation of the first result. In this case, coordinate information of the screen can be used for determining whether the position of the first result is changed or for information on a changed position between the second process and the first result. For example, when a service and/or OSD may be displayed on the screen, the digital receiver can determine and store coordinate information about the displayed service and/or OSD. Accordingly, the digital receiver can be aware of coordinate information about a service and data being provided to the screen in advance and thus can recognize a variation in the position (information) of the first result on the basis of the coordinate information and perform the second process based on the position of the first result.

The service discovery manager 210 may provide information required to select a service provider that provides a service. Upon receipt of a signal for selecting a channel from the service manager 213, the service discovery manager 210 discovers a service on the basis of the received signal.

The service control manager 209 may select and control a service. For example, the service control manager 209 may perform service selection and control using IGMP (Internet Group Management Protocol) or real time streaming protocol (RTSP) when the user selects a live broadcast service and using RTSP when the user selects a video on demand (VOD) service.

The schemes or protocols described in the specification are exemplified in order to aid in understanding of the present invention for convenience of explanations and the scope of the present invention is not limited thereto. Accordingly, the schemes or protocols can be determined in consideration of conditions different from the exemplified ones and other schemes or protocols can be used.

The metadata manager 212 may manage metadata regarding services and store metadata in the SI & metadata DB 211.

The SI & metadata DB 211 may store SI data decoded by the SI decoder 204, metadata managed by the metadata manager 212, and information required to select a service provider, which is provided by the service discovery manager 210. In addition, the SI & metadata DB 211 can store system set-up data.

An IMS (IP Multimedia Subsystem) gateway 250 may include functions required to access an IMS based IPTV services.

Figure 3:
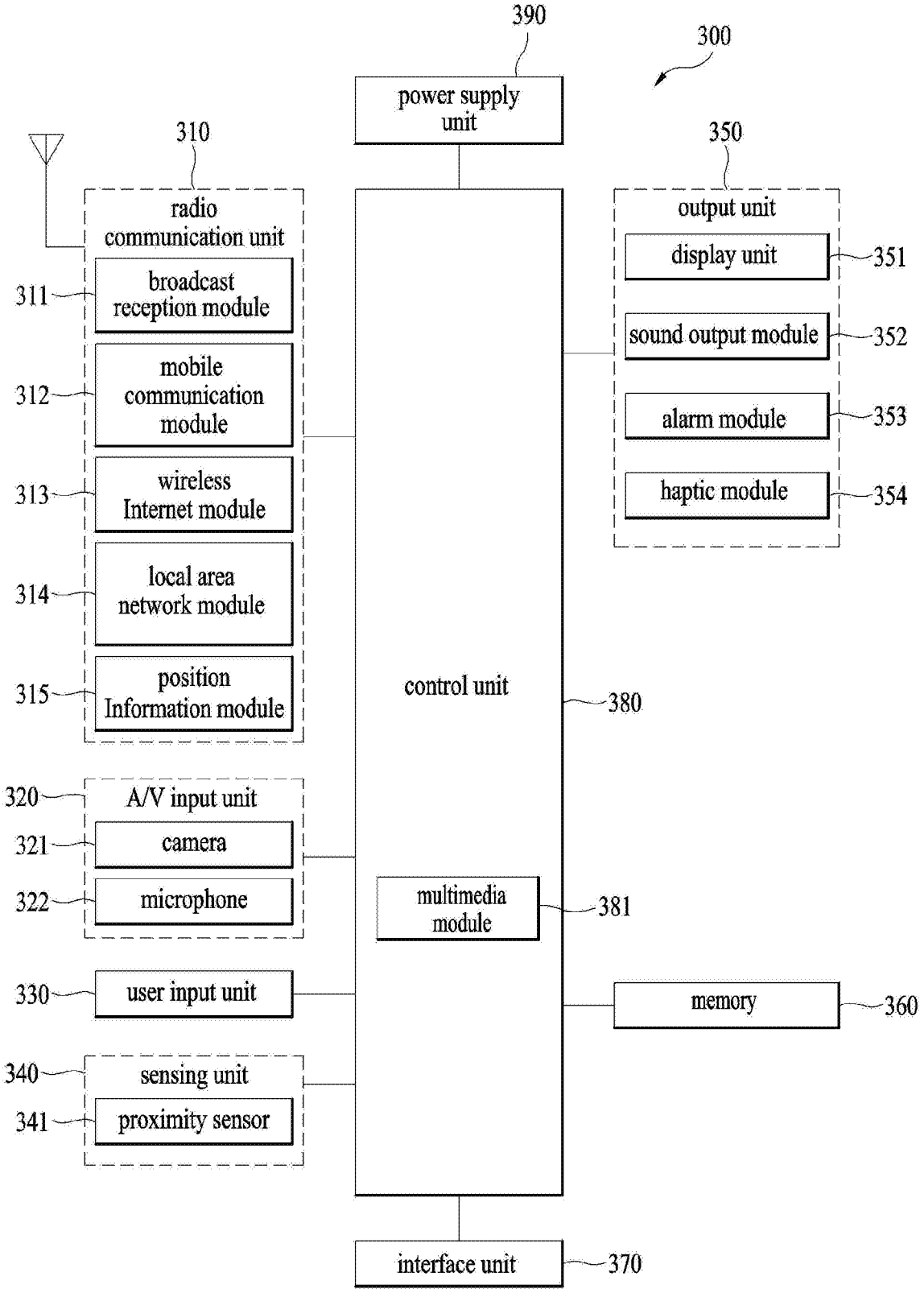
FIG. 3 is a block diagram showing the configuration of a digital device according to another embodiment of the present invention.

FIG. 3 is a block diagram of a mobile terminal 300 in accordance with an embodiment of the present invention. With reference to FIG. 3, the mobile terminal 300 includes a wireless communication unit 310, an A/V (audio/video) input unit 320, an user input unit 330, a sensing unit 340, an output unit 350, a memory 360, an interface unit 370, a controller 380, and a power supply unit 390. FIG. 3 shows the mobile terminal 300 having various components, but it is understood that implementing all of the illustrated components is not a requirement. More or fewer components may be implemented according to various embodiments.

The wireless communication unit 310 typically includes one or more components which permit wireless communication between the mobile terminal 300 and a wireless communication system or network within which the mobile terminal 300 is located. For instance, the wireless communication unit 310 can include a broadcast receiving module 311, a mobile communication module 312, a wireless Internet module 313, a short-range communication module 314, and a position-location module 315.

The broadcast receiving module 311 receives a broadcast signal and/or broadcast associated information from an external broadcast managing server via a broadcast channel. The broadcast channel may include a satellite channel and a terrestrial channel. At least two broadcast receiving modules 311 can be provided in the mobile terminal 300 to facilitate simultaneous reception of at least two broadcast channels or broadcast channel switching.

The broadcast managing server is generally a server which generates and transmits a broadcast signal and/or broadcast associated information or a server which is provided with a previously generated broadcast signal and/or broadcast associated information and then transmits the provided signal or information to a terminal. The broadcast signal may be implemented as a TV broadcast signal, a radio broadcast signal, and/or a data broadcast signal, among other signals. If desired, the broadcast signal may further include a broadcast signal combined with a TV or radio broadcast signal.

The broadcast associated information includes information associated with a broadcast channel, a broadcast program, or a broadcast service provider. Furthermore, the broadcast associated information can be provided via a mobile communication network. In this case, the broadcast associated information can be received by the mobile communication module 312.

The broadcast associated information can be implemented in various forms. For instance, broadcast associated information may include an electronic program guide (EPG) of digital multimedia broadcasting (DMB) and an electronic service guide (ESG) of digital video broadcast-handheld (DVB-H).

The broadcast receiving module 311 may be configured to receive broadcast signals transmitted from various types of broadcast systems. By non-limiting example, such broadcasting systems may include digital multimedia broadcasting-terrestrial (DMB-T), digital multimedia broadcasting-satellite (DMB-S), digital video broadcast-handheld (DVB-H), digital video broadcast-convergence of broadcasting and mobile services (DVB-CBMS), Open Mobile Alliance Broadcast (OMA-BCAST), the data broadcasting system known as media forward link only (MediaFLOTM) and integrated services digital broadcast-terrestrial (ISDB-T). Optionally, the broadcast receiving module 311 can be configured to be suitable for other broadcasting systems as well as the above-noted digital broadcasting systems.

The broadcast signal and/or broadcast associated information received by the broadcast receiving module 311 may be stored in a suitable device, such as the memory 360.

The mobile communication module 312 transmits/receives wireless signals to/from one or more network entities (e.g., a base station, an external terminal, and/or a server) via a mobile network such as GSM (Global System for Mobile communications), CDMA (Code Division Multiple Access), or WCDMA (Wideband CDMA). Such wireless signals may carry audio, video, and data according to text/multimedia messages.

The wireless Internet module 313 supports Internet access for the mobile terminal 300. This module may be internally or externally coupled to the mobile terminal 300. The wireless Internet technology can include WLAN (Wireless LAN), Wi-Fi, Wibro™ (Wireless broadband), Wimax™ (World Interoperability for Microwave Access), HSDPA (High Speed Downlink Packet Access), GSM, CDMA, WCDMA, or LTE (Long Term Evolution).

Wireless Internet access by Wibro™, HSPDA, GSM, CDMA, WCDMA, or LTE is achieved via a mobile communication network. In this regard, the wireless Internet module 313 may be considered as being a kind of the mobile communication module 312 to perform the wireless Internet access via the mobile communication network.

The short-range communication module 314 facilitates relatively short-range communications. Suitable technologies for implementing this module include radio frequency identification (RFID), infrared data association (IrDA), ultra-wideband (UWB), as well as the networking technologies commonly referred to as Bluetooth™ and ZigBee™, to name a few.

The position-location module 315 identifies or otherwise obtains the location of the mobile terminal 100. According to one embodiment, this module may be implemented with a global positioning system (GPS) module. The GPS module 315 is able to precisely calculate current 3-dimensional position information based on at least longitude, latitude or altitude and direction (or orientation) by calculating distance information and precise time information from at least three satellites and then applying triangulation to the calculated information. Location information and time information are calculated using three satellites, and errors of the calculated location position and one or more time information are then amended (or corrected) using another satellite. In addition, the GPS module 315 is able to calculate speed information by continuously calculating a real-time current location.

With continued reference to FIG. 3, the audio/video (A/V) input unit 320 is configured to provide audio or video signal input to the mobile terminal 300. As shown, the A/V input unit 320 includes a camera 321 and a microphone 322. The camera 321 receives and processes image frames of still pictures or video, which are obtained by an image sensor in a video call mode or a photographing mode. Furthermore, the processed image frames can be displayed on the display 351.

The image frames processed by the camera 321 can be stored in the memory 360 or can be transmitted to an external recipient via the wireless communication unit 310. Optionally, at least two cameras 321 can be provided in the mobile terminal 300 according to the environment of usage.

The microphone 322 receives an external audio signal while the portable device is in a particular mode, such as phone call mode, recording mode and voice recognition. This audio signal is processed and converted into electronic audio data. The processed audio data is transformed into a format transmittable to a mobile communication base station via the mobile communication module 312 in a call mode. The microphone 322 typically includes assorted noise removing algorithms to remove noise generated in the course of receiving the external audio signal.

The user input unit 330 generates input data responsive to user manipulation of an associated input device or devices. Examples of such devices include a keypad, a dome switch, a touchpad (e.g., static pressure/capacitance), a jog wheel, and a jog switch.

The sensing unit 340 provides sensing signals for controlling operations of the mobile terminal 300 using status measurements of various aspects of the mobile terminal. For instance, the sensing unit 340 may detect an open/closed status of the mobile terminal 100, the relative positioning of components (e.g., a display and keypad) of the mobile terminal 300, a change of position (or location) of the mobile terminal 300 or a component of the mobile terminal 300, a presence or absence of user contact with the mobile terminal 300, and an orientation or acceleration/deceleration of the mobile terminal 300. As an example, a mobile terminal 300 configured as a slide-type mobile terminal is considered. In this configuration, the sensing unit 340 may sense whether a sliding portion of the mobile terminal is open or closed. According to other examples, the sensing unit 340 senses the presence or absence of power provided by the power supply unit 390, and the presence or absence of a coupling or other connection between the interface unit 370 and an external device. According to one embodiment, the sensing unit 340 can include a proximity sensor 341.

The output unit 350 generates output relevant to the senses of sight, hearing, and touch. Furthermore, the output unit 350 includes the display 351, an audio output module 352, an alarm unit 353, a haptic module 354, and a projector module 355.

The display 351 is typically implemented to visually display (output) information associated with the mobile terminal 300. For instance, if the mobile terminal is operating in a phone call mode, the display will generally provide a user interface (UI) or graphical user interface (GUI) which includes information associated with placing, conducting, and terminating a phone call. As another example, if the mobile terminal 300 is in a video call mode or a photographing mode, the display 351 may additionally or alternatively display images which are associated with these modes, the UI or the GUI.

The display module 351 may be implemented using known display technologies. These technologies include, for example, a liquid crystal display (LCD), a thin film transistor-liquid crystal display (TFT-LCD), an organic light-emitting diode display (OLED), a flexible display and a three-dimensional display. The mobile terminal 300 may include one or more of such displays.

Some of the displays can be implemented in a transparent or optical transmittive type, i.e., a transparent display. A representative example of the transparent display is the TOLED (transparent OLED). A rear configuration of the display 351 can be implemented as the optical transmittive type as well. In this configuration, a user may be able to see an object located at the rear of a terminal body on a portion of the display 351 of the terminal body.

At least two displays 351 can be provided in the mobile terminal 300 in accordance with one embodiment of the mobile terminal 300. For instance, a plurality of displays can be arranged to be spaced apart from each other or to form a single body on a single face of the mobile terminal 300. Alternatively, a plurality of displays can be arranged on different faces of the mobile terminal 300.

If the display 351 and a sensor for detecting a touch action (hereinafter called 'touch sensor') are configured as a mutual layer structure (hereinafter called 'touch screen'), the display 351 is usable as an input device as well as an output device. In this case, the touch sensor can be configured as a touch film, a touch sheet, or a touchpad.

The touch sensor can be configured to convert pressure applied to a specific portion of the display 351 or a variation of capacitance generated from a specific portion of the display 351 to an electronic input signal. Moreover, the touch sensor is configurable to detect pressure of a touch as well as a touched position or size.

If a touch input is made to the touch sensor, a signal(s) corresponding to the touch input is transferred to a touch controller. The touch controller processes the signal(s) and then transfers the processed signal(s) to the controller 380. Therefore, the controller 380 is made aware when a prescribed portion of the display 351 is touched.

Referring to FIG. 3, a proximity sensor 341 can be provided at an internal area of the mobile terminal 300 enclosed by the touch screen or around the touch screen. The proximity sensor is a sensor that detects a presence or non-presence of an object approaching a prescribed detecting surface or an object existing (or located) around the proximity sensor using an electromagnetic field strength or infrared ray without mechanical contact. Hence, the proximity sensor 341 is more durable than a contact type sensor and also has utility broader than the contact type sensor.

The proximity sensor 341 can include one of a transmittive photoelectric sensor, a direct reflective photoelectric sensor, a mirror reflective photoelectric sensor, a radio frequency oscillation proximity sensor, an electrostatic capacity proximity sensor, a magnetic proximity sensor, and an infrared proximity sensor. If the touch screen includes the electrostatic capacity proximity sensor, it is configured to detect the proximity of a pointer using a variation of an electric field according to the proximity of the pointer. In this configuration, the touch screen (touch sensor) can be considered as the proximity sensor.

For clarity and convenience of explanation, an action for enabling the pointer approaching the touch screen to be recognized as placed on the touch screen may be named 'proximity touch' and an action of enabling the pointer to actually come into contact with the touch screen may be referred to as 'contact touch'. And, a position, at which the proximity touch is made to the touch screen using the pointer, may mean a position of the pointer vertically corresponding to the touch screen when the pointer makes the proximity touch.

The proximity sensor detects a proximity touch and a proximity touch pattern (e.g., a proximity touch distance, a proximity touch duration, a proximity touch position, a proximity touch shift state). Information corresponding to the detected proximity touch action and the detected proximity touch pattern can be output to the touch screen.

The audio output module 352 functions in various modes including a call-receiving mode, a call-placing mode, a recording mode, a voice recognition mode, and a broadcast reception mode to output audio data which is received from the wireless communication unit 310 or is stored in the memory 360. During operation, the audio output module 352 outputs audio relating to a particular function (e.g., call received, message received). The audio output module 352 may be implemented using one or more speakers, buzzers, other audio producing devices, and combinations of these devices.

The alarm unit 353 outputs a signal for announcing the occurrence of a particular event associated with the mobile terminal 300. Typical events include a call received, a message received and a touch input received. The alarm unit 353 is able to output a signal for announcing the event occurrence by way of vibration as well as video or audio signal. The video or audio signal can be output via the display 351 or the audio output module 352. Hence, the display 351 or the audio output module 352 can be regarded as a part of the alarm unit 353.

The haptic module 354 generates various tactile effects that can be sensed by a user. Vibration is a representative one of the tactile effects generated by the haptic module 354. The strength and pattern of the vibration generated by the haptic module 354 are controllable. For instance, different vibrations can be output in a manner of being synthesized together or can be output in sequence.

The haptic module 354 is able to generate various tactile effects as well as the vibration. For instance, the haptic module 354 may generate an effect attributed to the arrangement of pins vertically moving against a contact skin surface, an effect attributed to the injection/suction power of air though an injection/suction hole, an effect attributed to the skim over a skin surface, an effect attributed to a contact with an electrode, an effect attributed to an electrostatic force, and an effect attributed to the representation of a hot/cold sense using an endothermic or exothermic device.

The haptic module 354 can be implemented to enable a user to sense the tactile effect through a muscle sense of a finger or an arm as well as to transfer the tactile effect through direct contact. Optionally, at least two haptic modules 354 can be provided in the mobile terminal 300 in accordance with an embodiment of the mobile terminal 300.

The memory 360 is generally used to store various types of data to support the processing, control, and storage requirements of the mobile terminal 300. Examples of such data include program instructions for applications operating on the mobile terminal 300, contact data, phonebook data, messages, audio, still pictures (or photo), and moving pictures. Furthermore, a recent use history or a cumulative use frequency of each data (e.g., use frequency for each phonebook, each message or each multimedia file) can be stored in the memory 360.

Moreover, data for various patterns of vibration and/or sound output in response to a touch input to the touch screen can be stored in the memory 360.

The memory 360 may be implemented using any type or combination of suitable volatile and non-volatile memory or storage devices including hard disk, random access memory (RAM), static random access memory (SRAM), electrically erasable programmable read-only memory (EEPROM), erasable programmable read-only memory (EPROM), programmable read-only memory (PROM), read-only memory (ROM), magnetic memory, flash memory, magnetic or optical disk, multimedia card micro type memory, card-type memory (e.g., SD memory or XD memory), or other similar memory or data storage device. Furthermore, the mobile terminal 300 is able to operate in association with a web storage for performing a storage function of the memory 360 on the Internet.

The interface unit 370 may be implemented to couple the mobile terminal 100 with external devices. The interface unit 370 receives data from the external devices or is supplied with power and then transfers the data or power to the respective elements of the mobile terminal 300 or enables data within the mobile terminal 300 to be transferred to the external devices. The interface unit 370 may be configured using a wired/wireless headset port, an external charger port, a wired/wireless data port, a memory card port, a port for coupling to a device having an identity module, audio input/output ports, video input/output ports, and/or an earphone port.

The identity module is a chip for storing various kinds of information for authenticating a usage authority of the mobile terminal 300 and can include a User Identify Module (UIM), a Subscriber Identity Module (SIM), and/or a Universal Subscriber Identity Module (USIM). A device having the identity module (hereinafter called 'identity device') can be manufactured as a smart card. Therefore, the identity device is connectible to the mobile terminal 300 via the corresponding port.

When the mobile terminal 300 is connected to an external cradle, the interface unit 370 becomes a passage for supplying the mobile terminal 300 with a power from the cradle or a passage for delivering various command signals input from the cradle by a user to the mobile terminal 300. Each of the various command signals input from the cradle or the power can operate as a signal enabling the mobile terminal 300 to recognize that it is correctly loaded in the cradle.

The controller 380 typically controls the overall operations of the mobile terminal 300. For example, the controller 380 performs the control and processing associated with voice calls, data communications, and video calls. The controller 380 may include a multimedia module 381 that provides multimedia playback. The multimedia module 381 may be configured as part of the controller 380, or implemented as a separate component.

Moreover, the controller 380 is able to perform a pattern (or image) recognizing process for recognizing a writing input and a picture drawing input carried out on the touch screen as characters or images, respectively.

The power supply unit 390 provides power required by various components of the mobile terminal 300. The power may be internal power, external power, or combinations of internal and external power.

Various embodiments described herein may be implemented in a computer-readable medium using, for example, computer software, hardware, or some combination of computer software and hardware. For a hardware implementation, the embodiments described herein may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described herein, or a selective combination thereof. Such embodiments may also be implemented by the controller 180.

For a software implementation, the embodiments described herein may be implemented with separate software modules, such as procedures and functions, each of which performs one or more of the functions and operations described herein. The software codes can be implemented with a software application written in any suitable programming language and may be stored in memory such as the memory 160, and executed by a controller or processor, such as the controller 380.

Figure 4:
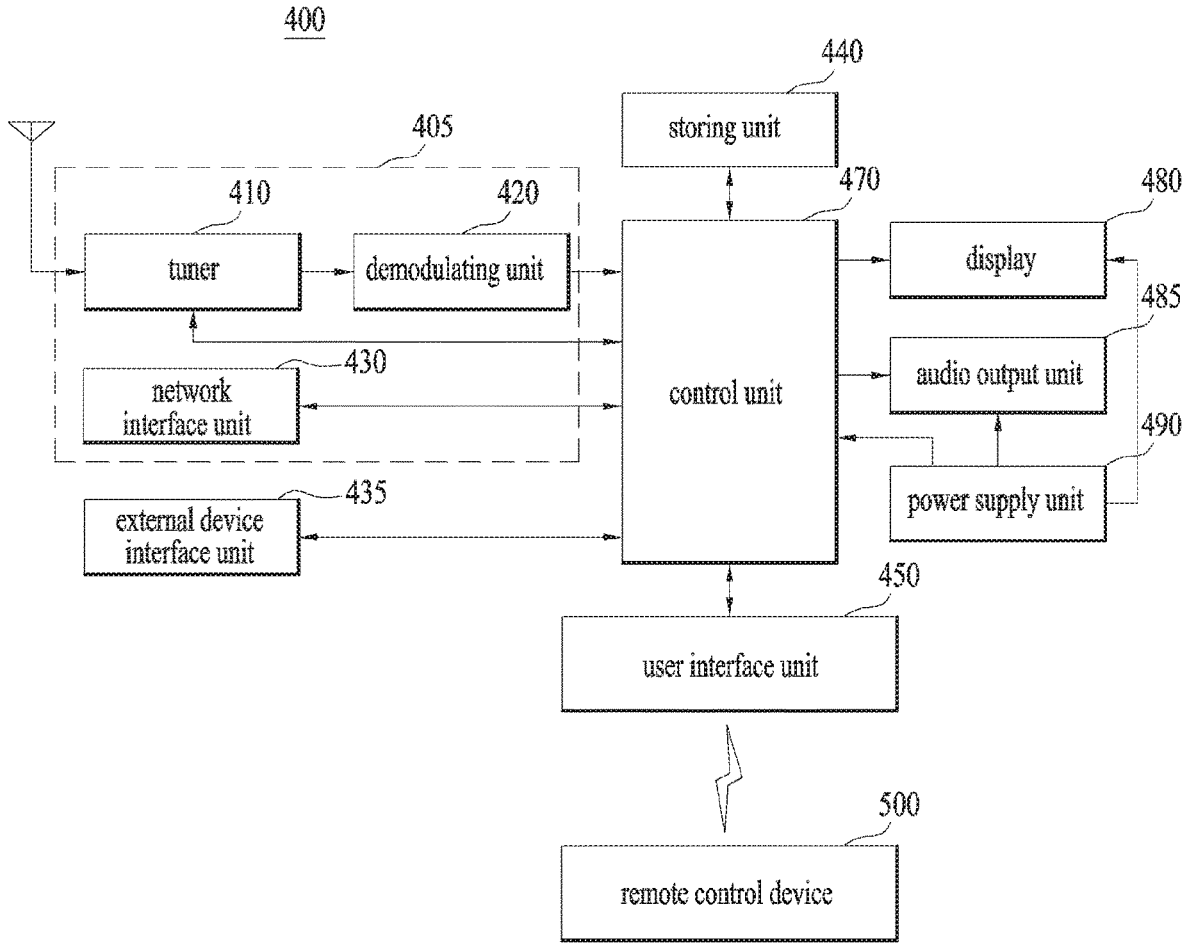
FIG. 4 is a diagram showing a digital device according to another embodiment of the present invention.

FIG. 4 illustrates a digital receiver according to another embodiment of the present invention.

Referring to FIG. 4, an exemplary digital receiver 400 according to the present invention may include a broadcast receiving unit 405, an external device interface 435, a storage unit 440, a user input interface 450, a controller 470, a display unit 480, an audio output unit 485, a power supply unit 490, and a photographing unit (not shown). The broadcast receiving unit 305 may include at least one of one or more tuner 410, a demodulator 420, and a network interface 430. The broadcast receiving unit 405 may include the tuner 410 and the demodulator 420 without the network interface 430, or may include the network interface 430 without the tuner 410 and the demodulator 420. The broadcast receiving unit 405 may include a multiplexer (not shown) to multiplex a signal, which is subjected to the tuner 410 and demodulated by the demodulator 420, and a signal received through the network interface 40. In addition, the broadcast receiving unit 405 can include a demultiplexer (not shown) and demultiplex a multiplexed signal, a demodulated signal, or a signal received through the network interface 430.

The tuner 410 may receive a radio frequency (RF) broadcast signal by tuning to a channel selected by the user from among RF broadcast signals received through an antenna or all previously stored channels.

The demodulator 420 may receive a digital IF (Intermediate Frequency) signal (DIF) converted by the tuner 410 and demodulate the DIF signal.

A stream signal output from the demodulator 420 may be input to the controller 470. The controller 470 can control demultiplexing, audio/video signal processing, etc. Furthermore, the controller 470 can control output of an image through the display unit 480 and output of audio through the audio output unit 485.

The external device interface 435 may provide an environment for interfacing external devices with the digital receiver 400. To implement this, the external device interface 435 may include an A/V input/output unit (not shown) or an RF communication unit (not shown).

The external device interface 435 can be connected with external devices such as a digital versatile disk (DVD), a Blu-ray player, a game device, a camera, a camcorder, a computer (notebook computer), a Cloud and a mobile device (e.g., a Smart Phone, a tablet PC, and the like) in a wired/wireless manner.

The A/V input/output unit may include a USB (Universal Serial Bus) terminal, a composite video banking sync (CVBS) terminal, a component terminal, an S-video terminal (analog), a digital visual interface (DVI) terminal, a high definition multimedia interface (HDMI) terminal, an RGB terminal, a D-SUB terminal, etc.

The RF communication unit can perform near field communication. The digital receiver 400 can be networked with other electronic apparatuses according to communication protocols such as Bluetooth, radio frequency identification (RFID), infrared data association (IrDA), ultra wideband (UWB), ZigBee, and digital living network alliance (DLNA), for example.

The network interface 430 may provide an interface for connecting the digital receiver 400 to wired/wireless networks.

Using the network interface 430, the digital receiver can transmit/receive data to/from other users or other electronic apparatuses or access a predetermined web page through a network connected thereto or another network linked to the connected network.

The network interface 430 can selectively receive a desired application from among publicly open applications through a network.

The storage unit 440 may store programs for signal processing and control and store a processed video, audio or data signal.

In addition, the storage unit 440 may execute a function of temporarily storing a video, audio or data signal input from the external device interface 435 or the network interface 430. The storage unit 440 may store information about a predetermined broadcast channel through a channel memory function.

The storage unit 440 can store an application or a list of applications input from the external device interface 435 or the network interface 430. The storage unit 440 may store various platforms which will be described later. The storage unit 440 can include storage media of one or more types, such as a flash memory type, a hard disk type, a multimedia card micro type, a card type memory (e.g. SD or XD memory), RAM, EEPROM, etc. The digital receiver 400 may reproduce content files (a video file, a still image file, a music file, a text file, an application file, etc.) and provide them to the user.

While FIG. 4 illustrates an embodiment in which the storage unit 440 is separated from the controller 470, the configuration of the digital receiver 400 is not limited thereto and the storage unit 440 may be included in the controller 470.

The user input interface 450 may transmit a signal input by the user to the controller 470 or deliver a signal output from the controller 470 to the user.

For example, the user input interface 450 can receive control signals such as a power on/off signal, a channel selection signal, an image setting signal, etc. from the remote controller 500 or transmit control signals of the controller 470 to the remote controller 500 according to various communication schemes such as RF communication, IR communication, and the like.

The user input interface 450 can transmit control signals input through a power key, a channel key, a volume key, and a local key (not shown) of a set value to the controller 470.

The user input interface 450 can transmit a control signal input from a sensing unit (not shown) which senses a gesture of the user or deliver a signal of the controller 470 to the sensing unit (not shown). Here, the sensing unit (not shown) may include a touch sensor, a voice sensor, a position sensor, an action sensor, an acceleration sensor, a gyro sensor, a speed sensor, a tilt sensor, a temperature sensor, a pressure or back-pressure sensor, etc.

The controller 470 can generate and output a signal for video or audio output by demultiplexing streams input through the tuner 410, the demodulator 420 or the external device interface 435 or processing demultiplexed signals.

A video signal processed by the controller 470 can be input to the display unit 380 and displayed as an image through the display unit 480. In addition, the video signal processed by the controller 470 can be input to an external output device through the external device interface 435.

An audio signal processed by the controller 470 can be applied to the audio output unit 485. Otherwise, the audio signal processed by the controller 470 can be applied to an external output device through the external device interface 435.

The controller 470 may include a demultiplexer and an image processor, which are not shown in FIG. 4.

The controller 470 can control the overall operation of the digital receiver 300. For example, the controller 470 can control the tuner 410 to tune to an RF broadcast corresponding to a channel selected by the user or a previously stored channel.

The controller 470 can control the digital receiver 400 according to a user command input through the user input interface 450 or an internal program. Particularly, the controller 470 can control the digital receiver 400 to be linked to a network to download an application or application list that the user desires to the digital receiver 400.

For example, the controller 470 may control the tuner 410 to receive a signal of a channel selected in response to a predetermined channel selection command received through the user input interface 450. In addition, the controller 470 may process a video, audio or data signal corresponding to the selected channel. The controller 470 may control information on a channel selected by the user to be output with a processed video or audio signal through the display unit 480 or the audio output unit 485.

Alternatively, the controller 470 may control a video signal or an audio signal received from an external apparatus, for example, a camera or a camcorder through the external device interface 435 to be output through the display unit 480 or the audio output unit 485 according to an external device image reproduction command received through the user input interface 450.

The controller 470 can control the display unit 480 to display images. For example, the controller 470 can control a broadcast image input through the tuner 410, an external input image received through the external device interface 435, an image input through the network interface 430, or an image stored in the storage unit 440 to be displayed on the display unit 480. Here, an image displayed on the display unit 480 can be a still image or video, and it can be a 2D or 3D image.

The controller 470 can control reproduction of content. Here, the content may be content stored in the digital receiver 400, received broadcast content, or content input from an external device. The content may include at least one of a broadcast image, an external input image, an audio file, a still image, an image of a linked web, and a text file.

The controller 470 can control display of applications or an application list, downloadable from the digital receiver 400 or an external network, when an application view menu is selected.

The controller 470 can control installation and execution of applications downloaded from an external network in addition to various user interfaces. Furthermore, the controller 470 can control an image relating to an application executed by user selection to be displayed on the display unit 480.

The digital receiver 400 may further include a channel browsing processor (not shown) which generates a thumbnail image corresponding to a channel signal or an external input signal.

The channel browsing processor can receive a stream signal (e.g., TS) output from the demodulator 420 or a stream signal output from the external device interface 435 and extract an image from the received stream signal to generate a thumbnail image. The generated thumbnail image can be directly input to the controller 470 or can be encoded and then input to the controller 470. Also, the thumbnail image can be coded into a stream and then applied to the controller 470. The controller 470 can display a thumbnail list including a plurality of thumbnail images on the display unit 480 using thumbnail images input thereto. The thumbnail images included in the thumbnail list can be updated sequentially or simultaneously. Accordingly, the user can conveniently check content of a plurality of broadcast channels.

The display unit 480 may convert a video signal, a data signal, and an OSD signal processed by the controller 470 and a video signal and a data signal received from the external device interface 435 into RGB signals to generate driving signals. The display unit 480 may be a PDP, an LCD, an OLED, a flexible display, a 3D display or the like. The display unit 480 may be configured as a touch-screen and used as an input device rather than an output device. The audio output unit 485 receives a signal audio-processed by the controller 470, for example, a stereo signal, a 3.1 channel signal or a 5.1 channel signal, and outputs the received signal as audio. The audio output unit 485 can be configured as one of various speakers.

The digital receiver 400 may further include the sensing unit (not shown) for sensing a gesture of the user, which includes at least one of a touch sensor, a voice sensor, a position sensor, and an action sensor, as described above. A signal sensed by the sensing unit (not shown) can be delivered to the controller 470 through the user input interface 450. The digital receiver 400 may further include the photographing unit (not shown) for photographing the user. Image information acquired by the photographing unit (not shown) can be supplied to the controller 470. The controller 470 may sense a gesture of the user from an image captured by the photographing unit (not shown) or a signal sensed by the sensing unit (not shown), or by combining the image and the signal.

The power supply unit 490 may supply power to the digital receiver 400. Particularly, the power supply unit 490 can supply power to the controller 470 which can be implemented as a system-on-chip (SoC), the display unit 480 for displaying images, and the audio output unit 485 for audio output.

The remote controller 500 may transmit user input to the user input interface 450. To achieve this, the remote controller 500 can use Bluetooth, RF communication, IR communication, UWB, ZigBee, etc. In addition, the remote controller 500 can receive audio, video or data signal output from the user input interface 350 and display the received signal or output the same as audio or vibration.

The functions of the application manager shown in FIG. 2 can be divided and executed by the controller 470, the storage unit 440, the user interface 450, the display unit 480 and the audio output unit 485 which are controlled by the controller 470.

The digital receivers shown in FIGS. 2 and 4 are exemplary and components thereof can be integrated, added or omitted according to specifications thereof. That is, two or more components can be integrated into one component or one component can be subdivided into two or more components as required. The function executed by each component is exemplified to describe embodiments of the present invention and detailed operations or devices do not limit the scope of the present invention. Some of the components shown in FIG. 2 may be omitted or a component (not shown in FIG. 2) may be added as required. The digital receiver according to the present invention may not include the tuner and the demodulator, differently from the digital receivers shown in FIGS. 2 and 4, and may receive content through the network interface or the external device interface and reproduce the content.

The digital receiver is an example of image signal processors which process an image stored therein or an input image. Other examples of the image signal processors may include a set-top box (STB) which does not include the display unit 380 and the audio output unit 485 shown in FIG. 4, a DVD player, a Blu-ray player, a game device, a computer, etc.

Figure 5:
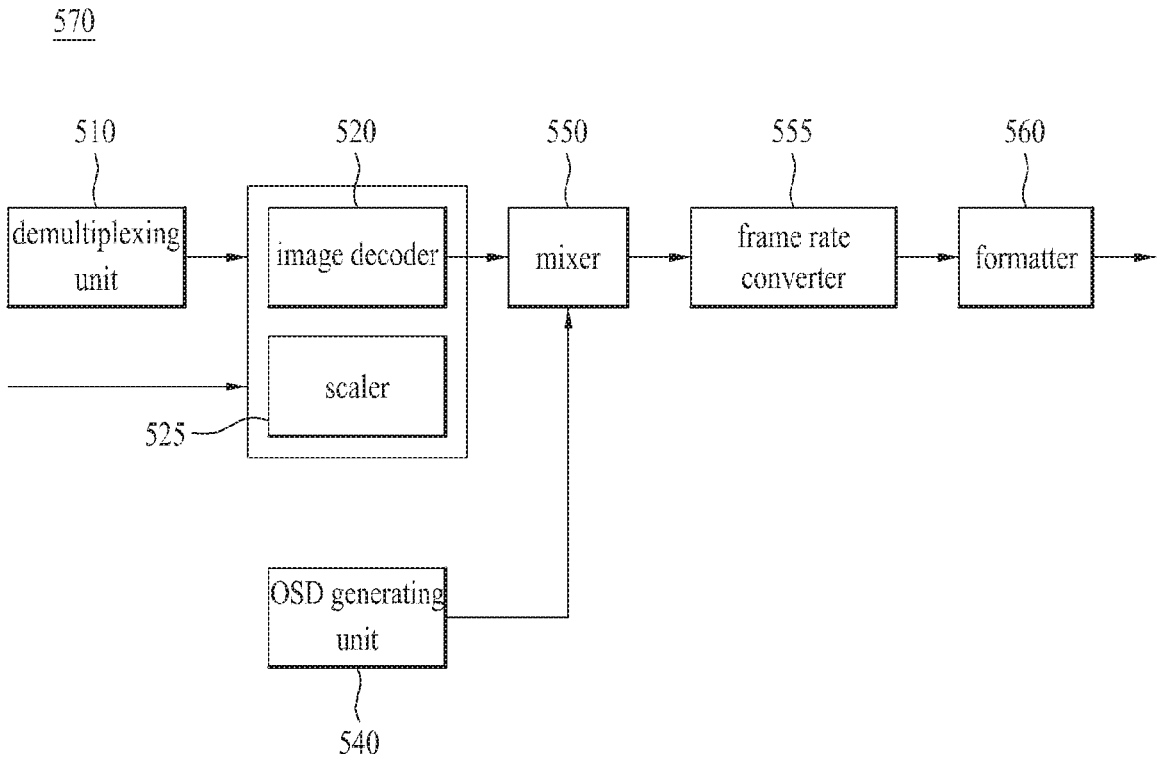
FIG. 5 is a block diagram showing the detailed configuration of each of controllers of FIGS. 2 to 4 according to one embodiment of the present invention.

FIG. 5 illustrates a digital receiver according to another embodiment of the present invention. Particularly, FIG. 5 shows a configuration for implementing a 3D digital receiver, which can be included in the configurations of FIGS. 2 and 3.

The digital receiver according to the present invention may include a demultiplexer 510, an image processor 520, an OSD generator 540, a mixer 550, a frame rate converter (FRC) 555, and a 3D formatter (or an Output formatter) 560.

The demultiplexer 510 can demultiplex an input stream signal into an MPEG-2 TS image, an audio signal and a data signal, for example.

The image processor can process a demultiplexed image signal using a video decoder 525 and a scaler 535. The video decoder 525 can decode the demultiplexed image signal and the scaler 535 can scale the resolution of the decoded image signal such that the image signal can be displayed.

The image signal decoded by the image processor 520 may be input to the mixer 550.

The OSD generator 540 may generate OSD data automatically or according to user input. For example, the OSD generator 540 may generate data to be displayed on the screen of an output unit in the form of an image or text on the basis of a control signal of a user input interface. OSD data generated by the OSD generator 540 may include various data such as a user interface image of the digital receiver, various menu screens, widget, icons, and information on ratings. The OSD generator 540 can generate a caption of a broadcast image or data for displaying EPG based broadcast information.

The mixer 550 may mix the OSD data generated by the OSD generator 540 and the image signal processed by the image processor 520. The mixer 550 may provide the mixed signal to the 3D formatter 560. By mixing the decoded image signal and the OSD data, OSD may be overlaid on a broadcast image or external input image.

The frame rate converter (FRC) 555 may convert a frame rate of input video. For example, the frame rate converter 555 can convert the frame rate of an input 60 Hz video to a frame rate of 120 Hz or 240 Hz, according to an output frequency of the output unit. The frame rate converter 555 may be bypassed when frame conversion is not executed.

The 3D formatter 560 may change the output of the frame rate converter 555, which is input thereto, into a form suitable for the output format of the output unit. For example, the 3D formatter 560 can output an RGB data signal. In this case, this RGB data signal can be output according to low voltage differential signaling (LVDS) or mini-LVDS. When a 3D image signal output from the frame rate converter 555 is input to the 3D formatter 560, the 3D formatter 560 can format the 3D image signal such that the 3D image signal is matched to the output format of the output unit, to thereby support a 3D service.

An audio processor (not shown) may audio-process a demultiplexed audio signal. The audio processor (not shown) can support various audio formats. For example, when audio signals are encoded in MPEG-2, MPEG-4, advanced audio coding (AAC), high efficiency-AAC (HE-AAC), AC-3 and bit sliced audio coding (BSAC) formats, the audio processor (not shown) can include decoders corresponding to the formats to process the audio signals. Furthermore, the audio processor (not shown) can control base, treble and volume.

In addition, a data processor (not shown) can process a demultiplexed data signal. For example, when a demultiplexed data signal is encoded, the data processor (not shown) can decode the encoded demultiplexed data signal. Here, the encoded data signal may be EPG information including broadcast information such as the start time and end time (or duration) of a broadcast program which is broadcast through each channel.

Figure 6:
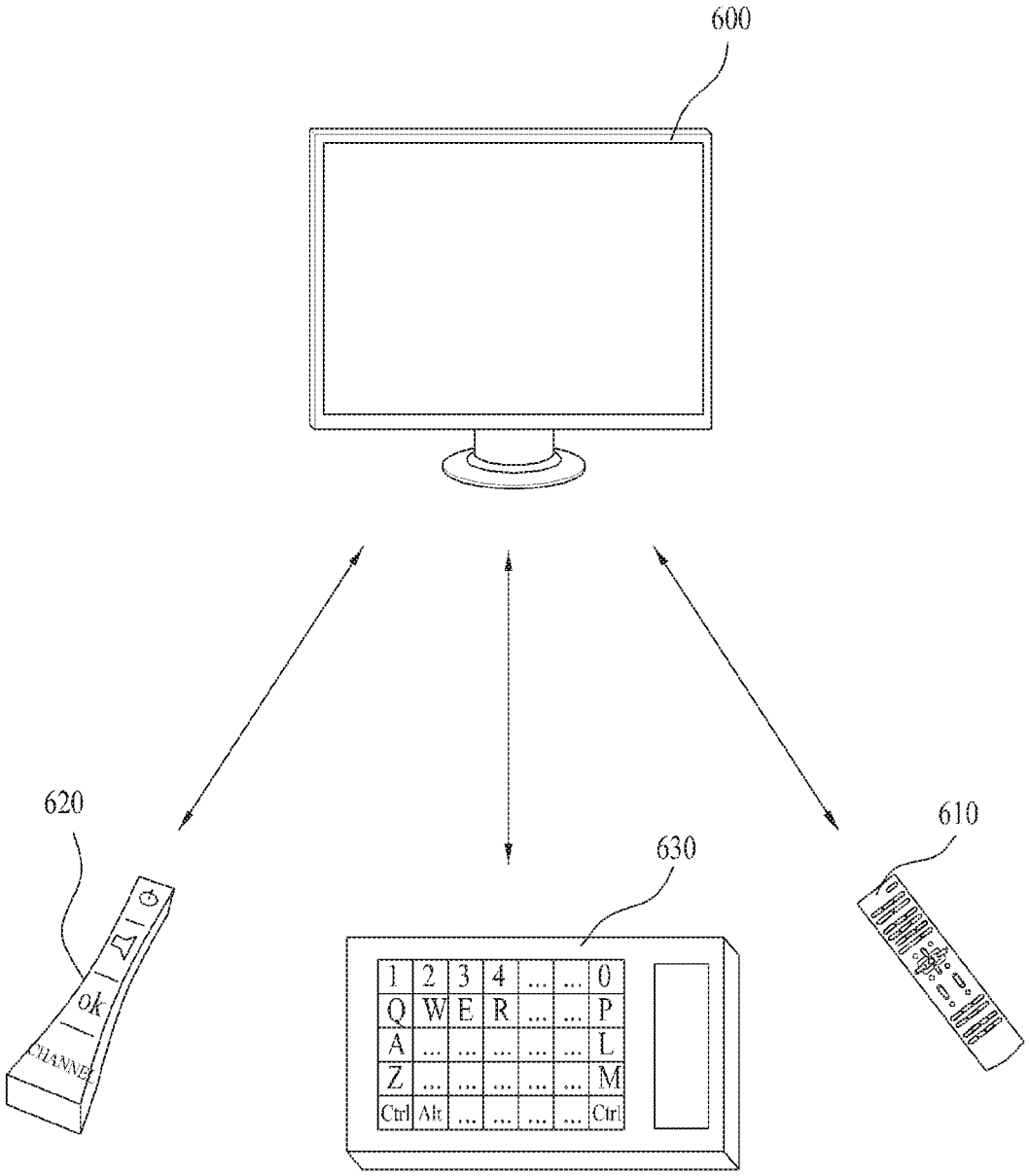
FIG. 6 is a diagram showing an input unit connected to each of the digital devices of FIGS. 2 to 4 according to one embodiment of the present invention.

FIG. 6 illustrates remote controllers of a digital receiver according to an embodiment of the present invention.

To execute various operations for implementing the present invention according to embodiments, various user interface devices (UIDs) which can communicate with a digital receiver 600 in a wired/wireless manner can be used as remote controllers.

The remote controllers can use various communication protocols such as Bluetooth, RFID, IrDA, UWB, ZigBee, DLNA, etc.

UIDs can include a mobile device (e.g., a smart phone, a tablet PC, and the like), a magic remote controller 620 and a remote controller 630 equipped with a keyboard and a touch pad in addition to a general remote controller 610.

The magic remote controller 620 may include a gyro sensor mounted therein to sense vibration of a user's hand or rotation. That is, the magic remote controller 620 can move a pointer according to up, down, left and right motions of the user such that the user can easily execute a desired action, for example, easily control a channel or a menu.

The remote controller 630 including the keyboard and touch pad can facilitate text input through the keyboard and control of movement of a pointer and magnification and reduction of a picture or video through the touch pad.

The digital device described in the present specification can be operated by based on WebOS platform. Hereinafter, a WebOS based process or algorithm may be performed by the controller of the above-described digital device. The controller includes the controllers of FIGS. 2 to 5 and has wide concepts. Accordingly, hereinafter, a component for processing WebOS based services, applications, content, etc., including software, firmware or hardware in a digital device is referred to a controller.

Such a WebOS based platform may improve development independency and functional extensibility by integrating services, applications, etc. based on a Luna-service bus, for example, and increase application development productivity based on web application framework. In addition, system resources, etc. may be efficiently used via a WebOS process and resource management to support multitasking.

A WebOS platform described in the present specification may be available or loaded not only for stationary devices such as personal computers (PCs), TVs and set top boxes (STBs) but also for mobile devices such as cellular phones, smartphones tablet PCs, laptops, and wearable devices.

A software structure for a digital device is a monolithic structure which solves conventional problems depending on markets, is a single process and closed product based on multi-threading, and has difficulties in terms of external applications. In pursuit of new platform based development, cost innovation via chipset replacement and UI application and external application development efficiency, layering and componentization are performed to obtain a 3-layered structure and an add-on structure for an add-on, a single source product and an open application. Recently, modular design of a software structure has been conducted in order to provide a web open application programming interface (API) for an echo system and modular architecture of a functional unit or a native open API for a game engine, and thus a multi-process structure based on a service structure has been produced.

Television Based on WebOS

Figure 7:
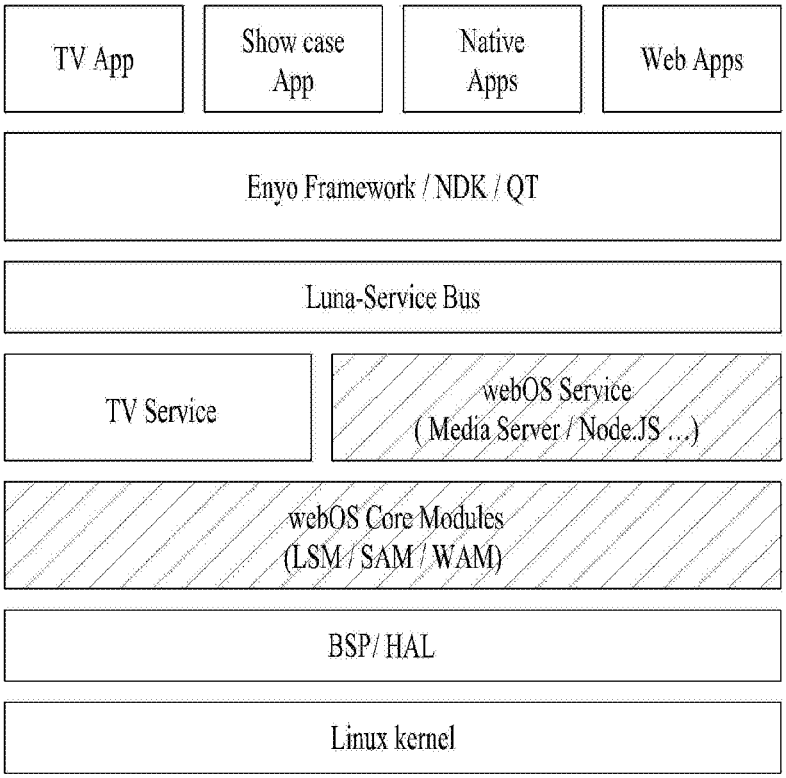
FIG. 7 is a diagram illustrating WebOS architecture according to one embodiment of the present invention.

FIG. 7 is a diagram illustrating WebOS architecture according to one embodiment of the present invention.

The architecture of a WebOS platform will now be described with reference to FIG. 7.

The platform may be largely divided into a kernel, a webOS core platform based on a system library, an application, a service, etc.

The architecture of the WebOS platform has a layered structure. OS is provided at a lowest layer, system library(s) are provided at a next highest layer and applications are provided at the highest layer.

First, the lowest layer is an OS layer including a Linux kernel such that Linux is included as an OS of the digital device.

At layers higher than the OS layer, a board support package (BSP)/hardware abstraction layer (HAL) layer, a WebOS core modules layer, a service layer, a Luna-service bus layer and an Enyo framework/native developer's kit (NDK)/QT layer are sequentially provided. At the highest layer, an application layer is provided.

One or more layers of the above-described WebOS layered structure may be omitted and a plurality of layers may be combined to one layer and one layer may be divided into a plurality of layers.

The WebOS core module layer may include a Luna surface manager (LSM) for managing a surface window, etc., a system & application manager (SAM) for managing execution and performance status of applications, etc., and a web application manager (WAM) for managing web applications based on WebKit.

The LSM manages an application window displayed on a screen. The LSM may control display hardware (HW) and provide a buffer for rendering content necessary for applications, and compose and output results of rendering a plurality of applications on a screen.

The SAM manages policy according to several conditions of systems and applications.

The WAM is based on Enyo framework, because a WebOS regards a web application as a basic application.

An application may use a service via a Luna-service bus. A service may be newly registered via a bus and the application may detect and use a desired service.

The service layer may include services having various service levels, such as a TV service, a WebOS service, etc.

The WebOS service may include a media server, Node.JS, etc. and, in particular, the Node.JS service supports JavaScript, for example.

The WebOS service may be communicated to a Linux process implementing function logic via a bus. This WebOS service is largely divided into four parts, migrates from a TV process and an existing TV to a WebOS, is developed as services which differ between manufacturers, WebOS common services and Javascripts, and is composed of the Node.JS service used via Node.JS.

The application layer may include all applications supportable by a digital device, such as a TV application, a showcase application, a native application, a web application, etc.

Applications on the WebOS may be divided into a web application, a palm development kit (PDK) application, a Qt Meta Language or Qt Modeling Language (QML) application, etc. according to implementation methods.

The web application is based on a WebKit engine and is performed on WAM runtime. Such a web application is based on Enyo framework or may be developed and performed based on general HTML5, cascading style sheets (CSS) and JavaScripts.

The PDK application includes a native application developed with C/C++ based on a PDK provided for a third party or an external developer. The PDK refers to a set of development libraries and tools provided to enable a third party to develop a native application (C/C++) such as games. For example, the PDK application may be used to develop applications requiring high performance.

The QML application is a native application based on Qt and includes basic applications provided along with the WebOS platform, such as card view, home dashboard, virtual keyboard, etc. QML is a markup language of a script format, not C++.

The native application is an application which is developed and compiled using C/C++ and is executed in the binary form and has an advantage such as high execution speed.

Figure 8:
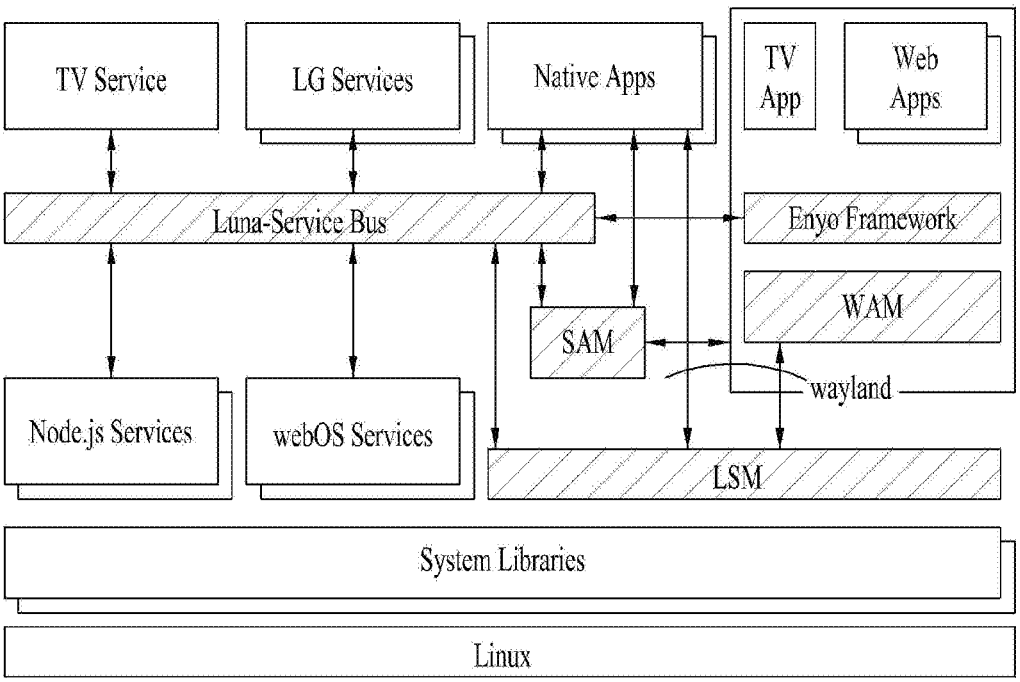
FIG. 8 is a diagram illustrating architecture of a WebOS device according to one embodiment of the present invention.

FIG. 8 is a diagram illustrating the architecture of a WebOS device according to one embodiment of the present invention.

FIG. 8 is a block diagram based on a runtime of a WebOS device and is described with reference to the layered structure of FIG. 7.

Hereinafter, a description will be given with reference to FIGS. 7 and 8.

Referring to FIG. 8, services, applications and WebOS core modules are included on a system OS (Linux) and system libraries and communication therebetween may be performed via a Luna-service bus.

Node.JS services based on HTML5 such as e-mail, contact or calendar, CSS, Javascript, etc., WebOS services such as logging, backup, file notify, database (DB), activity manager, system policy, audio daemon (AudioD), update, media server, etc., TV services such as electronic program guide (EPG), personal video recorder (PVR), data broadcasting, etc., CP services such as voice recognition, Now on, notification, search, auto content recognition (ACR), contents list browser (CBOX), wfdd, digital media remastering (DMR), remote application, download, Sony Philips digital interface format (SDPIF), etc., native applications such as PDK applications, browsers, QML applications, a UI-related TV applications based on Enyo framework and web applications are processed via WebOS core modules such as the above-described SAM, WAM and LSM via the Luna-service bus. The TV applications and the web applications are not necessarily based on Enyo framework or related to UI.

The CBOX may manage metadata and lists of content of external devices such as USB drivers, DLNA devices or Cloud servers connected to a TV. The CBOX may output content listing of various content containers such as USB, data management system (DMS), DVR, Cloud server, etc. as an integrated view. The CBOX may display various types of content listings such as pictures, music or video and manage metadata thereof. The CBOX may output content of an attached storage in real time. For example, if a storage device such as a USB is plugged in, the CBOX should immediately output a content list of the storage device. At this time, a standardized method for processing the content listing may be defined. The CBOX may accommodate various connection protocols.

The SAM is used to improve module complexity and extensibility. For example, an existing system manager processes several functions such as system UI, window management, web application runtime and UX constraint processing via one process and thus has high implementation complexity. In order to solve such a problem, the SAM divides main functions and clarifies an interface between functions, thereby decreasing implementation complexity.

The LSM is supported to independently develop and integrate a system UX such as card view, launcher, etc. and to easily cope with change in product requirements. The LSM maximally uses hardware resources to enable multitasking if a plurality of application screens is composed using an app-on-app method and may provide a window management mechanism for 21:9 and a multi-window.

The LSM supports implementation of a system UI based on a QML and improves development productivity. QML UX may easily configure a view using a screen layout and UI components based on model view controller (MVC) and easily develop code for processing user input. An interface between the QML and the WebOS component is achieved via a QML extensibility plug-in and graphic operation of an application may be based on Wayland protocol, luna-service call, etc.

The LSM is an abbreviation for a Luna surface manager and functions as an application window compositor.

The LSM composes and outputs independently developed applications, UI components, etc. on a screen. When components such as recent applications, showcase applications or launcher applications render respective content, the LSM defines an output area, a linkage method, etc. as a compositor. The LSM functioning as a compositor performs processing such as graphic composition, focus management, input events, etc. At this time, the LSM receives event, focus, etc. from an input manager, and a remote controller, a HID such as a mouse and keyboard, a joystick, a game pad, a remote application, a pen touch, etc. may be included as an input manager.

The LSM supports multiple window models and may be simultaneously executed in all applications as a system UI. The LSM may support launcher, recents, setting, notification, system keyboard, volume UI, search, finger gesture, voice recognition (speech to text (STT), text to speech (TTS), natural language processing (NLP), etc.), pattern gesture (camera or mobile radio control unit (MRCU)), live menu, ACR, etc.

Figure 9:
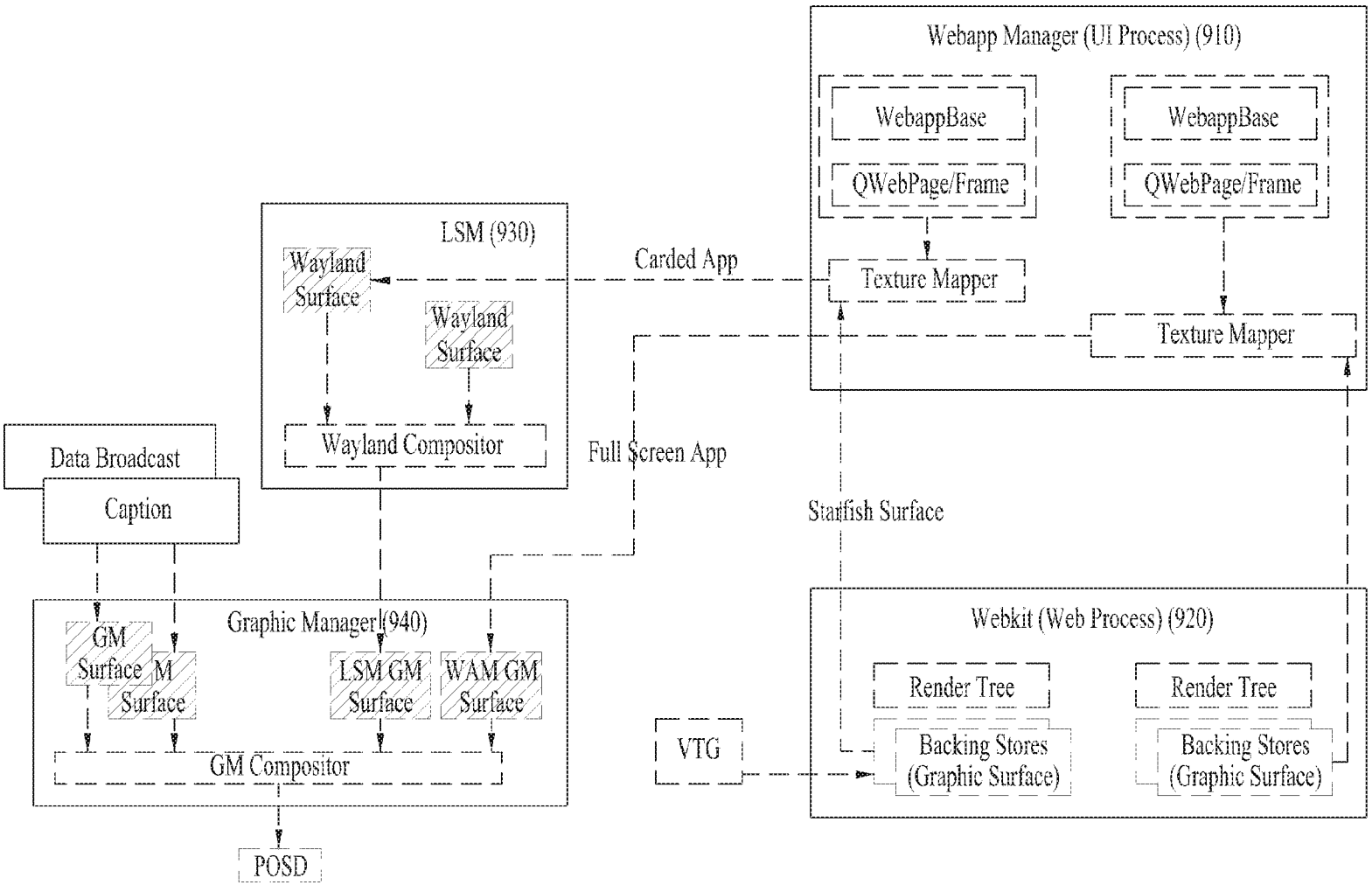
FIG. 9 is a diagram illustrating a graphic composition flow in a WebOS device according to one embodiment of the present invention.

FIG. 9 is a diagram illustrating a graphic composition flow in a WebOS device according to one embodiment of the present invention.

Referring to FIG. 9, graphic composition processing may be performed via a web application manager 910 functioning as a UI process, a WebKit 920 functioning as a web process, an LSM 930 and a graphics manager (GM) 940.

When the web application manager 910 generates web application based graphics data (or application) as a UI process, the generated graphics data is delivered to the LSM if the graphics data is not a fullscreen application. The web application manager 910 receives an application generated by the WebKit 920 in order to share a graphic processing unit (GPU) memory for graphic management between the UI process and the web process and delivers the application to the LSM 930 if the application is not a fullscreen application. If the application is a fullscreen application, the LSM 930 may bypass the application. In this case, the application is directly delivered to the graphics manager 940.

The LSM 930 transmits the received UI application to a Wayland compositor via a Wayland surface and the Wayland compositor appropriately processes the UI application and delivers the processed UI application to the graphics manager. The graphics data received from the LSM 930 is delivered to the graphics manager compositor via the LSM GM surface of the graphics manager 940, for example.

The fullscreen application is directly delivered to the graphics manager 940 without passing through the LSM 930 as described above and is processed in the graphics manager compositor via the WAM GM surface.

The graphics manager processes and outputs all graphics data in the webOS device and receives and outputs data passing through the above-described LSM GM surface, data passing through a WAM GM surface, and graphics data passing through a GM surface, such as a data broadcasting application or a caption application, on a screen. The function of the GM compositor is equal or similar to the above-described compositor.

Figure 10:
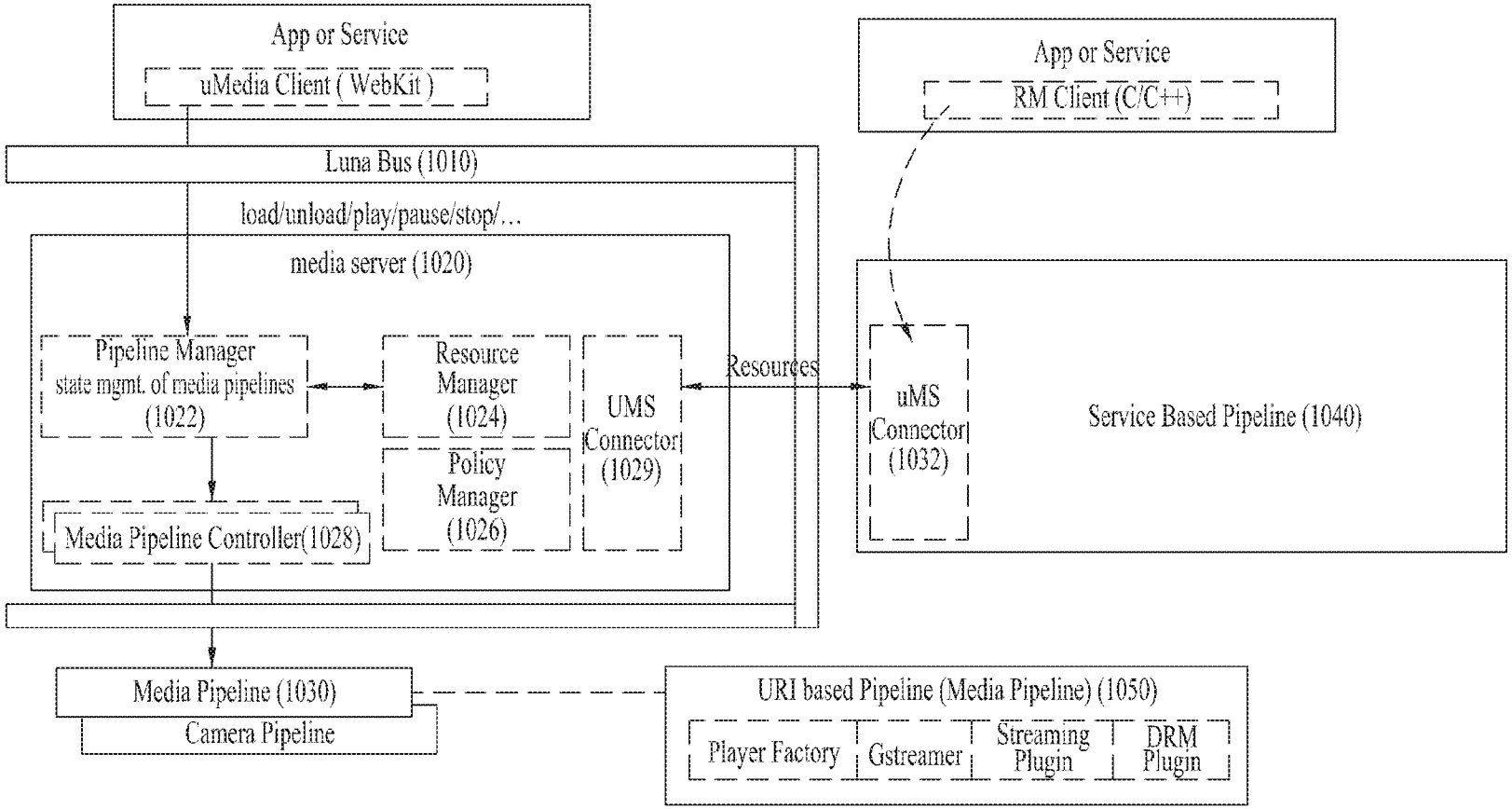
FIG. 10 is a diagram illustrating a media server according to one embodiment of the present invention.
Figure 11:
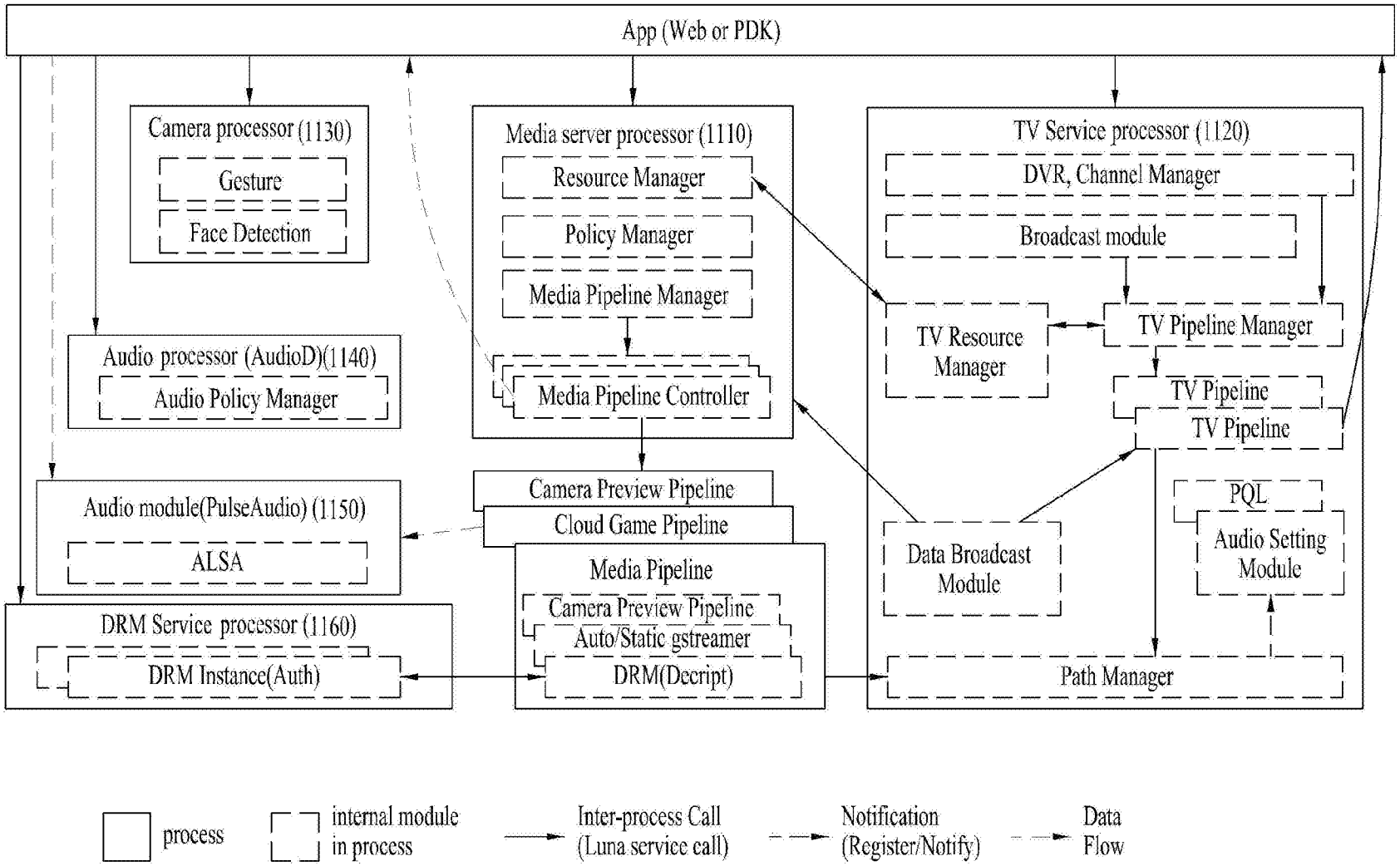
FIG. 11 is a block diagram showing the configuration of a media server according to one embodiment of the present invention.
Figure 12:
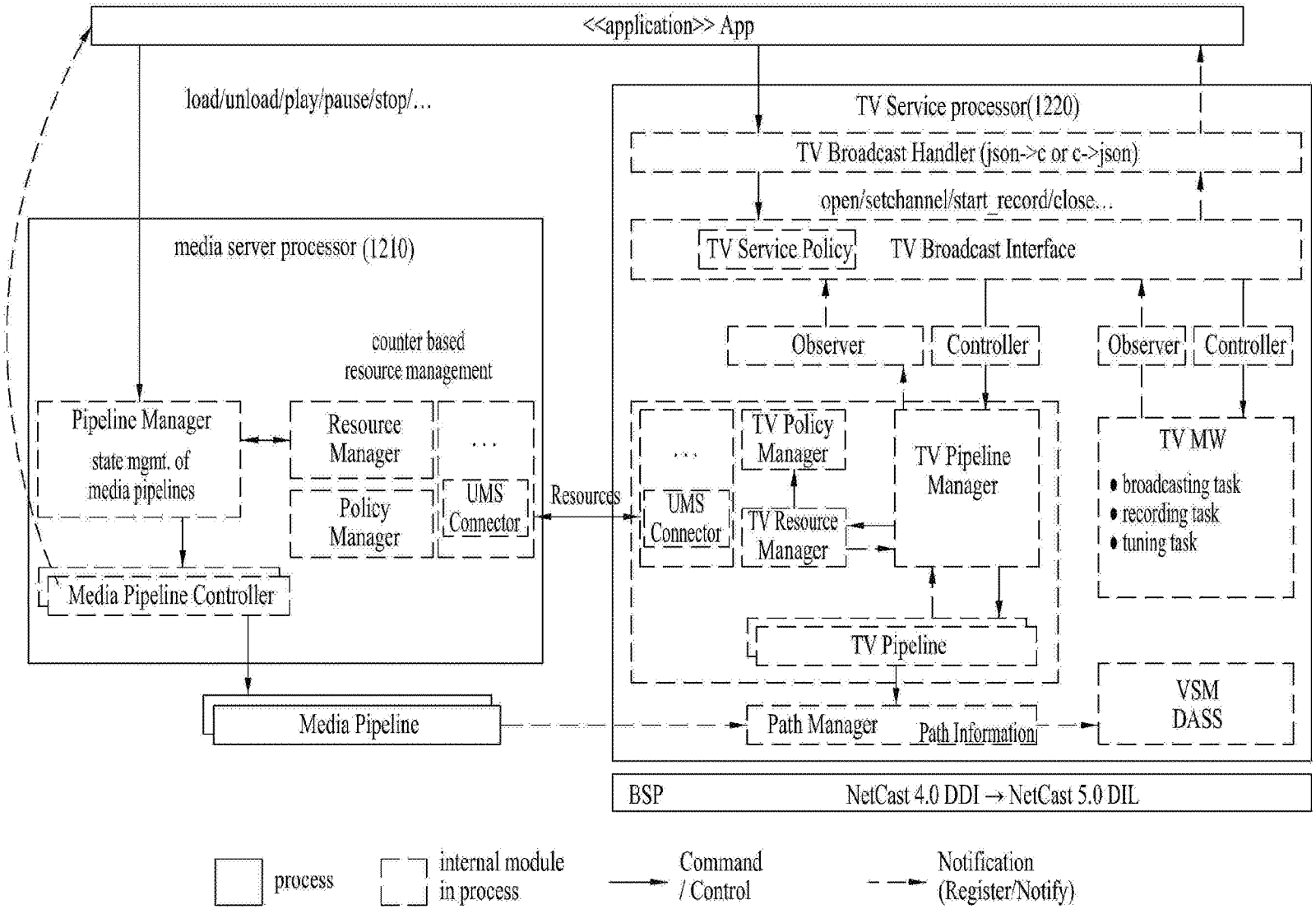
FIG. 12 is a diagram illustrating a relationship between a media server and a TV service according to one embodiment of the present invention.

FIG. 10 is a diagram illustrating a media server according to one embodiment of the present invention, FIG. 11 is a block diagram of a media server according to one embodiment of the present invention, and FIG. 12 is a diagram illustrating a relationship between a media server and a TV service according to one embodiment of the present invention.

The media server supports execution of a variety of multimedia in a digital device and manages necessary resources. The media server may efficiently use hardware resources necessary for media play. For example, the media server requires audio/video hardware resources for multimedia execution and efficiently manages a resource use status to efficiently use resources. In general, a stationary device having a screen larger than that of a mobile device requires more hardware resources upon multimedia execution and requires high encoding/decoding rate and graphics data transfer rate due to a large amount of data. The media server should perform not only streaming or file playback but also broadcasting, recording and tuning tasks, a task for simultaneously viewing and recording, and a task for simultaneous displaying a sender and a recipient on a screen upon video call. It is difficult for the media server to simultaneously perform several tasks due to restriction in hardware resources such as an encoder, a decoder, a tuner, a display engine, etc. in chipset units. For example, the media server restricts a use scenario or performs processing using user input.

The media server may make system stability robust, and may remove a playback pipeline, in which errors occur during media playback, per pipeline, such that other media play is not influenced even when errors occur. Such a pipeline is a chain for connecting unit functions such as decoding, analysis, output, etc. upon a media playback request, and required unit functions may be changed according to media type, etc.

The media server may have extensibility and may add a new type of pipeline without influencing an existing implementation method. For example, the media server may accommodate a camera pipeline, a video conference (Skype) pipeline, a third-party pipeline, etc.

The media server may process general media playback and TV task execution as separate services because the interface of the TV service is different from that of media playback. The media server supports operation such as "setchannel", "channelup", "channeldown", "channeltuning" and "recordstart" in relation to the TV service and support operation such as "play", "pause" and "stop" in relation to general media playback, that is, supports different operations with respect to the TV service and general media playback and processes the TV service and media playback as separate services.

The media server may control or manage a resource management function. Hardware resource assignment or recovery in a device is conducted by the media server. In particular, the TV service process delivers a task which is being executed and a resource assignment status to the media server. The media server secures resources to execute a pipeline whenever media is executed, allows media execution due to priority (e.g., policy) upon media execution request, and performs resource recovery of another pipeline, based on a resource status of each pipeline. The predefined execution priority and resource information necessary for a specific request are managed by a policy manager and the resource manager communicates with the policy manager to process resource assignment and recovery.

The media server may have identifiers (IDs) for all operations related to playback. For example, the media server may send a command to a specific pipeline based on the ID. The media server may send respective commands to pipelines for playback of two or more media.

The media server is responsible for playing back a HTML5 standard media.

The media server performs a service process of a TV pipeline according to a TV restructuralization range. The media server may be designed and implemented regardless of the TV restructuralization range. If the separate service process of the TV is not performed, the TV may be wholly re-executed when errors occurs in a specific task.

The media server is also referred to as uMS, that is, a micro media server. The media player is a media client and means WebKit for HTML5 video tag, camera, TV, Skype or second screen, for example.

The media server mainly manages micro resources such as a resource manager or a policy manager. The media server also controls playback of web standard media content. The media server may manage pipeline controller resources.

The media server supports extensibility, reliability, efficient resource usage, etc., for example.

In other words, the uMS, that is, the micro media server, manages and controls resource usage for appropriate processing within the WebOS device, such as resources such as cloud game, MVPD (pay service, etc.), camera preview, second screen or Skype, and TV resources. A pipeline is used upon usage of each resource, for example, and the media server may manage and control generation, deletion, use of a pipeline for resource management.

The pipeline may be generated when a media related to a task starts a sequence of request, decoding streaming and parsing such as video output. For example, in association with a TV service and an application, watching, recording, channel tuning, etc. are controlled and performed via pipelines individually generated according to requests thereof with respect to resource usage.

Referring to FIG. 10, a processing structure of a media server will be described in detail.

In FIG. 10, an application or service is connected to a media server 1020 via a Luna-service bus 1010 and the media server 1020 is connected to and managed by pipelines generated via the Luna-service bus 1010.

The application or service includes various clients according to properties thereof and may exchange data with the media server 1020 or the pipeline via the clients.

The clients include a uMedia client (WebKit) for connection with the media server 1020 and a resource manager (RM) client (C/C++), for example.

The application including the uMedia client is connected to the media server 1020 as described above. More specifically, the uMedia client corresponds to the below-described video object, for example, and uses the media server 1020, for video operation by a request, etc.

The video operation relates to a video status and may include all status data related to the video operation, such as loading, unloading, play (playback or reproduction), pause, stop, etc. Such video operations or statuses may be processed by generating individual pipelines. Accordingly, the uMedia client transmits status data related to the video operation to the pipeline manager 1022 in the media server.

The media server 1022 acquires information about resources of the current device via data communication with the resource manager 1024 and requests assignment of resources corresponding to the status data of the uMedia client. At this time, the pipeline manager 1022 or the resource manager 1024 controls resource assignment via data communication with the policy manager 1026 if necessary. For example, if resources to be assigned according to the request of the pipeline manager 1022 are not present or are lacking in the resource manager 1024, resource assignment may be appropriately performed according to priority comparison of the policy manager 1026.

The pipeline manager 1022 requests to generate a pipeline for operation according to the request of the uMedia client from the media pipeline controller 102, with respect to resources assigned according to resource assignment of the resource manager 1024.

The media pipeline controller 1028 generates a necessary pipeline under control of the pipeline manager 1022. As shown, a media pipeline, a camera pipeline, a pipeline related to playback, pause or stop may be generated. The pipeline includes pipelines for HTML5, web CP, Smarthshare playback, thumbnail extraction, NDK, cinema, multimedia and hypermedia information coding experts group (MHEG), etc.

The pipeline may include a service-based pipeline and a URI based pipeline (media pipeline), for example.

Referring to FIG. 10, the application or service including the RM client may not be directly connected to the media server 1020, because the application or service can directly process a media. In other words, if the application or service directly processes a media, the media server may not be used. At this time, for pipeline generation and usage, resource management is necessary and, at this time, a uMS connector is used. When a resource management request for direct media processing of the application or service is received, the uMS connector communicates with the media server 1020 including the resource manager 1024. The media server 1020 also includes a uMS connector.

Accordingly, the application or service may cope with the request of the RM client via resource management of the resource manager 1024 via the uMS connector. The RM client may process services such as native CP, TV service, second screen, flash player, You Tube media source extensions (MSE), cloud game, Skype, etc. In this case, as described above, the resource manager 1024 may manage resources via appropriate data communication with the policy manager 1026 if necessary for resource management.

The URI based pipeline does not directly process the media unlike the above-RM client but processes the media via the media server 1020. The URI based pipeline may include player factory, Gstreamer, streaming plug-in, digital rights management (DRM) plug-in pipelines.

An interface method between the application and the media services is as follows.

An interface method using a service in a web application may be used. In this method, a Luna call method using a palm service bridge (PSB) and a method of using Cordova may be used, in which a display is extended to a video tag. In addition, a method of using HTML5 standard related to a video tag or media element may be used.

A method of using a service in PDK may be used.

Alternatively, a method of using in existing CP may be used. For backward compatibility, plug-in of an existing platform may be extended and used based on Luna.

Lastly, an interface method using a non-WebOS may be used. In this case, a Luna bus may be directly called to perform interfacing.

Seamless change is processed by a separate module (e.g., TVwin) and refers to a process of first displaying a TV program on a screen without a WebOS before or duration WebOS booting and then performing seamless processing. This is used for the purpose of first providing a basic function of a TV service, for fast response to a power-on request of a user, because a booting time of a WebOS is late. The module is a part of a TV service process and supports seamless change for providing fast booting and a basic TV function, factory mode, etc. The module is responsible for switching from the non-WebOS mode to the WebOS mode.

FIG. 11 shows the processing structure of the media server.

In FIG. 11, a solid box denotes a process component and a dotted box denotes an internal processing module of the process. A solid arrow denotes an inter-process call, that is, a Luna-service call and a dotted arrow denotes notification such as register/notify or data flow.

The service, the web application or the PDK application (hereinafter, referred to as "application") is connected to various service processing components via a Luna-service bus and is operated or controlled via the service processing components.

A data processing path is changed according to application type. For example, if the application includes image data related to a camera sensor, the image data is transmitted to and processed by a camera processor 1130. At this time, the camera processor 1130 includes a gesture or face detection module and processes image data of the received application. The camera processor 1130 may generate a pipeline via a media server processor 1110 with respect to data which requires use of a pipeline according to user selection or automatically and process the data.

Alternatively, if the application includes audio data, the audio may be processed via an audio processor (AudioD) 1140 and an audio module (PulseAudio) 1150. For example, the audio processor 1140 processes the audio data received from the application and transmits the processed audio data to the audio module 1150. At this time, the audio processor 1140 may include an audio policy manager to determine processing of the audio data. The processed audio data is processed by the audio module 1150. The application or a pipeline related thereto may notify the audio module 1150 of data related to audio data processing. The audio module 1150 includes advanced Linux sound architecture (ALSA).

Alternatively, if the application includes or processes (hereinafter, referred to as "includes") content subjected to DRM, the content data is transmitted to a DRM service processor 1160 and the DRM service processor 1160 generates a DRM instance and processes the content data subjected to DRM. The DRM service processor 1160 is connected to a DRM pipeline in a media pipeline via a Luna-service bus, for processing of the content data subjected to DRM.

Hereinafter, processing of an application including media data or TV service data (e.g., broadcast data) will be described.

FIG. 12 shows the media server processor and the TV service processor of FIG. 11 in detail.

Accordingly, a description will be given with reference to FIGS. 11 and 12.

First, if the application includes TV service data, the application is processed by the TV service processor 1120/1220.

The TV service processor 1120 includes at least one of a DVR/channel manager, a broadcast module, a TV pipeline manager, a TV resource manager, a data broadcast module, an audio setting module, a path manager, etc., for example. In FIG. 12, the TV service processor 1220 may include a TV broadcast handler, a TV broadcast interface, a service processor, TV middleware (MW), a path manager and a BSP (NetCast). The service processor may mean a module including a TV pipeline manager, a TV resource manager, a TV policy manager, a USM connector, etc., for example.

In the present specification, the TV service processor may have the configuration of FIG. 11 or FIG. 12 or a combination thereof. Some components may be omitted or other components (not shown) may be added.

The TV service processor 1120/1220 transmits DVR or channel related data to a DVR/channel manager and transmits the DVR or channel related data to the TV pipeline manager to generate and process a TV pipeline, based on attribute or type of the TV service data received from the application. If the attribute or type of the TV service data is broadcast content data, the TV service processor 1120 generates and processes a TV pipeline via the TV pipeline manager, for processing of the data via a broadcast module.

Alternatively, a JavaScript standard object notation (json) file or a file written in c is processed by the TV broadcast handler and transmitted to the TV pipeline manager via a TV broadcast interface to generate and process a TV pipeline. In this case, the TV broadcast interface may transmit the data or file passing through the TV broadcast handler to the TV pipeline manager based on TV service policy and refer to the data or file upon generating a pipeline.

The TV pipeline manager generates one or more pipelines according to a request for generation of a TV pipeline from the processing module or manager of the TV service processor, under control of the TV resource manager. The TV resource manager may be controlled by the TV policy manager, in order to request a resource assignment status for a TV service according to a request for generation of a TV pipeline of the TV pipeline manager, and may perform data communication with the media server processor 1110/1210 via a uMS connector. The resource manager in the media server processor 1110/1210 sends the resource assignment status for the TV service according to the request of the TV resource manager. For example, if the resource manager in the media server processor 1110/1210 determines that the resources for the TV service are already assigned, the TV resource manager may be notified that assignment of all resources is completed. At this time, the resource manager in the media server processor may remove a predetermined TV pipeline according to a predetermined criterion or priority of TV pipelines already assigned for the TV service along with notification and request generation of a TV pipeline for the requested TV service. Alternatively, the TV resource manager may appropriately remove a TV pipeline or may add or newly establish a TV pipeline according to a status report of the resource manager in the media server processor 1110/1210.

The BSP supports backward compatibility with an existing digital device.

The generated TV pipelines may appropriately operate under control of the path manager in the processing procedure. The path manager may determine or control the processing path or procedure of the pipelines in consideration of the TV pipeline in the processing procedure and the operation of the pipelines generated by the media server processor 1110/1210.

Next, if the application includes media data, not TV service data, the application is processed by the media server processor 1110/1210. The media server processor 1110/1210 includes a resource manager, a policy manager, a media pipeline manager, a media pipeline controller, etc. As pipelines generated under control of the media pipeline manager and the media pipeline controller, a camera preview pipeline, a cloud game pipeline, a media pipeline, etc. may be generated. The media pipeline may include streaming protocol, auto/static gstreamer, DRM, etc. and the processing flow thereof may be determined under control of the path manager. For a detailed description of the processing procedure of the media server processor 1110/1210, refer to the description of FIG. 10 and a repeated description will be omitted. In the present specification, the resource manager in the media server processor 1110/1210 may perform resource management to a counter base, for example.

View Types in Flexible Television

FIG. 13 shows an outer appearance of a flexible TV according to one embodiment of the present invention. As discussed below, FIGS. 13 to 50 mainly illustrate a flexible TV according to one embodiment of the present invention. Description of the flexible TV according to one embodiment of the present invention can be supplemented with reference to FIGS. 1 to 12. For example, the flexible TV according to one embodiment of the present invention may store the web OS in a memory or may not operate based on the web OS.

As shown in FIG. 13(*a*), a flexible TV according to one embodiment of the present invention includes a housing 1300, and a flexible display is included in the housing 1300. In addition, a door 1301 is positioned on the top surface of the housing 1300 and the flexible display included in the housing 1300 is exposed to the outside through the open/close operation of the door 1301.

For example, as shown in FIG. 13(*b*), the door 1311 is opened according to the recognized command or view type, and only a part or the entirety of the flexible display 1312 is exposed to the outside. As used herein, the term "flexible display" or "flexible TV" means that the display or TV can be bent to some extent, and thus the term "flexible" may be replaced with terms such as "foldable" or "rollable". The above-mentioned "view type" will be described in more detail later with reference to FIG. 14.

Figure 14:
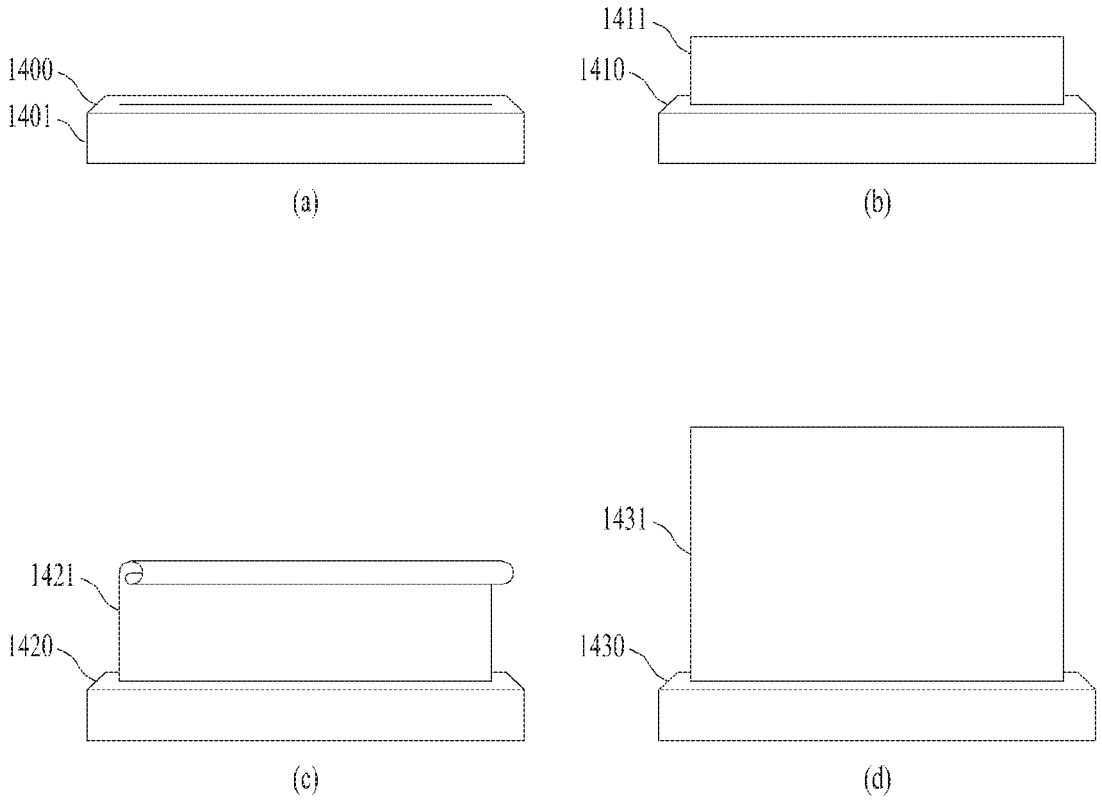
FIG. 14 shows three basic view types provided by a flexible TV according to one embodiment of the present invention.

FIG. 14 shows three basic view types provided by a flexible TV according to one embodiment of the present invention.

According to one embodiment of the present invention, as shown in FIG. 14, a flexible display is applied to a TV to provide various view types.

FIG. 14(*a*) shows a first view type, which will be referred to as a "zero view" type in this specification. FIG. 14(*b*) shows a second view type, which will be referred to as a "partial view" type in this specification. FIG. 14(*d*) shows a third view type, which will be referred to as a "full view" type in this specification.

As shown in FIG. 14(*a*), when a flexible TV 1400 according to one embodiment of the present invention implements the zero view type, the flexible display is not exposed to the outside of the housing 1401 at all. However, it should be noted that since a lighting module is mounted on the front surface of the housing 1401, providing some necessary feedback for the user is also within the scope of the present invention. Furthermore, for the zero view type shown in FIG. 14(*a*), only very limited functions such as speech recognition, music reproduction, and welcome-related audio output are provided.

As shown in FIG. 14(*b*), when the flexible TV 1410 according to the embodiment of the present invention implements the partial view type, only a part of the flexible display 1411 is exposed to the outside. In this case, due to the limited screen size, only specific optimized applications (for example, music, clock, album, mood, lighting, IoT, etc.) may be executed without a program of a typical broadcast channel displayed. Details will be described later with reference to FIGS. 30 to 34.

As shown in FIG. 14(*d*), when the flexible TV 1430 according to the embodiment of the present invention implements the full view statee, the entirety of the flexible display 1431 is exposed to the outside. In this case, a program of a typical broadcast channel is designed to be displayed.

Finally, FIG. 14(*c*) illustrates that the flexible display 1421 of the flexible TV 1420 according to one embodiment of the present invention can be rolled up or rolled down. That is, when the view type changes from the full view to the zero view, the flexible display 1421 moves into the housing (that is, the screen moves downward). On the other hand, when the view type changes from the zero view to the full view, the flexible display 1421 is drawn out of the housing (that is, the screen moves upward).

Figure 15:
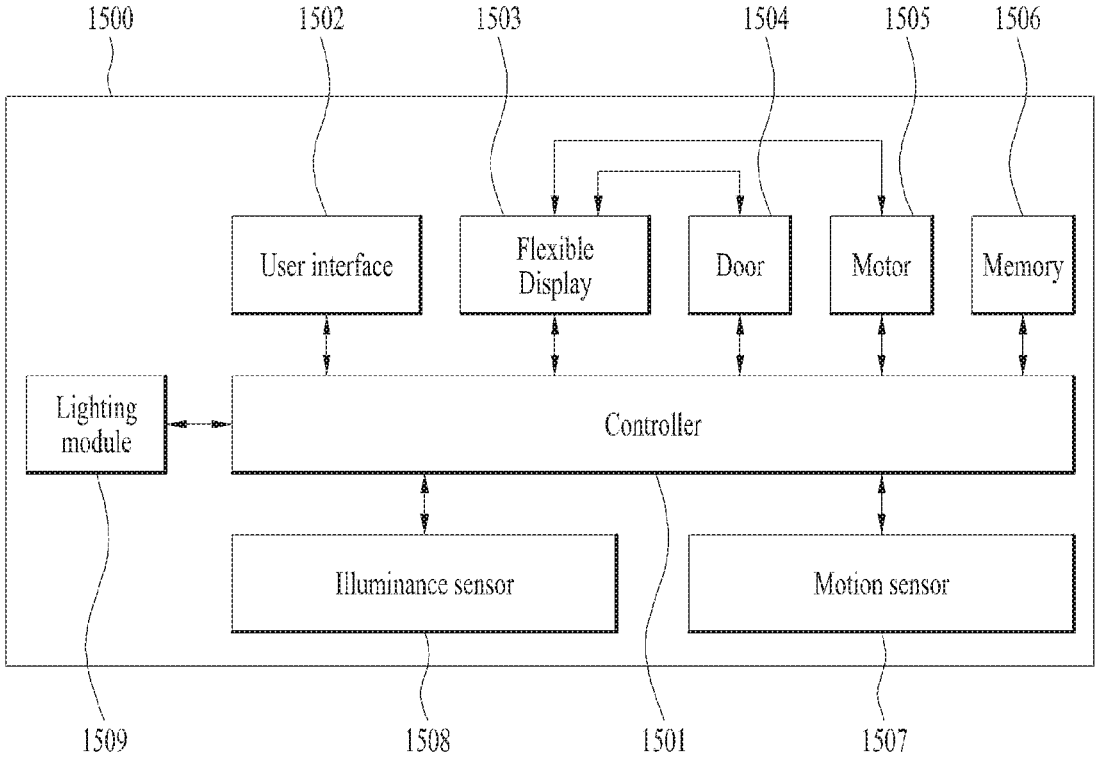
FIG. 15 shows internal constituent modules of a flexible TV according to one embodiment of the present invention.

FIG. 15 shows internal constituent modules of a flexible TV according to one embodiment of the present invention.

As shown in FIG. 15, the flexible TV according to one embodiment of the present invention includes a controller 1501, a user interface 1502, a flexible display 1503, a door 1504, a motor 1505, a memory 1506, a motion sensor 1507, an illuminance sensor 1508 and a lighting module 1509 in the housing 1500. Of course, some of the elements described above may be located outside the housing 1500, and not all of the elements described above are required. The elements can be selectively employed according to the needs of those skilled in the art. It is to be understood that FIG. 15 is for reference only and that the scope of the invention should be determined according to what is set forth in the claims.

The controller 1501 may be a central processing unit (CPU), a microcomputer, or the like and may be implemented as a system on chip (SOC). The controller serves to control the respective element shown in FIG. 15.

The user interface 1502 functions to receive a command for controlling the flexible TV according to one embodiment of the present invention. For example, the user interface corresponds to an RF communication module for bidirectional communication with the remote controller or an IR module for receiving an infrared signal. Furthermore, the user interface 1502 may be a microphone configured to receive an audio signal to recognize a user's voice.

The flexible display 1503 is controlled by at least one of the door 1504 and the motor 1505 such that the flexible display 1503 is fully or partially exposed to the outside of the housing 1500 or is not exposed at all. The flexible display 1503 may be configured with an OLED display having a polyimide substrate, but is not limited thereto.

Particularly, according to the present invention, when the door 1504 is positioned on the top surface of the housing 1500, unnecessary dust or the like may be prevented from flowing into the housing 1503 when the flexible display 1503 is not in use. However, in order for the door 1504 and the motor 1505 to operate efficiently, an operation rule must be defined in advance, which will be described in more detail later with reference to FIGS. 49 and 50.

The memory 1506 stores various programs and other applications for the operation of the controller 1501, and also stores data shown in FIGS. 18, 19, 21, 22, 28, 35, 45, 49 and 50, which will be described later.

The motion sensor 1507 is configured to detect a user located in the vicinity of the flexible TV, and an infrared sensor may be used as the motion sensor. Details will be described later with reference to FIG. 27.

The illuminance sensor 1508, which is configured to prevent power from being wasted due to unnecessary operations of the flexible TV or an unnecessary screen according to one embodiment of the present invention, functions to sense the illuminance of the surroundings.

The lighting module 1509 produces an appropriate feedback effect according to the operation state of the flexible TV according to one embodiment of the present invention, and has, for example, 32 LEDs. Of course, the present invention is not limited to the aforementioned numerical value. When the LEDs are on, three colors (e.g., yellow, red, blue) may be provided to produce various feedback effects. Details will be described later with reference to FIGS. 20 and 21.

Figure 16:
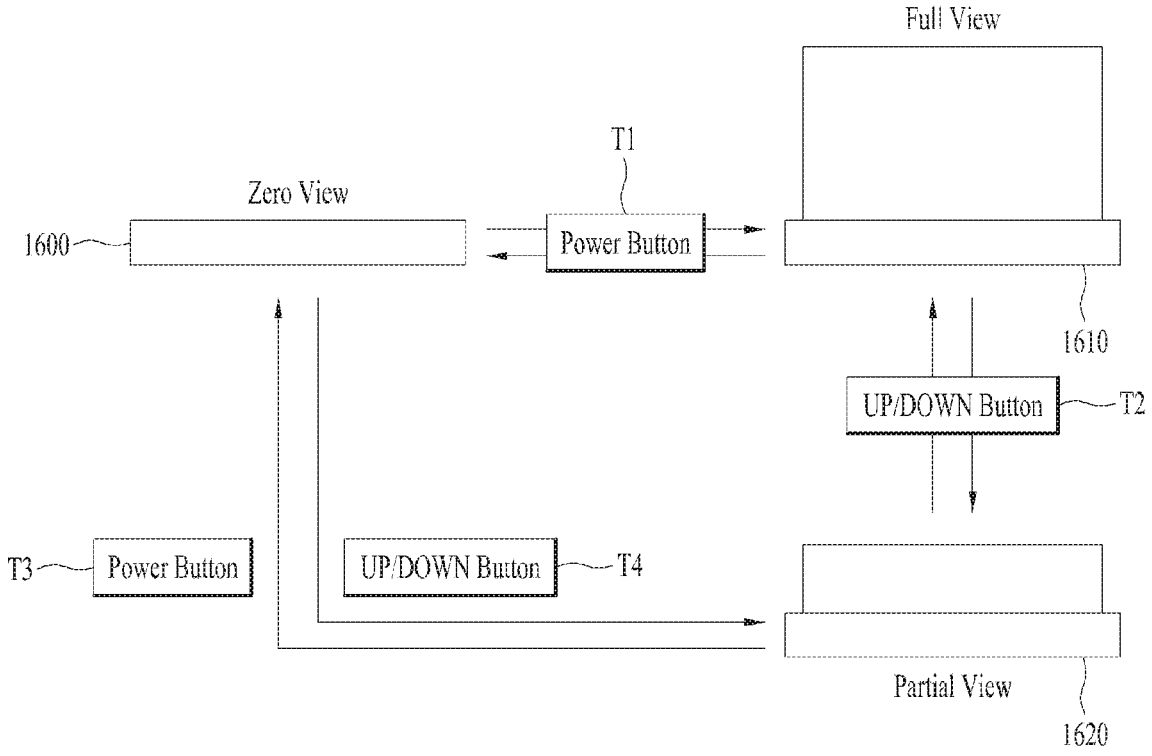
FIG. 16 illustrates an example of a trigger condition for switching to each view type according to one embodiment of the present invention.

FIG. 16 illustrates an example of a trigger condition for switching to each view type according to one embodiment of the present invention.

As described above, even when the flexible TV 1600 according to one embodiment of the present invention implements the zero view statee (that is, the flexible display is not exposed to the outside of the housing at all), speech recognition, music playback and a welcome audio output according to user recognition are enabled.

If the power button in the remote controller is pressed (T1) when the flexible TV 1600 is in the zero view state, the flexible TV 1610 is switched to the full view state. That is, the entirety of the flexible display is exposed to the outside of the housing. Of course, if the power button in the remote controller is pressed (T1) when the flexible TV 1610 is in the full view state, the flexible TV 1600 is switched to the zero view state.

Further, if the up/down button in the remote controller is pressed (T2) when the flexible TV 1610 is in the full view state, the flexible TV 1620 is switched to the partial view state. In contrast, if the up/down button in the remote controller is pressed (T2) when the flexible TV 1620 is in the partial view state, the flexible TV 1610 is switched to the full view state. The up/down button is different from the channel or volume up/down button of the existing remote controller, and refers to a specific button 1753 shown in FIG. 17, which will be described later in more detail with reference to FIG. 17.

If the power button in the remote controller is pressed (T3) when the flexible TV 1620 is in the partial view state, the flexible TV 1600 is switched to the zero view state. In contrast, if the up/down button in the remote controller is pressed (T4) when the flexible TV 1600 is in the zero view state, the flexible TV 1620 is switched to the partial view state. In this specification, reference numerals T1, T2, T3, T4 . . . denote specific trigger conditions.

Figure 17:
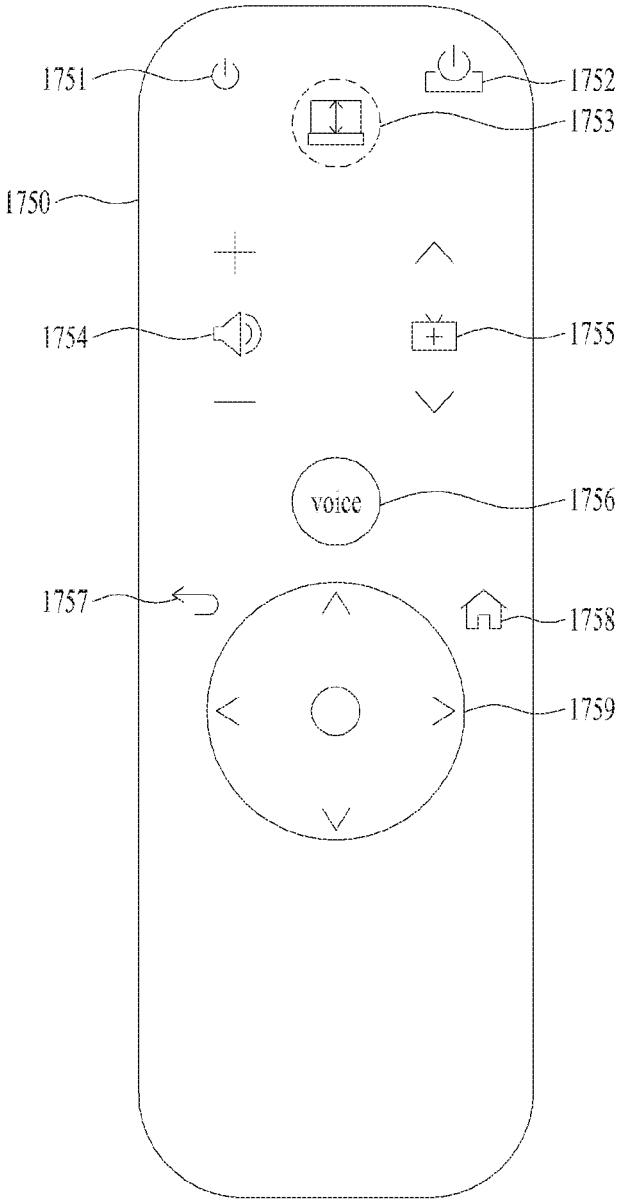
FIG. 17 shows an outer appearance of a remote controller used for controlling a flexible TV according to one embodiment of the present invention.

FIG. 17 shows an outer appearance of a remote controller used for controlling a flexible TV according to one embodiment of the present invention.

Various solutions for a remote controller for controlling a flexible TV according to one embodiment of the present invention are proposed. First, although not shown in FIG. 17, it is also possible to provide both a first remote controller having only a simple button for a specific main function and a second remote controller having many buttons including even a function having a relatively low frequency of use. Therefore, the user is allowed to selectively use the first remote controller or the second remote controller as needed.

As shown in FIG. 17, only advantages of the first remote controller and the second remote controller may be combined to provide a plurality of modes through one remote controller. For example, the remote controller shown in FIG. 17 may be configured to include a physical button. It should be understood that implementing the remote controller as a touch display to display only a specific function of the first remote controller or a specific function of the second remote controller according to user selection to allow only the function to be touched is also within the scope of the present invention.

In brief, the remote controller shown in FIG. 17 may be designed to have a physical button, or may be implemented as a touch-based controller capable of recognizing user touch.

In any case, the specific button 1753 for adjusting the view type of the present invention should be included. The specific button 1753 corresponds to the "up/down" button of FIG. 16, and changing the view type based on the trigger condition of the specific button 1753 according to the state of the flexible TV has been described in detail with reference to FIG. 16. While it is illustrated in FIG. 17 that one specific button 1753 is designed to change the view type, designing two buttons of up and down buttons for changing the view type is also within the scope of the present invention. However, designing one button may reduce the number of unnecessary resources on the remote controller.

In FIG. 17, a first power button 1751 shown is provided for turning the TV on/off, and a second power button 1750 is provided for turning the STB on/off. A volume button 1754 is provided to adjust the volume of a speaker built in or network-connected to the flexible TV and a channel button 1755 is provided to tune to a broadcast received over the tuner of the flexible TV or an IP network.

A voice button 1756 is provided to receive user voice, and operates to change the microphone attached to the remote control to the ON state. A back button 1757 is used to switch to a previous screen. A home button 1758 is used to switch to an initial screen of the flexible TV. A four-direction button 1759 is used to shift a cursor or an arrow to select a desired option, menu, content, or the like.

FIG. 18 shows a database that defines buttons of a remote controller which are enabled in each view type and buttons of the remote controller which are disabled in each view type, according to one embodiment of the present invention.

Unlike the conventional TV, which comes with a fixed screen size, a flexible TV according to one embodiment of the present invention provides various view types (screen sizes), and thus there are remote controller buttons which are unnecessary depending on each view type. Therefore, by pre-storing unnecessary buttons in the memory, unnecessary data processing may be prevented.

For example, if the flexible TV according to one embodiment of the present invention is in the zero view state, the flexible TV does not need to respond when the home button (1758 in FIG. 17) is pressed. Therefore, in the case where the remote controller shown in FIG. 17 is implemented as a touch display, the home button is intentionally excluded from the touch display when the flexible TV is in the zero view state.

On the other hand, if the flexible TV according to the embodiment of the present invention is in the partial view state, the flexible TV should switch to the first screen when the home button is pressed. Accordingly, in the case where the remote controller shown in FIG. 17 is implemented as a touch display, the home button is included in the touch display when the flexible TV is in the partial view state. This point differs from the remote controller in the zero view state.

Similarly, for example, if the flexible TV according to one embodiment of the present invention is in the zero view state, the flexible TV does not need to respond when the four-direction button (1759 in FIG. 17) is pressed. Therefore, in the case where the remote controller shown in FIG. 17 is implemented as a touch display, the four-way button is intentionally excluded from the touch display when the flexible TV is in the zero view state.

On the other hand, if the flexible TV according to the embodiment of the present invention is in the partial view state, an arrow indicator or a focus should be shifted such that a menu can be selected when the 4-direction button is pressed. Accordingly, in the case where the remote controller shown in FIG. 17 is implemented as a touch display, the four-direction button is included in the touch display when the flexible TV is in the partial view state. This point differs from the remote controller in the zero view state.

While FIG. 18 exemplarily shows a database according to the technical idea described above, the database may be slightly modified according to the needs of a person skilled in the art or the product situation, within the scope of the present invention. Although FIG. 18 illustrates a situation in which the view type has been set, it is also necessary to separately define whether or not to respond to the remote controller during change of the view type, which will be described in more detail below with reference to FIG. 19.

Figures 19, 20:
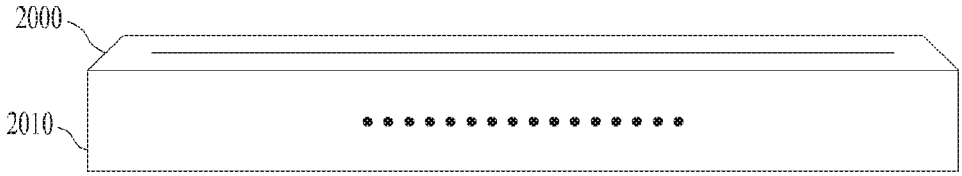
FIG. 19 shows a database that defines buttons of a remote controller which are enabled during view type change and buttons of the remote controller which are disabled during view type change, according to one embodiment of the present invention.
FIG. 20 illustrates a lighting module included in a flexible TV according to one embodiment of the present invention.

FIG. 19 shows a database that defines buttons of a remote controller which are enabled during view type change and buttons of the remote controller which are disabled during view type change, according to one embodiment of the present invention.

Changes of a view type include a change from the zero view to the partial view or a change from the partial view to the full view or the zero view. Of course, the changes also include a change from the full view to the partial or zero view, and may include all cases where the view type is changed.

Even when the view type is changed, the remote control button for turning the TV or STB on/off is needed. Therefore, the power button is kept constantly displayed on the touch display of the remote controller during view type change.

On the other hand, it may or may not be needed to adjust the volume during view type change. For example, if an audio signal is being output, the volume control button is displayed on the touch display of the remote controller during view type change. However, if the audio signal is not being output, the volume control button is not displayed on the touch display of the remote controller during view type change.

Unlike the power button (which is invariably displayed on the touch-display remote controller in any case while changing the view type) and the volume button (which is displayed on the touch-display remote controller, depending on whether there is audio output during view type change), no other function is displayed on the touch remote controller. Alternatively, another function may be displayed, but a guidance voice announcing that the corresponding function cannot be executed during view type change is output. Alternatively, as a solution to exclude a user's additional action, an IR code value received during view type change may be temporarily stored in the memory and be executed after view type change is completed, which is also within the scope of the present invention.

FIG. 20 illustrates a lighting module included in a flexible TV according to one embodiment of the present invention.

As described above, a lighting module 2010 is located on the front surface of the flexible TV 2000 according to one embodiment of the present invention. More specifically, the lighting module 2010 is provided with, for example, 32 LEDs in total. Thereby, appropriate lighting effects may be provided according to the state of the flexible TV. The lighting operation according to the state of the flexible TV will be described in detail below with reference to FIG. 21.

FIG. 21 shows a database that defines the operations and corresponding states of the lighting module shown in FIG. 20.

The "awake" state means that the flexible TV has woken up and immediately entered the standby state. The lighting located on the front surface of the housing is turned on starting with the innermost light, and the entire lighting is terminated after all lights including the outermost lights are turned on.

The "standby" state indicates that the flexible TV is already awake and waiting. The lighting located on the front surface of the housing is turned on starting with the innermost light, and the entire lighting is sequentially terminated by terminating the lights starting with the outermost lights after all lights including the outermost lights are turned on.

The "recognized" state indicates that a user is positioned around the flexible TV, through the motion sensor. However, the lighting operation for this state is the same as that for the "standby" state described above.

The "command listening" state indicates that the flexible TV is listening to the user's speech. In this state, the lighting located on the front surface of the housing is turned on starting with the outermost lights and all lights are turned off starting with the outermost lights after the entire lighting is turned on.

The "command processing" state indicates that the content of the user's speech recognized in the "command listening" state are being processed. In this state, the lighting located on the front surface of the housing displays an effect of shifting from left to right or right to left.

The "responding" state means that the flexible TV displays a feedback response to the user's speech. For example, TTS (Text to Speech) technology may be applied. In this state, the lighting located on the front surface of the housing displays an effect of shifting from the inner side to the outer side. For reference, the inner side of the lighting refers to a lighting module located near the center of a plurality of lighting modules arranged on the front surface of the housing, while the outer side of the lighting refers to a lighting module located near the left or right edge of the housing among the plurality of lighting modules arranged on the front surface of the housing.

The "changing view type" state has been sufficiently described above with reference to the previous figures, and thus a redundant description thereof will be omitted. However, as shown in FIG. 21, the operation of the lighting module changes depending on the current view type and the changed view type.

The "BT connection" state means that the flexible TV is connected to or disconnected from an external device through Bluetooth communication, and operates the lighting in a different color from that of the previous state. The previous state may be indicated by yellow. The color of indication may be replaced by another color according to the needs of those skilled in the art.

Finally, the "error and impossible" state means that a command that the user of the flexible TV speaks or inputs through the remote controller or the like cannot be executed. In this state, lighting operates in a color (RED) different from that for indication of the previous state.

FIG. 22 shows a database that defines speech recognition operations for each view type according to one embodiment of the present invention.

In FIG. 21, it has been described that the lighting feedback by which the user can easily distinguish each state is provided according to the state of the flexible TV using the lighting modules. Hereinafter, description of speech recognition for each view type will be given with reference to FIG. 22. For understanding of the speech recognition, FIG. 21 can be referenced.

Basically, when the view type is changed or the flexible TV is turned on/off, lighting feedback (which is specifically shown and described in FIG. 21) and sound/voice feedback are provided. The sound feedback simply refers to mechanical sound such as "ting-a-ling", while the voice feedback refers to audio data output based on TTS.

Suppose that there is a voice command for executing the function of "outputting a voice UI with simple text" when the flexible TV is in the full view state. If the voice command is received in the zero view state, the text is output through TTS without changing the view type. The same goes for the case where the command is received in the partial view state.

Suppose that there is a voice command for executing the function of "outputting a voice UI including content" when the flexible TV is in the full view state. If the voice command is received in the zero view state, the view type is switched to the partial view and the text is output through TTS. If the command is received in the partial view state, the view type will not be needed, and the voice UI is executed. The voice UI and the TTS used in this specification are similar in meaning unless otherwise defined, and refers to converting text into voice to be output.

Suppose that there is a voice command for executing the function of "outputting the voice UI including a widget" when the flexible TV is in the full view state. If the voice command is received in the zero view state, the widget is not executed and the text is output through TTS. The same goes for the case where the command is received in the partial view state.

Suppose that there is a voice command for executing the function of "outputting the overlay application" when the flexible TV is in the full view state. If the voice command is received in the zero view state or the partial view state, the music is reproduced without changing the view type only when the overlay application is the music player (wherein a music player for each view type is separately provided). In particular, the music player that is run in the zero view state is advantageous in that it is provided with a simple design that does not provide video.

When the flexible TV is in the full view type, it is assumed that there is a voice command for executing a function of "outputting a card type application". If the voice command is received in the zero view statee or the partial view statee, the application is executed after switching to the full view state.

Suppose that there is a voice command for executing the function of "switching to a specific channel and a specific program" when the flexible TV is in the full view state. If the voice command is received in the zero view state or the partial view state, the view statee is switched to the full view state and the corresponding channel or program is tuned to.

Suppose that there is a voice command for executing the function of "outputting the setting menu" when the flexible TV is in the full view state. If the voice command is received in the zero view state or the partial view state, no response will occur. However, if the voice command is for setting of sleep reservation, On reservation, and Off reservation, which do not require a visual UI, the flexible TV is designed to support TTS voice.

Suppose that there is a voice command for executing the function of "output volume, playback/stop/fast forward/rewind/navigation" when the flexible TV is in the full view state. If the voice command is received in the zero view state or the partial view state, the corresponding function is executed without changing the view type.

Suppose that there is a voice command for executing "TV off" when the flexible TV is in the full view state. If the voice command is received in the zero view state, the flexible TV is switched to the warm state, stopping the music that is being played back. If the voice command is received in the partial view state, the view type is switched to the zero view and the flexible TV is switched to the warm state. The warm state is described in detail later with reference to FIG. 45.

Figure 23:
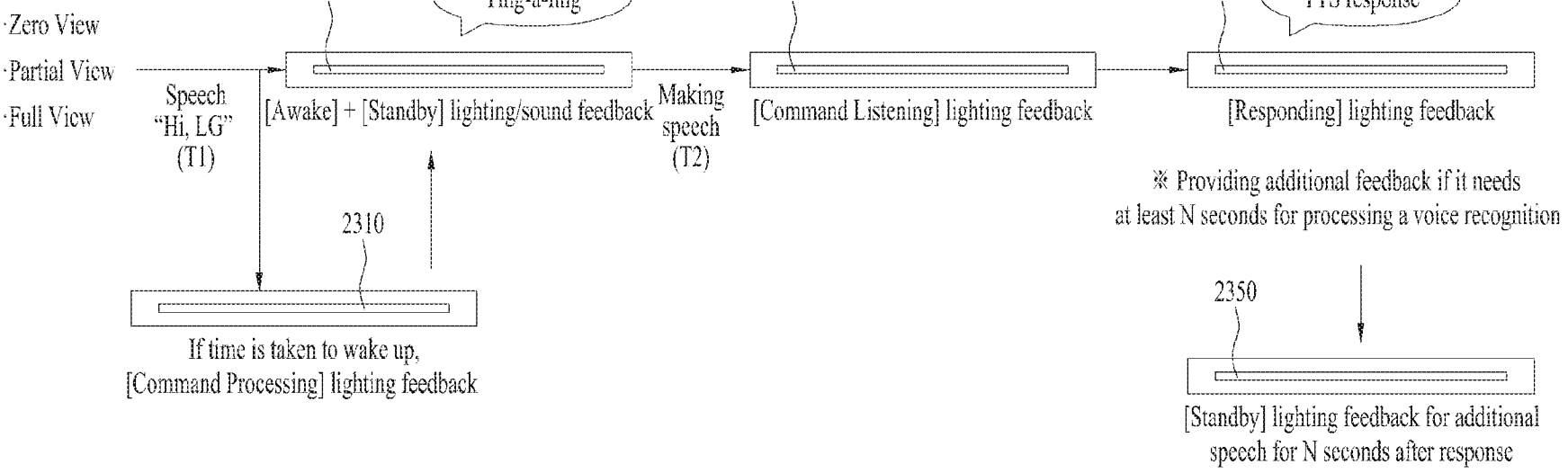
FIG. 23 illustrates a process of providing feedback for a voice command according to one embodiment of the present invention.

FIG. 23 illustrates a process of providing feedback for a voice command according to one embodiment of the present invention. The lighting feedback shown in FIG. 23 can be supplementarily explained with reference to FIG. 21.

If a voice command T1 ("Hi, LG") of a specific trigger has been recognized in any view state of the flexible TV and it takes time for the flexible TV to wake up, first lighting feedback 2310 is provided. Taking time to wake up means that the flexible TV was in a cold state. The cold state is described in detail later with reference to FIG. 45.

If a voice command T1 ("Hi, LG") of a specific trigger is recognized in any view state of the flexible TV and it does not take time for the flexible TV to wake up (that is, the flexible TV was in the warm state rather than the cold state), second lighting feedback 2320 is provided and specific mechanical sound (ting-a-ling) is output as a first response R1.

Subsequently, if a voice command T2 of another trigger (for example, a voice command for specifically controlling the flexible TV) is recognized, third lighting feedback 2330 indicating that the flexible TV is listening to the command (voice) is output.

Subsequently, when voice processing and analysis are completed, a response R2 to the user's speech is output by the TTS using a speaker and fourth lighting feedback 2340 is output. If another voice of the user is recognized within a predetermined time after the response R2, fifth lighting feedback 2350 is output. It is also within the scope of the present invention to differently design the respective lighting feedbacks described above depending on the state.

Figure 24:
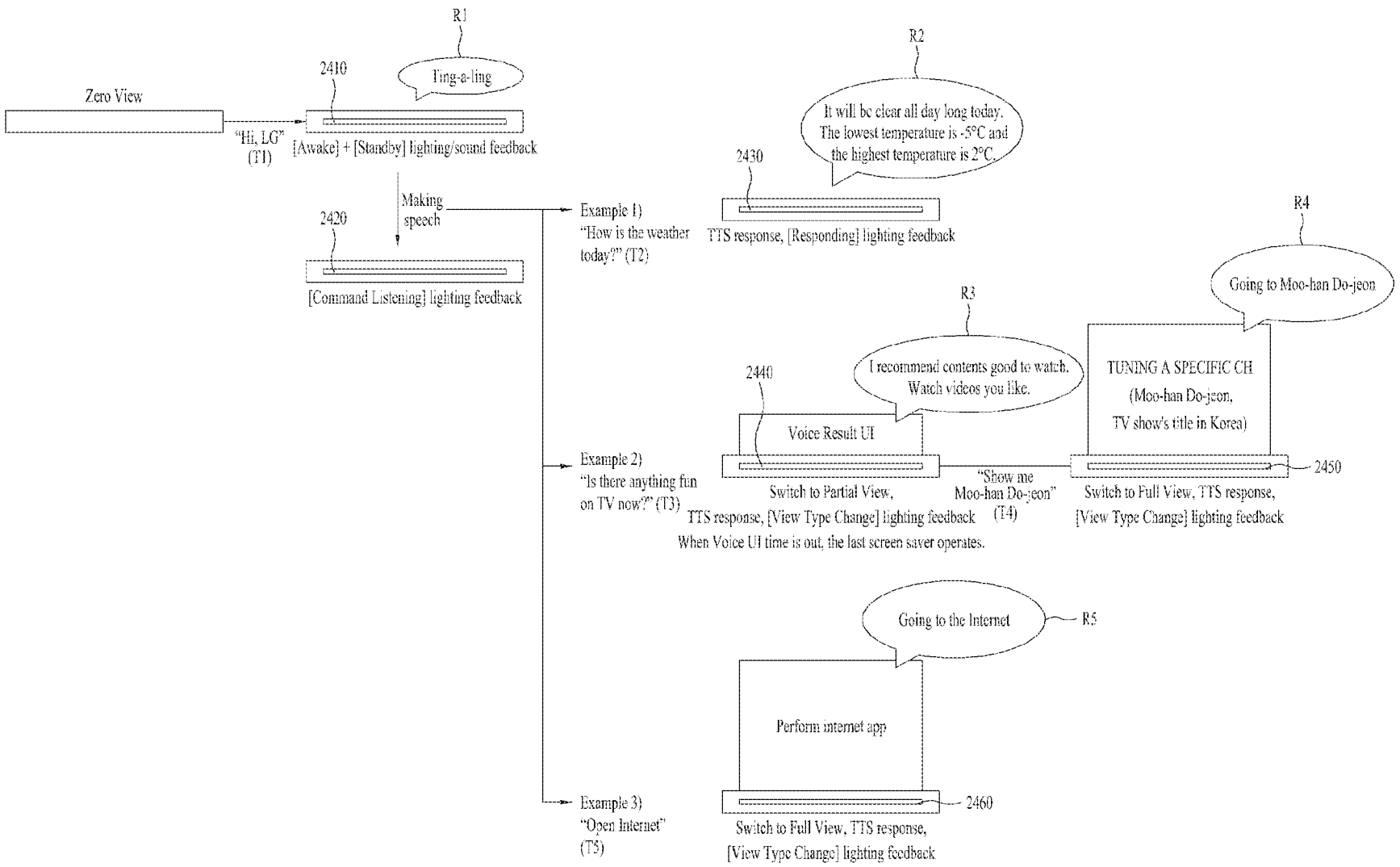
FIG. 24 illustrates a process of providing feedback for a voice command in a first view type according to one embodiment of the present invention.

FIG. 24 illustrates a process of providing feedback for a voice command in a first view type according to one embodiment of the present invention.

If a voice command T1 ("Hi, LG") of a specific trigger has been recognized in the zero view state of the flexible TV and it does not take time for the flexible TV to wake up (that is, the flexible TV was in the warm state rather than the cold state), lighting feedback 2410 is provided and specific mechanical sound (ting-a-ling) is output as a first response R1.

Subsequently, if a voice command of another trigger (for example, a voice command for specifically controlling the flexible TV) is recognized, second lighting feedback 2420 indicating that the flexible TV is listening to the command (voice) is output.

Further, the view type of the flexible TV is changed depending on the types T2, T3, T4, T5 of the voice command.

For example, if the recognized voice command corresponds to T2 (e.g., "How is the weather today?"), an answer R2 and lighting feedback 2430 therefor are provided, but the zero view state is maintained without change. This is because T2 as analyzed does not require a visual UI. Therefore, waste of power due to unnecessary change of view type may be reduced.

For example, if the recognized voice command corresponds to T3 (e.g., "Is there anything fun on TV now?"), an answer R3 and lighting feedback 2440 therefor are provided, and the view type is automatically switched to the partial view. Since T3 is analyzed as a case requiring a visual UI unlike T2. However, the view type will not be immediately switched to the full view in order to prevent unnecessary power consumption. If a voice command recognized after switching to the partial view state corresponds to T4 (e.g., "Play specific content (Moo-han Do-jeon)"), an answer R4 and lighting feedback 2450 therefor are provided, and the view type is automatically switched to the full view.

For example, if the recognized voice command corresponds to T5 (e.g., "Open Internet"), an answer R5 and lighting feedback 2460 therefor are provided, and the view type is automatically switched to the full view. Since T5 is analyzed as a case requiring a large-screen visual UI unlike T3, the intermediate step of changing to the partial view state is omitted and the user's intention is correctly reflected.

Figure 25:
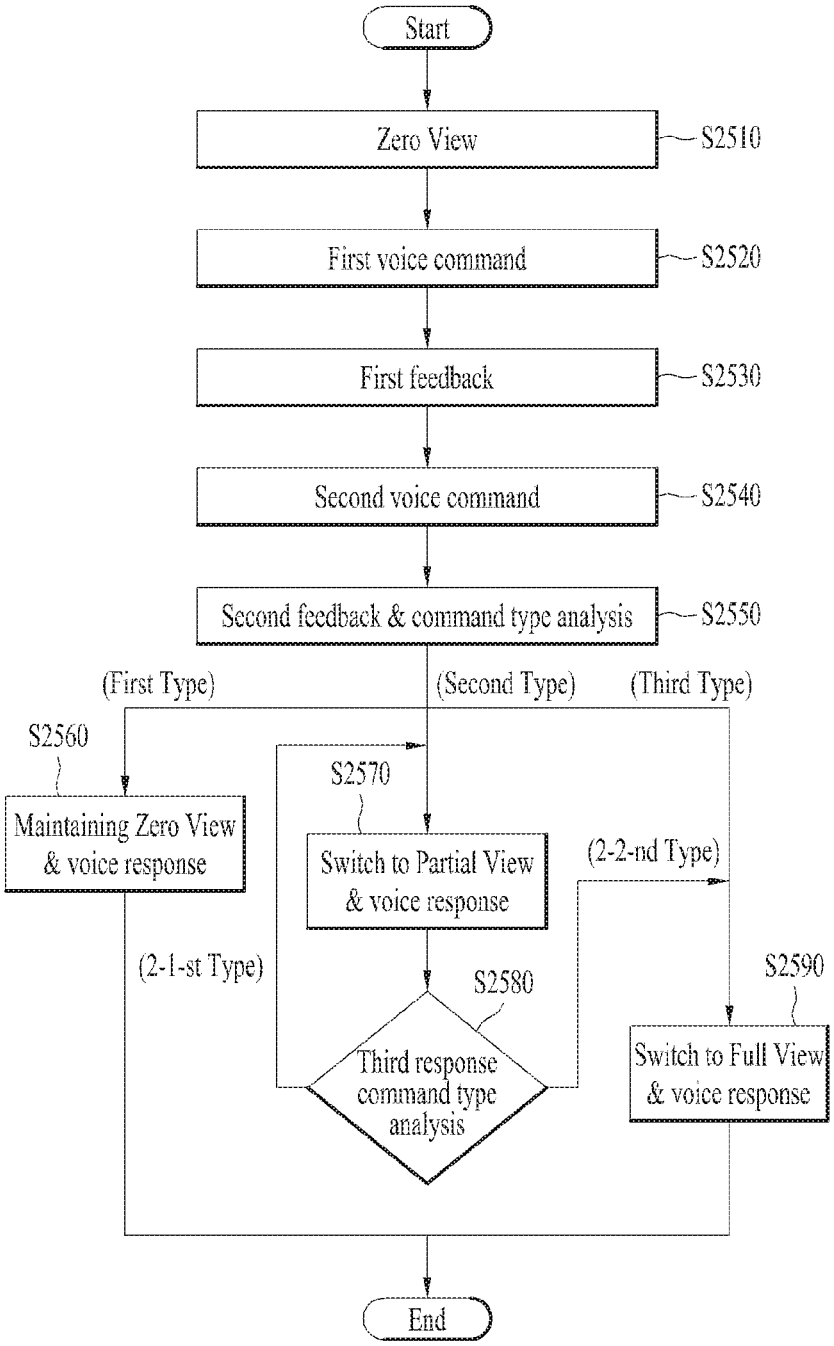
FIG. 25 is a flowchart showing FIG. 24 in more detail.

FIG. 25 is a flowchart showing FIG. 24 in more detail. For reference, FIG. 25 summarizes the technical idea of the present invention described with reference to FIG. 24.

It is assumed that a flexible TV according to one embodiment of the present invention is in the zero view state (S2510). Upon receiving a first voice command (S2520), the flexible TV outputs first feedback (S2530). The first voice command corresponds to, for example, a trigger indicating that a voice command will start, such as, for example, "Hi, LG".

Subsequently, upon receiving a second voice command (S2540), the flexible TV outputs second feedback and analyzes the type of the second voice command (S2550). The second voice command is a specific command for controlling the flexible TV.

If the analyzed second voice command corresponds to a first type, the zero view state is maintained and a voice response is output through the speaker (S2560). This is because sufficient information can be provided for the voice command corresponding to the first type without the visual UI.

If the analyzed second voice command corresponds to a second type, the flexible TV will switch to the partial view state and output a voice response through the speaker (S2570). This is because the voice command corresponding to the second type requires provision of a small-screen visual UI.

If the analyzed second voice command corresponds to a third type, the flexible TV will switch to the full view state and output a voice response through the speaker (S2590). This is because the voice command corresponding to the third type requires provision of a large-screen visual UI.

If the third voice command is received after step S2570, analysis of the type thereof is performed (S2580). If the third voice command corresponds to a 2-1st type (for which sufficient visual information can be provided in the partial view state), the process will return to step S2570. However, if the third voice command corresponds to a 2-2nd type, the process will proceed to step S2590.

Figure 26:
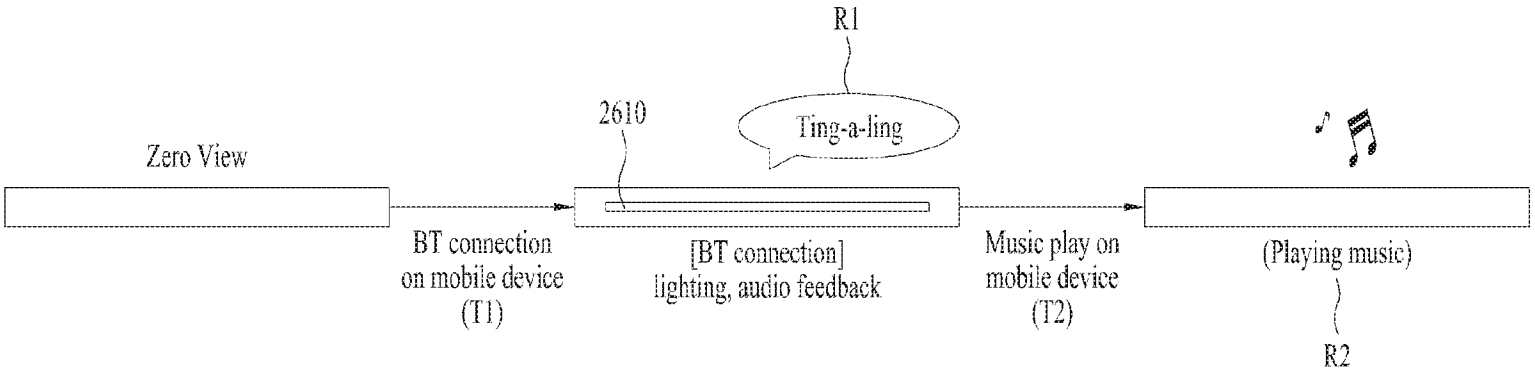
FIG. 26 illustrates a process of playing music in a first view type according to one embodiment of the present invention.

FIG. 26 illustrates a process of playing music in a first view type according to one embodiment of the present invention. As described above, the first view type defined in this specification refers to the zero view type, which means that the flexible display is not exposed to the outside of the housing of the flexible TV at all.

If the flexible TV is in the zero view state and a trigger condition T1 for connecting to an external mobile device (for example, a mobile phone, a tablet, etc.) is satisfied when the flexible TV is in the zero view state, lighting feedback 2610 and sound feedback R1 are output. Of course, it is also within the scope of the present invention that a connection is established through a wired USB or wireless communication such as ZigBee, other than Bluetooth.

If a trigger condition T2 for playing music is satisfied in a mobile device connected through Bluetooth, the music that is being played is output through the speaker built in the flexible TV or the speaker connected in a wireless/wired manner (R2).

If T1 is sensed while the flexible TV is connected to an external speaker through Bluetooth, the flexible TV will terminate the Bluetooth connection with the external speaker and automatically switch to a Bluetooth communication connection to the external mobile device.

Figure 27:
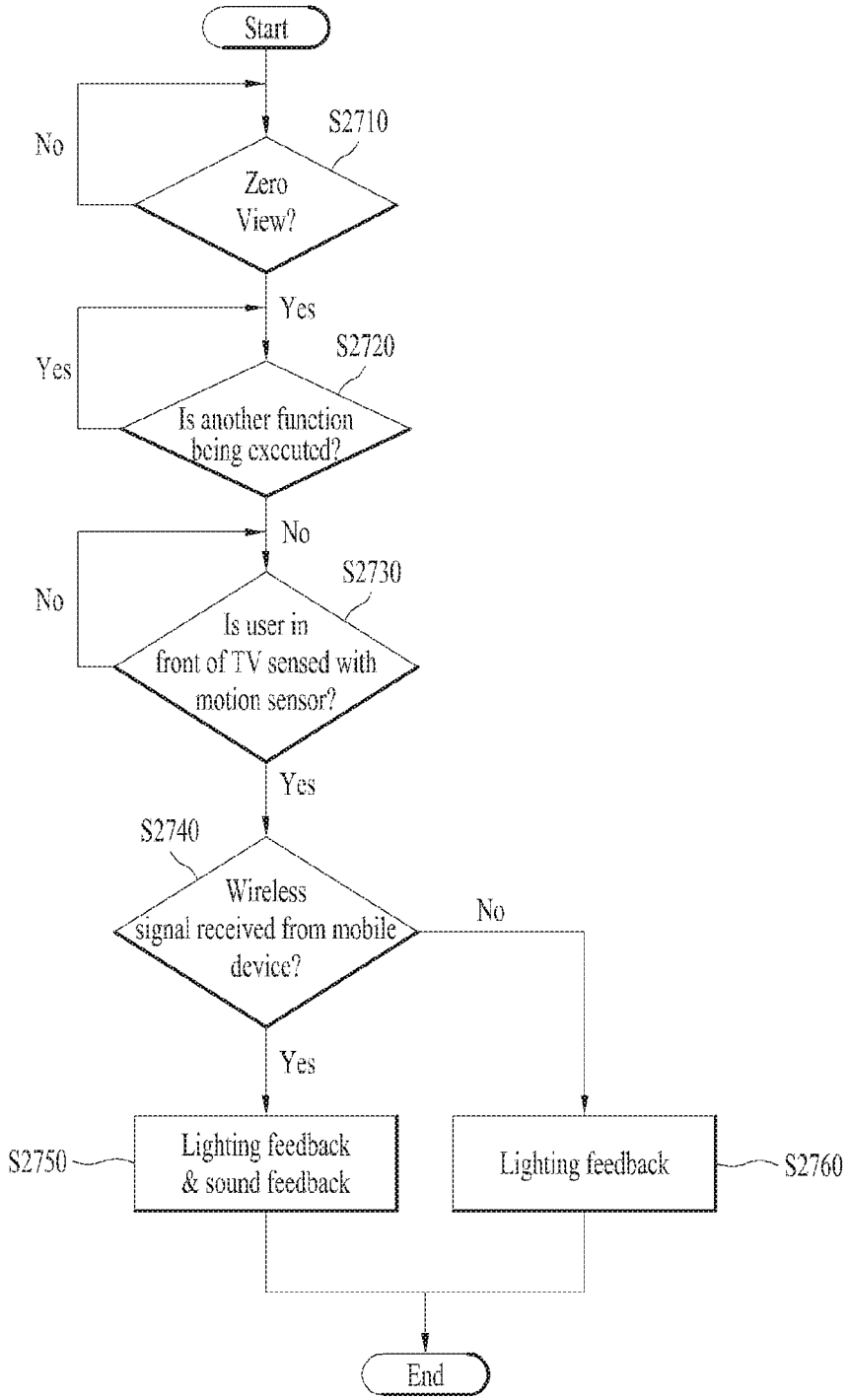
FIG. 27 is a flowchart illustrating a process of recognizing a user in a first view type according to one embodiment of the present invention.

FIG. 27 is a flowchart illustrating a process of recognizing a user in a first view type according to one embodiment of the present invention.

First, the flexible TV determines whether it is in the zero view state (S2710). If the flexible TV is not in the zero view state as a result of the determination S2710, the motion sensor will not be enabled since it is highly likely that the user is using the flexible TV. Thereby, unnecessary power consumption is reduced.

If the flexible TV is in the zero view state as a result of the determination S2710, it is determined whether the flexible TV is performing another function (S2720). Even if the flexible TV is in the zero view state, the motion sensor does not need to be operated if the user is performing any function.

If no other function is being executed as a result of the determination S2720, it is determined whether or not a user is sensed around the TV, using the motion sensor (S2730). If the user is sensed as a result of the determination S2730, it is determined that the wireless signal is received, and the mobile device determines whether or not a wireless signal is received from the mobile device (S2740).

If no wireless signal from the external mobile device is sensed as a result of the determination S2740, only lighting feedback is provided (S2760).

On the other hand, if the wireless signal from the external mobile device is sensed again a predetermined time later as a result of the determination S2740, both the lighting feedback and the sound feedback are provided together (S2750). For example, when a family member who went to work leaving the house where the flexible TV is installed returns, clearer feedback may be provided. In some cases, a welcome message including "family member name" may be output through TTS using data stored in the memory.

Further, in the case where an illuminance sensor is included in the flexible TV, brightness of lighting may be additionally adjusted according to the illuminance around the flexible TV. For example, if it is determined that it is early morning as a result of sensing of the illuminance sensor, brightness of the lighting may be automatically reduced.

FIG. 28 is a database that defines representative functions of a first view type according to one embodiment of the present invention. It is assumed that the flexible TV according to one embodiment of the present invention is in the zero view state.

If a command for controlling the volume is recognized, only lighting feedback is provided.

If a command to turn off the TV is recognized or the flexible TV is connected to an external device through Bluetooth, lighting feedback and specific sound feedback (e.g., ting-a-ling) are provided together. On the other hand, when a simple voice question about the weather/time is recognized, a corresponding TTS response is output along with lighting feedback.

If a command for executing a specific mode (which will be described later with reference to FIGS. 30 to 34) provided only in the partial view state is recognized, the lighting feedback and the specific sound feedback described above are provided, and the flexible TV is automatically switched to the partial view state.

If a search command for searching for a specific live broadcast program or VOD is recognized, lighting feedback and a TTS for the search result are provided. Further, in order to select a specific item in the search result, the flexible TV is automatically switched to the partial view state.

If a command for turning on the TV is recognized, the lighting feedback and the specific sound feedback described above are provided, and the flexible TV is automatically switched to the full view state. In this case, a screen provided by the last input means is output.

If a command for turning on the TV issued using a shortcut key (a specific CP selection button or a web browser button attached to the remote controller) is recognized, lighting feedback and a TTS indicating execution of the corresponding CP are output (for example, Execute Netflix, Execute the Internet, or the like). Then, the flexible TV is automatically switched to the full view state, and the function set to the shortcut key is executed immediately.

Figure 29:
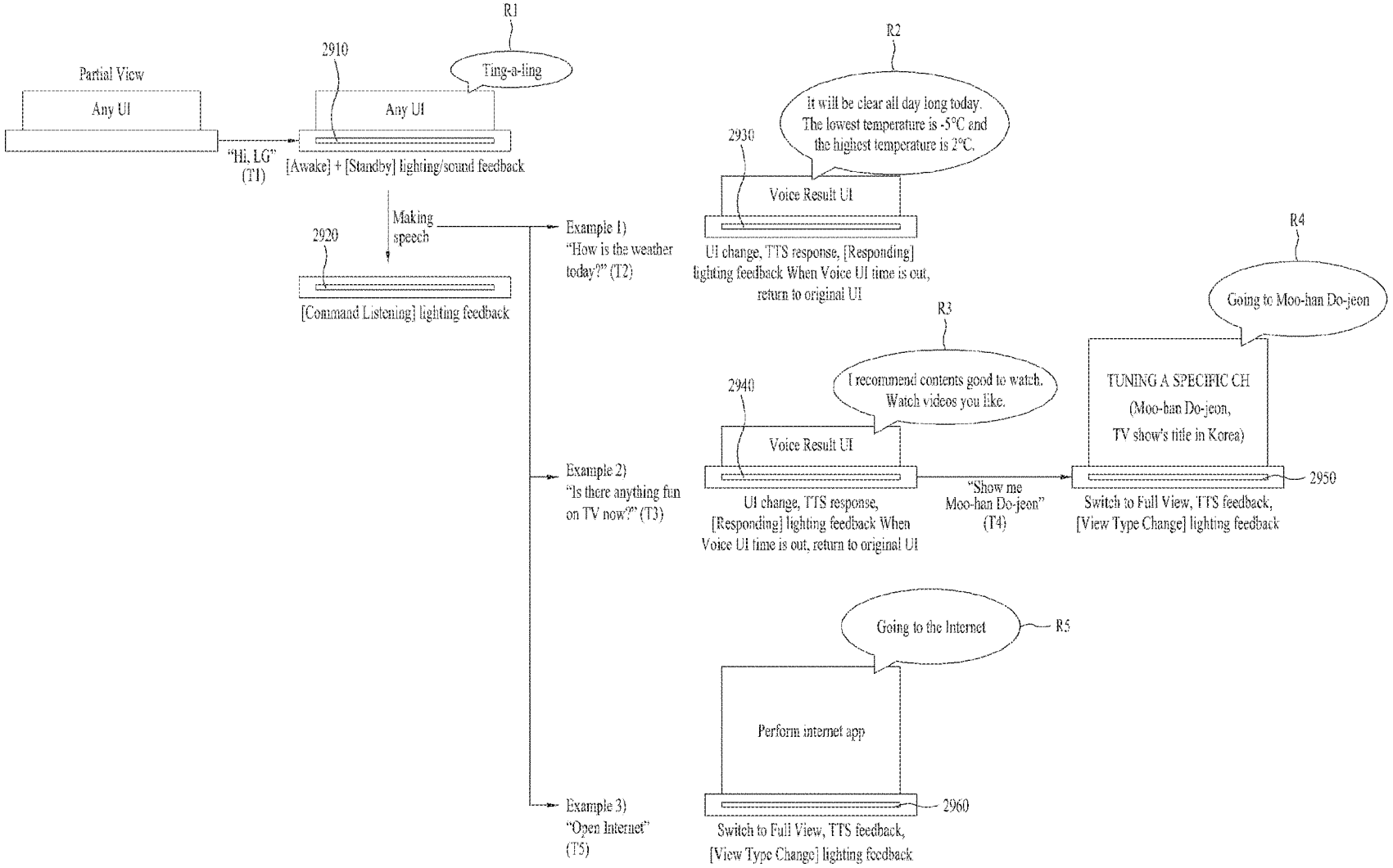
FIG. 29 illustrates a process of providing feedback for a voice command in a second view type according to one embodiment of the present invention.

FIG. 29 illustrates a process of providing feedback for a voice command in a second view type according to one embodiment of the present invention. As described above, the second view type defined in this specification refers to the partial view state, which means that only a part of the flexible display is exposed to the outside of the housing of the flexible TV. While the drawings of the present application illustrate that the degree to which the flexible display is exposed to the outside of the housing is fixed in the partial view state, the partial view state may be subdivided into a plurality of degrees, and the user may be allowed to adjust the degree of exposure to the outside of the housing as desired, which is also within the scope of the present invention.

If a voice command T1 ("Hi, LG") of a specific trigger has been recognized in any partial view state and it does not take time for the flexible TV to wake up (that is, the flexible TV was in the warm state rather than the cold state), first lighting feedback 2910 is provided and specific mechanical sound (ting-a-ling) is output as a first response R1.

Subsequently, if a voice command of another trigger (for example, a voice command for specifically controlling the flexible TV) is recognized, second lighting feedback 2920 indicating that the flexible TV is listening to the command (voice) is output.

Further, the view type of the flexible TV is changed depending on the types T2, T3, T4, T5 of the voice command.

For example, if the recognized voice command corresponds to T2 (e.g., "How is the weather today?"), an answer R2 and lighting feedback 2930 therefor are provided, but the partial view state is maintained without change. This is because the analyzed T2 does not require a large-screen visual UI. Therefore, waste of power due to unnecessary change of view type may be reduced.

For example, if the recognized voice command corresponds to T3 (e.g., "Is there anything fun on TV now?"), an answer R3 and lighting feedback 2940 therefor are provided, and the view type will not change. However, if a voice command recognized subsequently or within a predetermined time corresponds to T4 (e.g., "Play specific content (Moo-han Do-jeon)"), an answer R4 and lighting feedback 2950 therefor are provided, and the view type is automatically switched to the full view state. This is because, when specific content (vod, channel) is executed, it cannot be covered by the partial view state.

On the other hand, for example, if the recognized voice command corresponds to T5 (e.g., "Open Internet"), an answer R5 and lighting feedback 2960 therefor are provided, and the view type is automatically switched to the full view state without taking the intermediate step. Since T5 is analyzed as a case requiring a large-screen visual UI unlike T3, it is important not to go through a step of re-determining whether or not to change to the full view state according to an additional command, in order to correctly reflect the user's intention.

FIG. 30 shows specific menus provided in a second view type according to one embodiment of the present invention.

FIG. 30 shows six specialized menus provided by the flexible TV according to one embodiment of the present invention in the partial view state. Although not shown in FIG. 30, the specialized menus may also be used to display event information.

For example, using an application stored in the memory of the flexible TV or a mobile device connected thereto through Bluetooth, a message, a date and time to be displayed in the partial view state of the flexible TV are input. When the date and time arrive, the flexible TV will automatically switch to the partial view state and display the message (e.g., "Happy birthday, dad.").

In the partial view state shown in FIG. 30, the flexible TV is controlled by the four-direction button of the remote controller or a voice command. Of course, the cursor may be shifted according to the motion, touch, or wheel of the remote controller to select a menu in the partial view state through the cursor, but this operation is necessary considering that the number of selectable menus is six.

First, as shown in FIG. 30(*a*), six basic menus (Music 3010, Clock 3020, Frame 3030, Lighting 3040, Mood 3050, Home Connect 3060) are provided in the partial view state. However, the lighting mode provided in the partial view state should be distinguished from the lighting feedback provided in the previous zero view state. In the zero view state, a plurality of LEDs located on the front surface of the housing produce various effects. In the partial view state, however, effects are produced by computer graphic images output on the flexible display partially exposed to the outside of the housing, not by the LEDs of the housing. Each of the modes will be described in detail with reference to FIGS. 31 to 34, while the basic operation thereof will be described with reference to FIGS. 30(*b*) to 30(*d*).

When the music menu 3010 shown in FIG. 30A is selected, the title, the artist, and the like of the played music are displayed as shown in FIG. 30(*b*) (3011). If album jacket information is included in the corresponding music file, it may be displayed. If there is no album jacket information, a default image stored in the memory of the flexible TV is output.

When the home connect menu 3060 shown in FIG. 30(*a*) is selected, a list of a plurality of external devices that are connected to the flexible TV and can be controlled is output as shown in FIG. 30(*c*) (3061). However, when a specific external device (for example, BlurayPlayer HDMI2) is selected from the list, it is switched to the full view state.

When the clock menu 3020 shown in FIG. 30(*a*) is selected, information such as the current time, date, and day of week is displayed as shown in FIG. 30(*d*) (3021). Weather information received from the server may be additionally provided. The date and time shown in FIG. 30(*d*) are automatically set based on the country and region which are set in the initial setup step of the flexible TV, but may be modified by the user.

Figure 31:
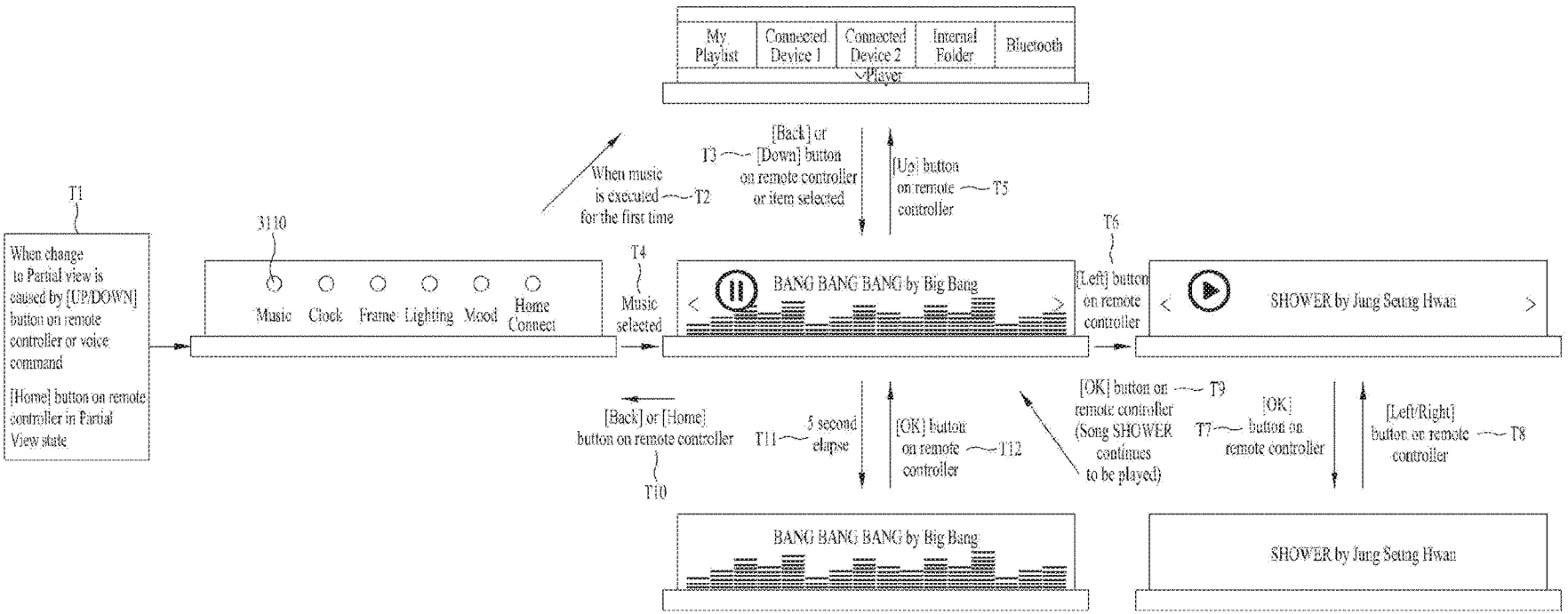
FIG. 31 shows in detail the process of executing the "Music" menu shown in FIG. 30.

FIG. 31 shows in detail the process of executing the "Music" menu shown in FIG. 30.

First, a process of invoking specialized menus of the partial view state shown in FIG. 30(*a*) will be described. As shown in FIG. 31, six specialized menus are displayed, taking T1 as a trigger condition.

T1 includes, for example, a case where the up/down button of the remote controller is pressed when the flexible TV is in the zero view state or full view state. The up/down button corresponds to the specific button 1753 shown in FIG. 17.

Further, T1 includes a voice command for executing the partial view state. Alternatively, T1 includes a case where the home button of the remote controller is pressed in the partial view state. The home button corresponds to the specific button 1758 shown in FIG. 17.

Selecting the Music menu 3110 from among the specialized menus shown in FIG. 31 may be divided into two cases. If the user of the flexible TV selects the Music menu 3110 for the first time (this condition will be referred to as a T2 trigger condition), a source list for loading music files is displayed. However, the connected device 1, the connected device 2, and the like are displayed only when the flexible TV and the connected devices 1 and 2 are connected. On the other hand, if it is not the first time that the user of the flexible TV selects the Music menu 3110 (this condition will be referred to as a T4 trigger condition), the previously reproduced content (music file) is played back in a follow-up manner.

If the up button of the remote controller is selected while a music file is being played (T5), the source list for loading the music file is displayed again. On the other hand, if the back button or the down button of the remote controller is selected while the source list is being displayed (T3), the title, the artist, and the state information (pause) of the currently played content (music file) is displayed. Then, if there is no input for a predetermined time (5 seconds) (T11), only the artist and title are displayed and all other unnecessary information will disappear. In this state, if the OK button on the remote controller is selected (T12), the artist, title, and state information (pause) are displayed again.

If the left/right direction button of the remote controller is selected (T6), another selectable song (Shower by Jung Seung Hwan) is displayed while the music file (Bang Bang Bang by Big Bang) that is currently being played continues to be output. At this time, if the back button or the down button on the remote controller is selected, information on the currently output music file is displayed. Alternatively, if the OK button on the remote controller is selected (T7), another selectable song (Shower by Jung Seung Hwan) is played back.

At this time, if the left/right direction button of the remote controller is selected (T8), left and right arrows indicating that there are other selectable songs are displayed at both side ends of the screen.

Figure 32:
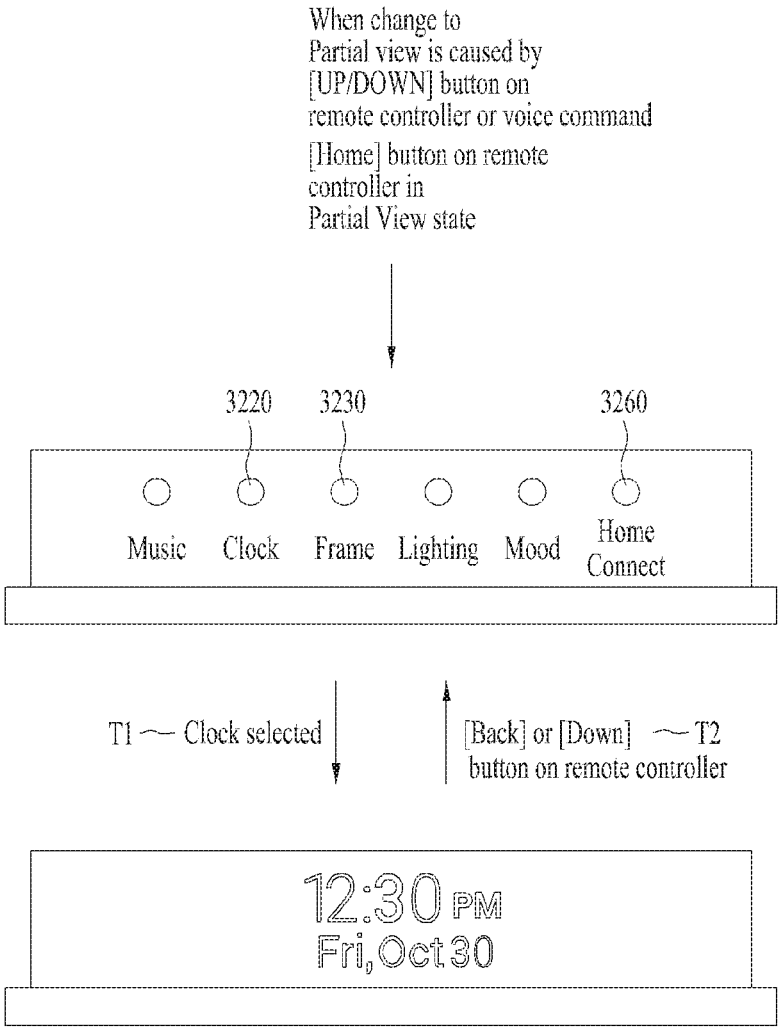
FIG. 32 shows in detail the process of executing the "Clock" menu shown in FIG. 30.

FIG. 32 shows in detail the process of executing the "Clock" menu shown in FIG. 30.

If the Clock menu 3220 shown in FIG. 32 is selected, at least one of the time, date, day of the week, or weather information of the currently set region is displayed, taking the selected menu as a T1 trigger condition. When the TV is not connected to a server or the like over a network, weather information cannot be acquired, and thus only time, date, and day of week information are displayed.

At this time, if the back button or the home button of the remote controller is selected, the screen is changed to the screen of six menus provided by the partial view state, taking the selection as a T2 trigger condition. The case where the Frame menu 3230 shown in FIG. 32 is selected will be described in detail with reference to FIG. 33 below. The case where the home connect menu 3260 shown in FIG. 32 is selected will be described in detail with reference to FIG. 34.

Figure 33:
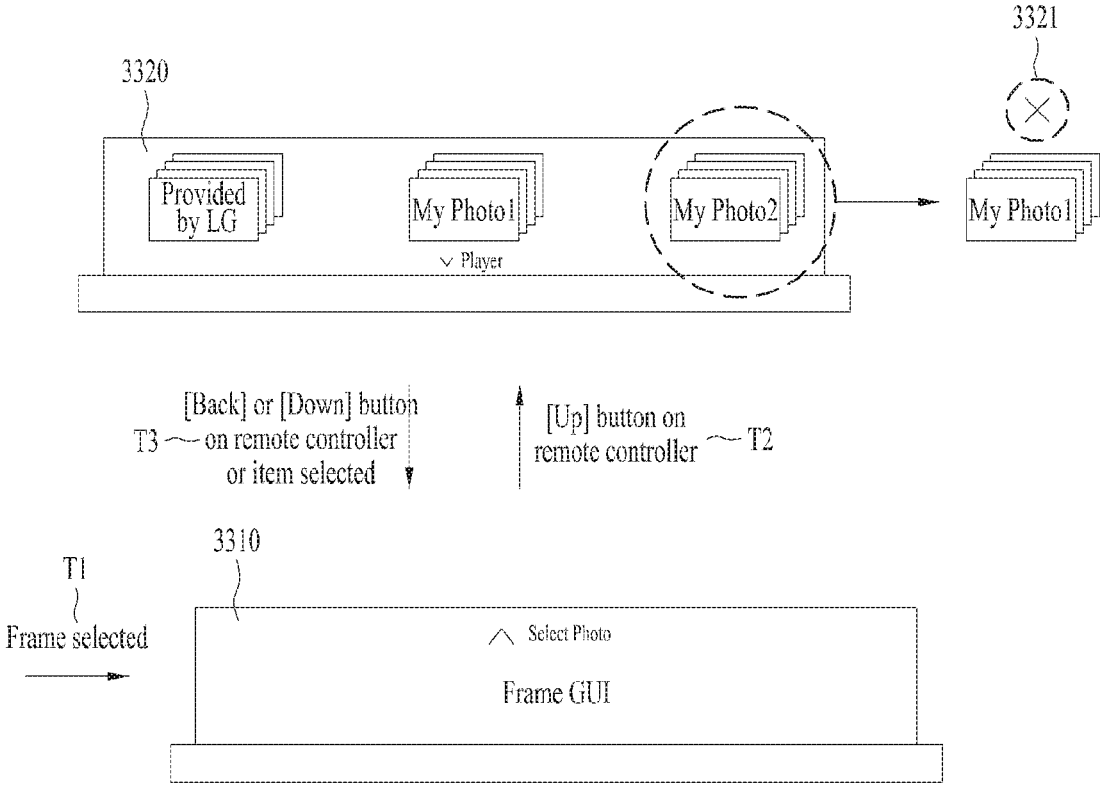
FIG. 33 shows in detail the process of executing the "Frame" menu shown in FIG. 30.

FIG. 33 shows in detail the process of executing the "Frame" menu shown in FIG. 30.

If the Frame menu 3230 shown in FIG. 32 is selected, a frame mode that was previously reproduced is reproduced, taking the selection as a T1 trigger condition. The frame mode means continuously displaying a still image or a moving image received from a server, a flexible TV, or an external device. Then, an UP direction cue is displayed and then disappears after a predetermined time (for example, 5 seconds) passes (HIDE).

If the up button of the remote controller is selected (T2) during reproduction of the frame mode (3310), a list 3320 of selectable photos or video files to be played back in the Frame mode is displayed. In particular, in the case where a plurality of photos (a group of photos) is brought into focus, an "X" button may be displayed at the top of the image of the photo group such that all the photos can be deleted at once, which is also within the scope of the present invention;

If the back button or the down button of the remote controller is selected (T3) while the list 3320 is being displayed, the frame mode is reproduced again (3310).

Figure 34:
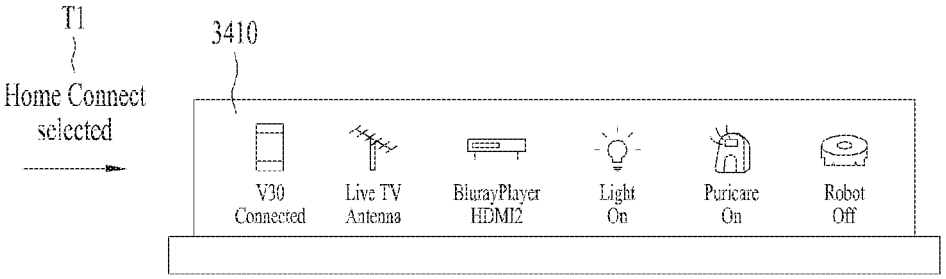
FIG. 34 shows in detail the process of executing the "Home Connect" menu shown in FIG. 30.

FIG. 34 shows in detail the process of executing the "Home Connect" menu shown in FIG. 30.

If the Home Connect menu 3260 shown in FIG. 32 is selected, a list of controllable external devices is displayed, taking the selection as a T1 trigger condition (3410). In the partial view state, only six menus or options may be basically output on one screen. Therefore, if the number of controllable external devices exceeds 6, at least one of the left and right direction cues is displayed near the left and right ends of the screen, respectively. Therefore, the user may more quickly and intuitively find an external device to be controlled by selecting the direction button on the remote controller.

The mood mode and the lighting mode, which have not been described in detail in comparison with other menus, are used to provide emotional comfort to the user or to produce a party effect.

The lighting mode uses relatively simple computer graphics, while the mood mode uses more complex and dynamic computer graphics. In addition, a plurality of options may be provided in each mode.

As mentioned briefly in the description of the previous drawings, the left and right cues or the up and down cues may be displayed together in any mode to inform the user that other functions can be selected, and may be designed to disappear after a certain time passes so that they do not obstruct the screen when they do not need to be used.

FIG. 35 shows a database that defines representative functions of a second view type according to one embodiment of the present invention. It is assumed that the flexible TV according to one embodiment of the present invention is in the partial view state.

When a command for controlling the volume is recognized, only lighting feedback is provided.

When the flexible TV is connected to an external device through Bluetooth, it provides specific sound feedback (e.g., ting-a-ling) along with lighting feedback. On the other hand, when a simple voice question about the weather/time is recognized, a corresponding TTS response is output along with lighting feedback.

If music playback is selected using an external mobile device while the flexible TV is connected to the external mobile device through Bluetooth or the like, information (e.g., artist, title, etc.) on the content (the music file) that is being reproduced is displayed.

If a search command for searching for a specific live broadcast program or VOD is recognized, lighting feedback and a TTS for the search result are provided. Further, instead of the home screen (the list of six menus) provided in the partial view state, a visual UI for selecting a specific item in the search result is displayed.

If a command for turning on the TV is recognized, the lighting feedback and the specific sound feedback described above are provided, and the flexible TV is automatically switched to the full view state. In this case, a screen provided by the last input means is output.

If a command for turning on the TV issued using a shortcut key (a specific CP selection button or a web browser button attached to the remote controller) is recognized, lighting feedback and a TTS indicating execution of the corresponding CP are output (for example, Execute Netflix, Execute the Internet, or the like). Then, the flexible TV is automatically switched to the full view state, and the function set to the shortcut key is executed immediately.

If a voice command of "Remove screen and listen to music" is recognized or the specific button 1753 shown in FIG. 17 is recognized, lighting feedback and specific sound feedback (e.g., ting-a-ling) are provided. Then, the flexible TV according to one embodiment of the present invention is automatically switched to the zero view state.

Figure 36:
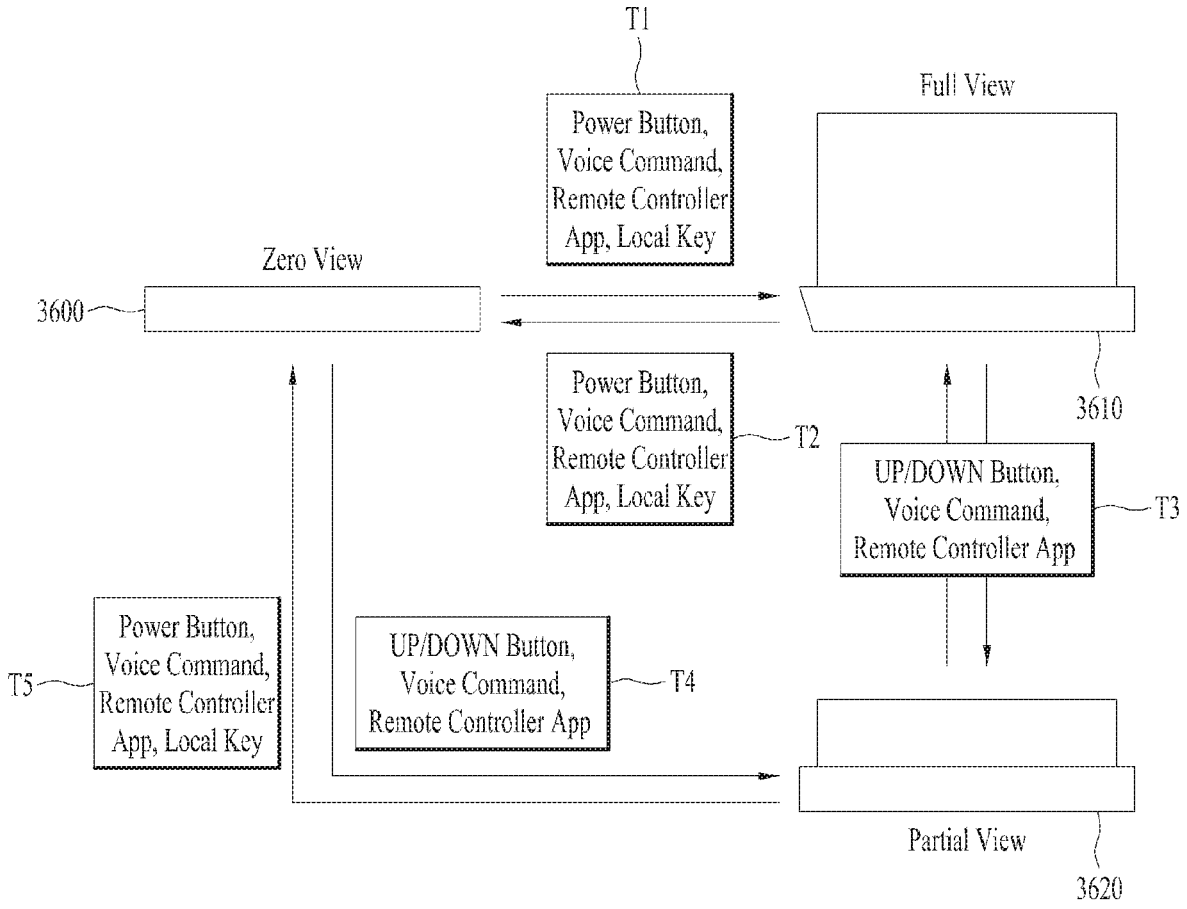
FIG. 36 is a diagram illustrating another example of trigger conditions for switching to each view type according to another embodiment of the present invention.

FIG. 36 is a diagram illustrating another example of trigger conditions for switching to each view type according to another embodiment of the present invention. While FIG. 16 illustrates the minimum trigger conditions for changing the view type, FIG. 36 illustrates more trigger conditions.

When a T1 trigger condition is recognized while the flexible TV 3600 is in the zero view state, the flexible TV 3610 is changed to the full view state. That is, the entirety of the flexible display is exposed to the outside of the housing. The T1 trigger condition includes, for example, at least one of a case where the power button on the remote controller is pressed, a case where a corresponding voice command is recognized, a case where a corresponding command is received from an external device connected through Bluetooth or the like (via, for example, a remote application stored in the memory of the external device) or a case where a local key attached to the flexible TV is pressed.

Of course, if a T2 trigger condition is recognized while the flexible TV 3610 is in the full view state, the flexible TV 3600 is switched to the zero view state. The T2 trigger condition includes, for example, at least one of a case where the power button on the remote controller is pressed, a case where a corresponding voice command is recognized, a case where a corresponding command is received from an external device connected through Bluetooth or the like (via, for example, a remote application stored in the memory of the external device) or a case where a local key attached to the flexible TV is pressed.

Further, if a T3 trigger condition is recognized while the flexible TV 3610 is in the full view state, the flexible TV 3600 is switched to the zero view state. The T3 trigger condition includes, for example, at least one of a case where the up/down button (1753 in FIG. 17) on the remote controller is pressed, a case where a corresponding voice command is recognized, a case where a corresponding command is received from an external device connected through Bluetooth or the like (via, for example, a remote application stored in the memory of the external device) or a case where a local key attached to the flexible TV is pressed. On the other hand, if a T3 trigger condition is recognized while the flexible TV 3610 is in the partial view state, the flexible TV 3610 is switched to the full view state.

If a T5 trigger condition is recognized while the flexible TV 3620 is in the partial view state, the flexible TV 3600 is switched to the zero view state. The T5 trigger condition includes, for example, at least one of a case where the power button of the remote controller is pressed, a case where a corresponding voice command is recognized, a case where a corresponding command is received from an external device connected through Bluetooth or the like (via, for example, a remote application stored in the memory of the external device) or a case where a local key attached to the flexible TV is pressed.

Finally, if a T4 trigger condition is recognized while the flexible TV 3600 is in the zero view state, the flexible TV 3620 is switched to the partial view state. The T4 trigger condition includes, for example, at least one of a case where the up/down button (1753 in FIG. 17) on the remote controller is pressed, a case where a corresponding voice command is recognized, a case where a corresponding command is received from an external device connected through Bluetooth or the like (via, for example, a remote application stored in the memory of the external device) or a case where a local key attached to the flexible TV is pressed.

Figure 37:
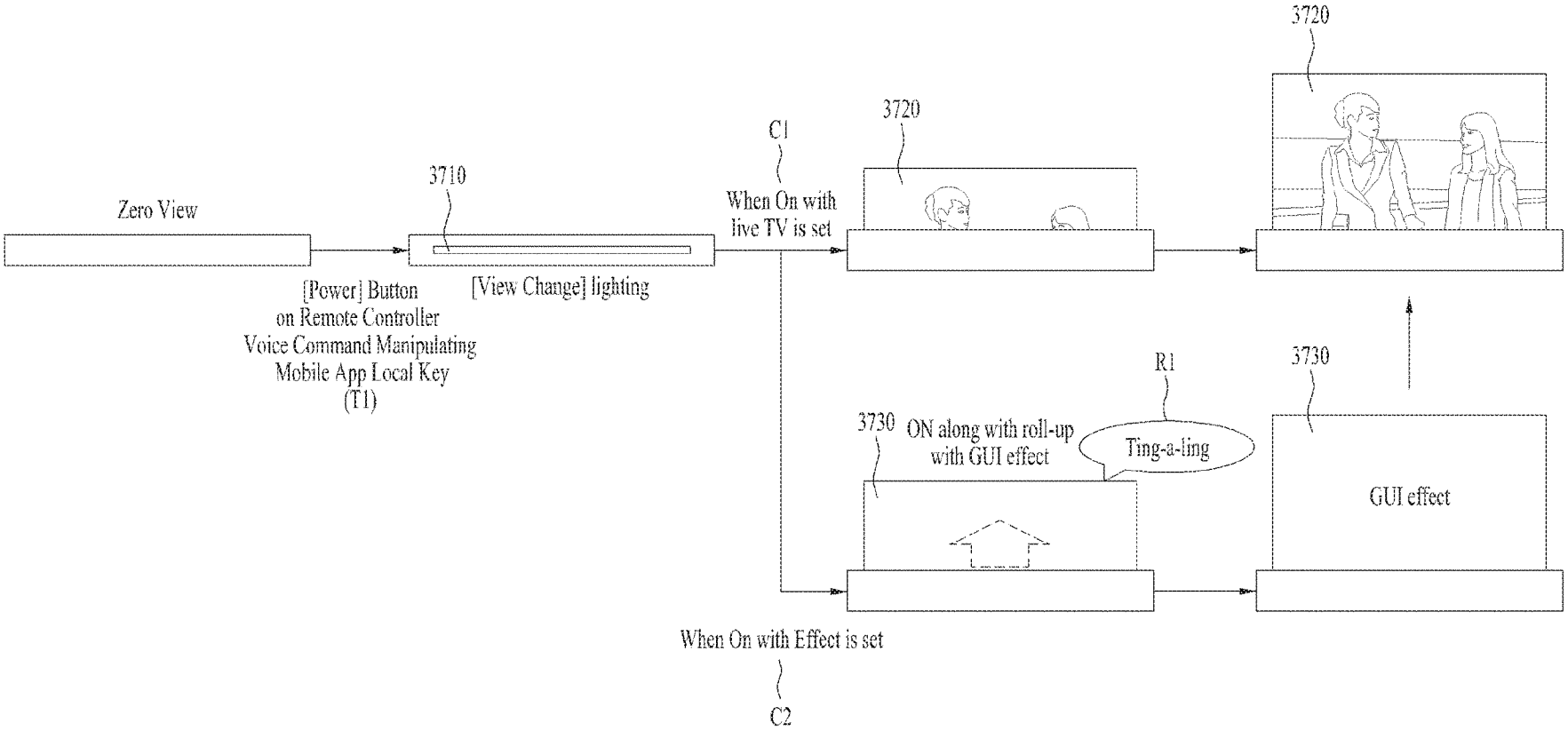
FIG. 37 illustrates a process of switching from a first view type to a third view type according to one embodiment of the present invention.

FIG. 37 illustrates a process of switching from a first view type to a third view type according to one embodiment of the present invention. The third view type refers to, for example, the full view state defined in this specification, which means that the flexible display is entirely exposed to the outside of the housing.

If a trigger condition T1 such as selection of the power button on the remote controller is recognized while the flexible TV according to the embodiment of the present invention is in the zero view state, lighting feedback indicating that the view type is being switched is displayed (3710). Then, while the lighting feedback is displayed, the flexible display is gradually exposed to the outside of the housing. In this regard, the present invention proposes two solutions.

Figure 38:
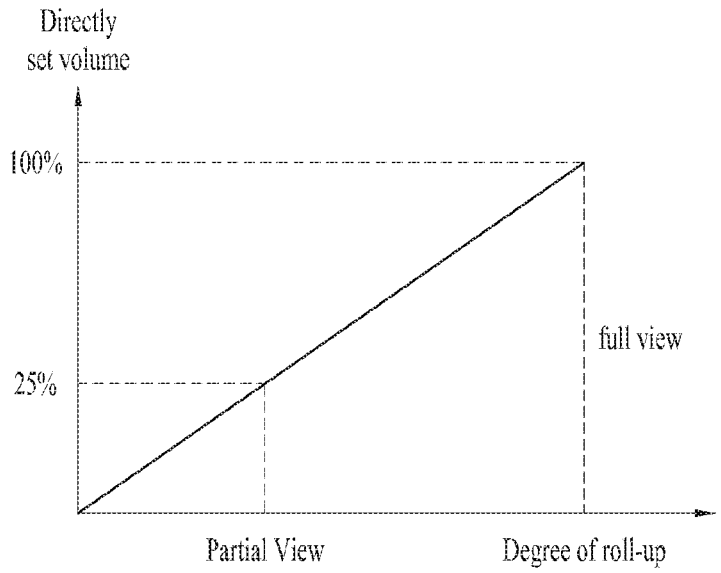
FIG. 38 is a diagram defining a relationship between a volume and a screen size required in the process shown in FIG. 37.

First, if "ON with live TV" has been automatically set or set by the user, a broadcast screen 3720 of the previously tuned channel may be gradually rolled up and the audio volume of the channel may be gradually increased. FIG. 38 is a diagram defining a relationship between volume and screen size required in the process shown in FIG. 37. That is, when the flexible display rises up to the partial view, 25% of the volume is output (assuming that the vertical length of the partial view is 25% of the vertical length of the full view). When the flexible display rises up to the full view, the audio of the broadcast is output at 100% volume. Here, 100% volume refers to the volume intensity at the time when the flexible TV was previously turned off. With this design, the user may intuitively recognize that the flexible display is being gradually raised and has not been exposed to the extent of the full screen size yet. Of course, the audio sound may be designed to be output at the 100% volume from the beginning irrespective of the degree of roll-up of the flexible display, which is within the scope of the present invention.

Second, if "ON with effect" has been automatically set or set by the user, a preset image 3730 (stored in the memory of the flexible TV) may be slowly rolled up together with specific mechanical sound (ting-a-ling) R1, the audio of the corresponding channel may be designed to be output at 100% volume immediately. Then, the screen is switched to the broadcast screen only after the flexible display is entirely exposed to the outside of the housing. With this design, the user may immediately identify the broadcast by the audio of the broadcast channel without waiting.

Figure 39:
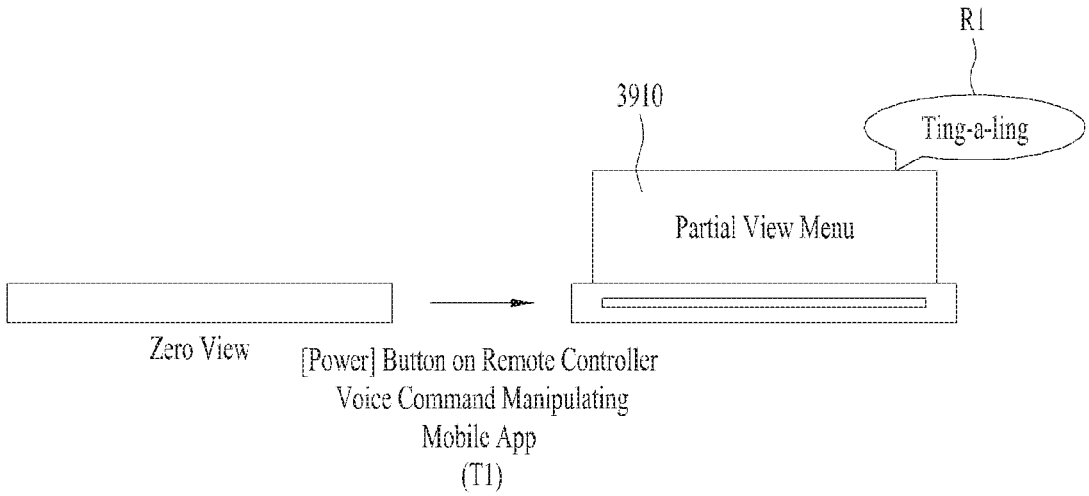
FIG. 39 illustrates a process of switching from a first view type to a second view type according to one embodiment of the present invention.

FIG. 39 illustrates a process of switching from a first view type to a second view type according to one embodiment of the present invention.

If a trigger condition T1 such as selection of the up/down button (1753 in FIG. 17) on the remote controller is recognized while the flexible TV according to the embodiment of the present invention is in the zero view state, lighting feedback indicating that the view type is being switched is displayed (3910), and specific mechanical sound (R1) is output through a speaker. Here, different UI screens are provided depending on the type of T1.

For example, if the UP/DOWN button on the remote controller is recognized as the trigger condition T1, a list of six menus specific to the partial view state is output. On the other hand, if the trigger condition T1 is recognized through a voice command or a specific application of an external mobile device (for example, a remote application for controlling the TV), a menu item selected by the user is immediately executed without displaying the list of six menus. With such a design, issues such as waste of electric power and time unnecessarily consumed due to data processing for displaying the list may all be addressed.

Figure 40:
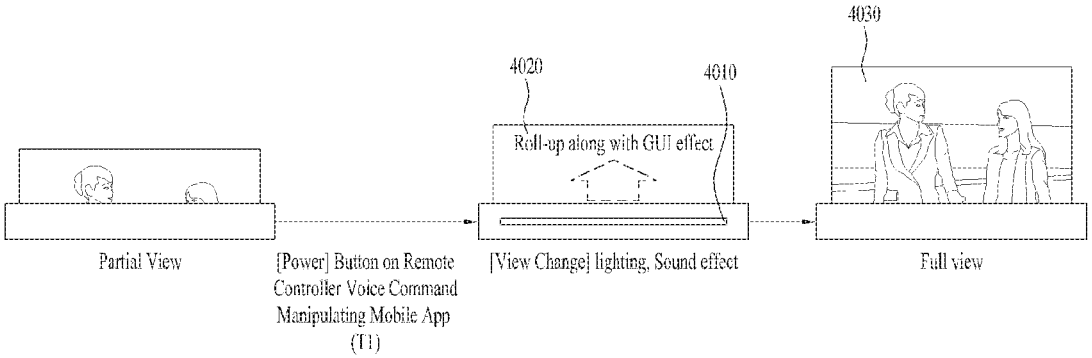
FIG. 40 illustrates a process of switching from a second view type to a third view type according to one embodiment of the present invention.

FIG. 40 illustrates a process of switching from a second view type to a third view type according to one embodiment of the present invention.

If a trigger condition T1 such as selection of the up/down button on the remote controller is recognized while the flexible TV according to the embodiment of the present invention is in the partial view state, lighting feedback indicating that the view type is being switched is displayed (4010). Then, while the lighting feedback is displayed, the flexible display is gradually exposed to the outside of the housing (4020). At this time, a specific image stored in the memory of the flexible TV may be displayed, or a part of the broadcast screen of the currently tuned channel may be set automatically or according to selection by the user, as described above.

Once the flexible display is entirely exposed to the outside of the housing, the entire broadcast screen 4030 of the currently tuned channel is displayed.

Figure 41:
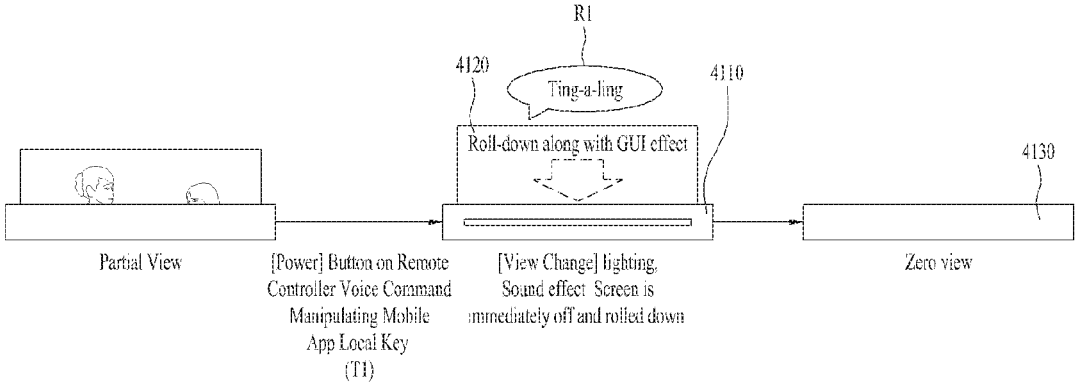
FIG. 41 shows a process of switching from a second view type to a first view type according to one embodiment of the present invention.

FIG. 41 shows a process of switching from a second view type to a first view type according to one embodiment of the present invention.

If a trigger condition T1 such as selection of the power button on the remote controller is recognized while the flexible TV according to the embodiment of the present invention is in the partial view state, lighting feedback indicating that the view type is being switched is displayed (4110). Then, while the lighting feedback is displayed, the flexible display gradually enters the housing (4120). At this time, a specific image stored in the memory of the flexible TV may be displayed, or a part of the broadcast screen of the currently tuned channel may be set automatically or according to selection by the user, as described above. Of course, as shown in FIG. 41, it is also a feature of the present invention to increase the feedback effect for the user by outputting the mechanical sound R1 temporarily or continuously during the view type switching process.

Once the entirety of the flexible display enters the housing, the view type switching process is completed, and thus the flexible TV 4130 according to the embodiment of the present invention enters the zero view state.

Figure 42:
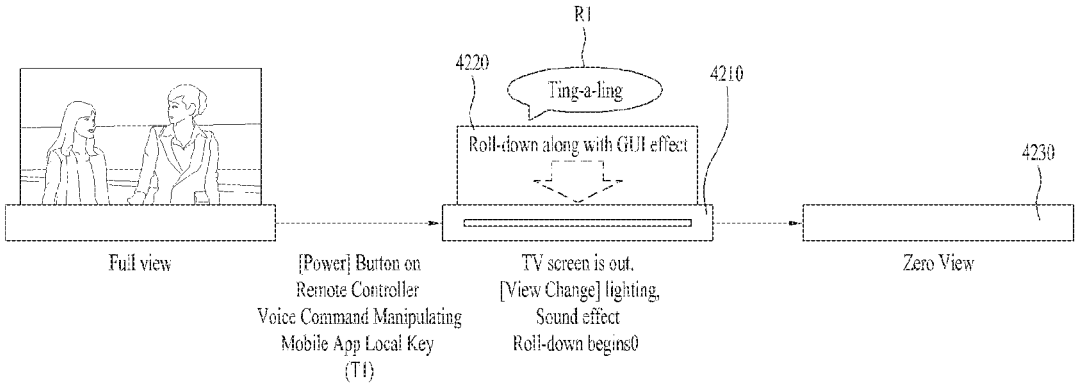
FIG. 42 illustrates a process of switching from a third view type to a first view type according to one embodiment of the present invention.

FIG. 42 illustrates a process of switching from a third view type to a first view type according to one embodiment of the present invention.

If a trigger condition T1 such as selection of the power button on the remote controller is recognized while the flexible TV according to the embodiment of the present invention is in the full view state, lighting feedback 4210 indicating that the view type is being switched and specific mechanical sound feedback (R1) are provided together.

Then, the flexible display gradually enters the housing (4220). At this time, a specific image stored in the memory of the flexible TV may be displayed, or a part of the broadcast screen of the currently tuned channel may be set automatically or according to selection by the user, as described above.

Further, once the entirety of the flexible display enters the housing, the view type switching process is completed, and thus the flexible TV 4230 according to the embodiment of the present invention enters the zero view state.

Figure 43:
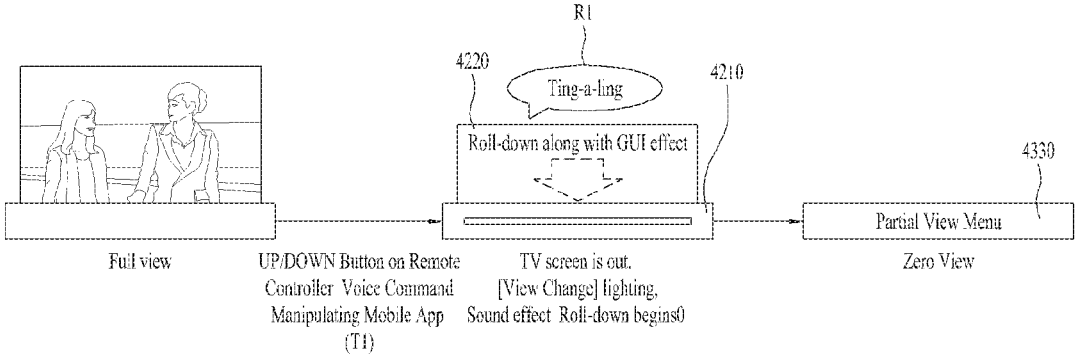
FIG. 43 illustrates a process of switching from a third view type to a second view type according to one embodiment of the present invention.

FIG. 43 illustrates a process of switching from a third view type to a second view type according to one embodiment of the present invention.

If a trigger condition T1 such as selection of the up/down button (1753 in FIG. 17) on the remote controller is recognized while the flexible TV according to the embodiment of the present invention is in the full view state, lighting feedback indicating that the view type is being switched and specific mechanical sound feedback R1 are provided together.

Then, the flexible display gradually enters the housing (4320). At this time, a specific image stored in the memory of the flexible TV may be displayed, or a part of the broadcast screen of the currently tuned channel may be set automatically or according to selection by the user, as described above.

Further, when a predetermined part of the flexible display enters the housing, the view type switching process is completed, and thus the flexible TV 4330 according to the embodiment of the present invention enters the partial view state.

Power Management in Flexible Television

Figure 44:
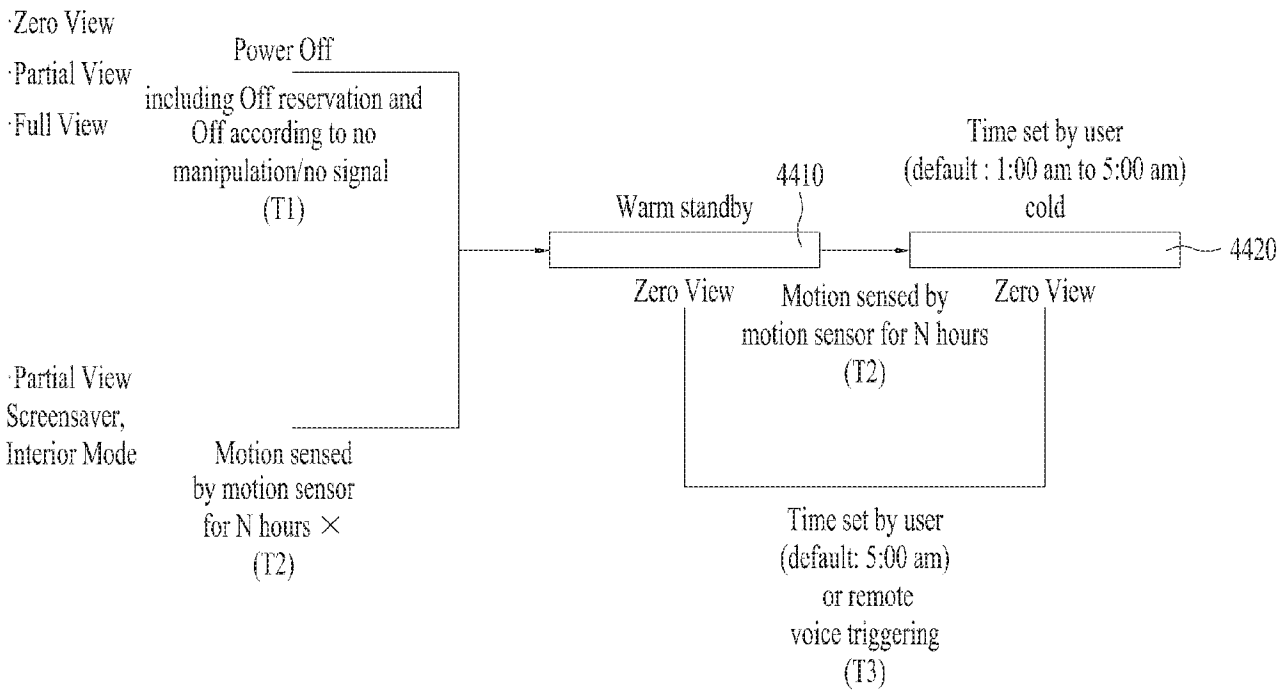
FIG. 44 illustrates a process of managing a power state of a flexible TV according to one embodiment of the present invention.
Figures 45, 46:
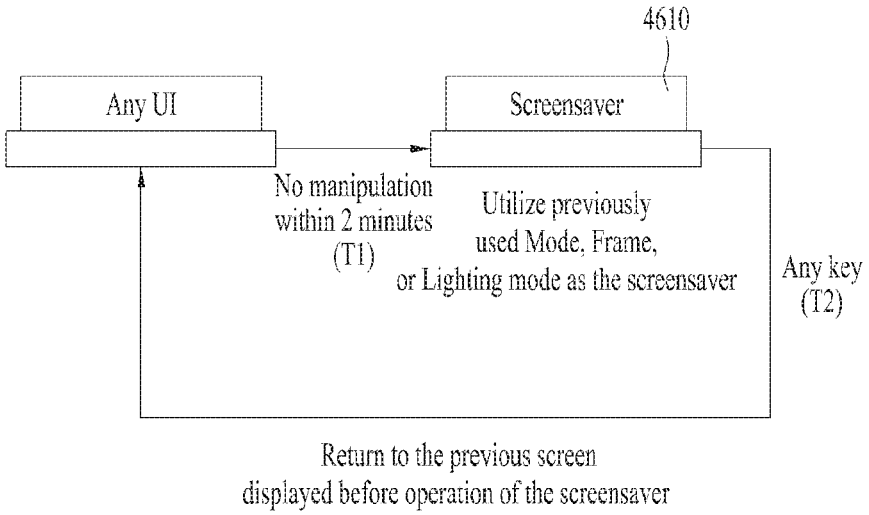
FIG. 45 shows a database that defines the power state shown in FIG. 44.
FIG. 46 illustrates a process in which a flexible TV operates a screen saver, according to one embodiment of the present invention.

As described above, the flexible TV according to the embodiment of the present invention can change the view type from time to time, and power consumption for controlling the door and the motor may be increased in order to implement view type change. Therefore, a method of lowering power consumption compared to a conventional TV is required. Various solutions for reducing power consumption have been presented in the embodiments of the previous drawings. In FIGS. 44 to 46, a power management method is illustrated from another point of view.

FIG. 44 illustrates a process of managing a power state of a flexible TV according to one embodiment of the present invention.

When the flexible TV according to one embodiment of the present invention receives a power off signal T1 in the zero view state, the partial view state, or the full view state, the flexible TV is externally switched to the zero view state 4410, while being internally switched to a warm standby state. As used herein, the terms "warm standby state", "warm state", and "standby state" all mean the same state, and this state will be described later in more detail with reference to FIG. 45.

If the flexible TV according to one embodiment of the present invention is in the partial view state and is operating the screen saver or the interior mode, the flexible TV is externally switched to the zero view state 4410 and is internally switched to the warm standby state automatically even if no movement is sensed by the motion sensor for predetermined N hours. The operation of the screen saver will be described in detail later with reference to FIG. 46. The interior mode does not mean that the six menus specific to the partial view state are provided, but means a case where computer graphics which can be harmonized with the interior of the house is displayed continuously or for certain time.

If the current time is in a preset time range (for example, from 1:00 am to 5:00 am) in the warm standby state, the flexible TV 4420 automatically enters the cold state, taking the aforementioned event as a T2 trigger condition. The preset time range may be set by the user or automatically set. The cold state used in this specification will be described later in more detail with reference to FIG. 45.

Finally, if the current time is out of the preset time range (1:00 am to 5:00 am) or the user's voice command ("Hi, LG") is recognized, the flexible TV 4420 in the cold state returns to the warm standby state 4410, taking the aforementioned event as a T3 trigger condition.

By designing the flexible TV as described above, unnecessary power consumption may be reduced as much as possible. The warm standby mode and the cold mode shown in FIG. 44 will be described in detail below with reference to FIG. 45.

FIG. 45 shows a database that defines the power state shown in FIG. 44.

If the flexible TV according to one embodiment of the present invention is not in the wakeup state in which the flexible TV performs a general function, it selectively enters the warm standby state or the cold state. In the wakeup state, power is supplied to most components of the flexible TV, but not in the warm standby state or the cold state.

However, the user's speech should be recognized even in the warm standby state or the cold state. Therefore, in both the warm standby state and the cold state, power is designed to be supplied to the microphone, which is the first input module of speech recognition.

However, in the warm standby state, the possibility that the user will control the flexible TV is relatively high, and therefore power may be designed to be supplied to both the microphone, the speech recognition module (engine) and the network module, which are used for speech recognition processing. Thereby, speech recognition processing may be performed more quickly.

On the other hand, in the cold state, the possibility that the user will control the flexible TV is not relatively high, and power is supplied only to the microphone for voice input. The voice recognition module (engine) and the network module are supplied with power only when voice input is received through the microphone. The design as described above may produce a slight delay but is more advantageous in terms of reducing power consumption.

FIG. 46 illustrates a process in which a flexible TV operates a screen saver, according to one embodiment of the present invention. The flexible TV according to one embodiment of the present invention is often used with only a part of the flexible display exposed as described above, and may undergo deterioration in image quality, which must be addressed.

For example, the flexible TV according to one embodiment of the present invention displays any visual user interface (UI) in the partial view state. Then, if no command is received for a preset time (for example, 2 minutes), the flexible TV operates the screen saver 4610, taking the aforementioned event as a T1 trigger condition.

The screen saver 4610 may select, for example, at least one of the mood menu, the frame menu and the lighting menu among the six menus provided in the partial view state automatically or through the user.

Finally, if any key button on the remote controller is selected or speech is recognized, the screen is returned to the screen before the screen saver operates, taking the aforementioned event as a T2 trigger condition. That is, the screen before the screen saver operates may mean, for example, the screen before the event of the T1 trigger condition shown in FIG. 46 occurs.

Figure 47:
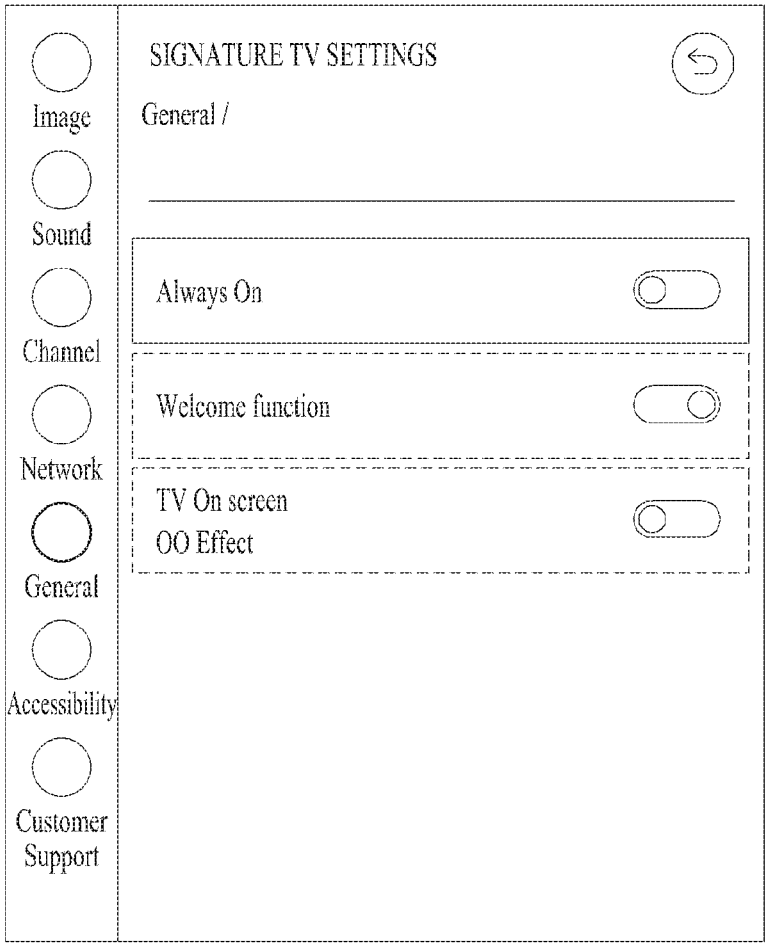
FIG. 47 illustrates a plurality of modes according to one embodiment of the present invention.
Figures 48, 49:
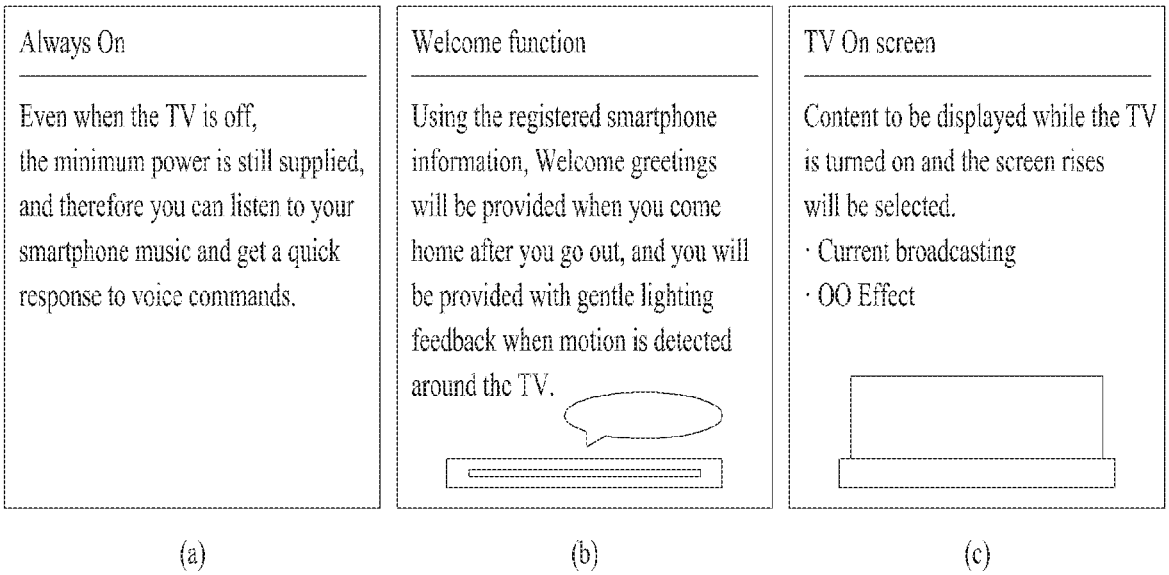
FIG. 48 specifically explains each of the modes shown in FIG. 47.
FIG. 49 shows data for controlling a door or a motor according to a type of a command recognized by a flexible TV according to one embodiment of the present invention.

FIG. 47 illustrates a plurality of modes according to one embodiment of the present invention. FIG. 48 specifically explains each of the modes shown in FIG. 47.

The flexible TV according to one embodiment of the present invention provides three specialized options, as shown in FIG. 47. These options can be set independently. For example, if a first option 4710 is set to ON, there is no restriction on setting a second option 4720 and a third option 4730 to ON/OFF. The options may be set through the flexible TV or through a mobile device connected through Bluetooth or the like.

The first option 4710, the second option 4720 and the third option 4730 shown in FIG. 47 are shown in detail in FIG. 48.

As shown in FIG. 48(*a*), the first option may be referred to as "Always On". If the "Always On" option is set to "on", power is designed to be supplied to at least one of the Bluetooth module for communication with the mobile device, the speech recognition module, and the network even when the flexible TV is in the off state (for example, the zero view state) to allow speech recognition and music playback.

As shown in FIG. 48(*b*), the second option may be referred to as a "Welcome function". If the "Welcome function" option is set to "on", a welcome message is output to a family member who returns home from outside through voice or video using the information on the mobile device stored in the memory of the flexible TV. If movement is sensed around the flexible TV, specific lighting feedback is provided. Relevant details have been described above with reference to FIG. 27.

As shown in (c) of FIG. 48, the third option may be referred to as "TV On screen". If the "TV On screen" option is set to "on", content to be displayed may be selected while the Flexible TV is rolled up and thus the display rises. As described above, the broadcast screen of the currently tuned channel may be displayed, or any still image or moving image stored in the memory of the flexible TV may be selected for a specific effect.

FIG. 49 shows data for controlling a door or a motor according to a type of a command recognized by a flexible TV according to one embodiment of the present invention.

In brief, the flexible TV according to one embodiment of the present invention includes a housing, a user interface for receiving at least one command, a controller for controlling a flexible display, a door and a motor located in the housing.

Further, the user interface may be a microphone for receiving a voice command, or an IR module or an RF module for receiving a command from a remote controller. Although the controller is illustrated as controlling the door and the motor, it may also control other modules as long as the extent to which the flexible display is exposed to the outside can be controlled.

In particular, the controller controls at least one of the door or the motor depending on the type of the command, thereby determining a range in which the flexible display is exposed to the outside of the housing.

For example, as shown in FIG. 49, when the type of the command is recognized as a first type, the controller controls the door to open and controls the motor in the up direction. However, controlling the motor in the up direction means that the direction in which the motor rotates is controlled such that the flexible display rises upward. The first type is determined in connection with the view state of the flexible TV, which will be described in detail later with reference to FIG. 50.

On the other hand, as shown in FIG. 49, when the type of the command is recognized as a second type, the controller controls the motor in the up or down direction without controlling the door. Controlling the motor in the down direction means that the direction in which the motor rotates is controlled such that the flexible display is lowered toward the ground. The second type is determined in connection with the view state of the flexible TV, which will be described in detail later with reference to FIG. 50.

FIG. 50 shows a database that defines conditions for determining the command type shown in FIG. 49. FIG. 50 can be supplementarily analyzed with reference to FIG. 49.

If the command recognized through a button on the remote controller or the speech recognition engine is determined to be the first type, the view state and the kind (content) of the command satisfy the following two conditions.

For example, the flexible TV is in the zero view state and the recognized command requests an additional screen (more specifically, for example, speech of "Is there anything fun on TV now?" is recognized). In this case, the door of the flexible TV should be opened such that the flexible display is exposed to the outside of the housing, as shown in FIG. 49.

On the other hand, if the command recognized through a button on the remote controller or the speech recognition engine is determined to be the second type, the view type and the type (content) of the command satisfy the following two conditions.

For example, the flexible TV is in the partial view state and the recognized command requests an additional screen (more specifically, for example, speech of "Play specific video content" is recognized). In this case, it is not necessary to open the door of the flexible TV, and therefore only the motor is controlled in a first direction such that the flexible display is exposed to the outside of the housing, as shown in FIG. 49.

Further, the flexible TV is in the full view state and the recognized command requires only a small screen (more specifically, for example, speech of "Play music file" is recognized). In this case, it is not necessary to open the door of the flexible TV, and therefore only the motor is controlled in a second direction such that the flexible display is exposed to the outside of the housing. The second direction is not the same as the first direction described above, but is the opposite direction.

Therefore, according to an embodiment of the present invention, a technical effect of providing UX/UI technology for user convenience, which is required in the flexible TV, is expected.

According to another embodiment of the present invention, a technical effect of specifically defining a database in consideration of the type of the command and the view type recognized in the flexible TV is expected.

According to another embodiment of the present invention, power consumption and deterioration in the image quality of a specific area of the flexible display due to switching between the view types of the flexible TV may be addressed.

The digital device and the content processing method of the digital device according to the foregoing embodiments are not restricted to the embodiments set forth herein. Therefore, variations and combinations of the exemplary embodiments set forth herein may fall within the scope of the present invention.

The method for operating the digital device according to the foregoing embodiments may be implemented as code that can be written to a computer-readable recording medium and can thus be read by a processor. The computer-readable recording medium may be any type of recording device in which data can be stored in a computer-readable manner. Examples of the computer-readable recording medium include a ROM, a RAM, a CD-ROM, a magnetic tape, a floppy disk, optical data storage, and a carrier wave (e.g., data transmission over the Internet). The computer-readable recording medium may be distributed over a plurality of computer systems connected to a network so that computer-readable code is written thereto and executed therefrom in a decentralized manner. Functional programs, code, and code segments to realize the embodiments herein can be construed by one of ordinary skill in the art Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A display device comprising:

a power supply module;

a housing;

a motor;

flexible display configured to be extended from the housing by operation of the motor, wherein the flexible display may be set to a first position, a second position, or a third position corresponding to different modes of the display device;

an input unit; and a controller configured to:

receive a first input via the input unit and obtain a response to the first input to be output;

when a current position of the flexible display is not compatible with the obtained response, change the flexible display to a compatible position for outputting the obtained response; and output the obtained response while the flexible display is in the compatible position, wherein the flexible display is fully retracted in the housing in the first position, wherein the first position corresponds to multiple power states of the display device, wherein the power supply module is configured to supply power to a microphone for voice input, but not to a speech recognition engine or to a network module, when the display device is in a first power state corresponding to the first position, wherein the power supply module is configured to supply power to the speech recognition engine and the network module as well as the microphone when the display device is in a second power state corresponding to the first position, wherein the flexible display is partially extended from the housing in the second position, and wherein the flexible display is fully extended from the housing in the third position.

2. The display device of claim 1, wherein the obtained response is associated with one or more predetermined compatible positions of the flexible display.

3. The display device of claim 1, wherein the obtained response is compatible with the current position if audio or visual information of the obtained response can be output while the flexible display is in the current position.

4. The display device of claim 1, wherein when the obtained response requires display of information on a full screen of the display device, the compatible position is the third position.

5. The display device of claim 1, wherein when the obtained response comprises visual information which may be displayed on a partial screen of the display device, the compatible position is the second position or the third position.

6. The display device of claim 5, wherein when the current position is the second position or the third position, the position of the flexible display is not changed.

7. The display device of claim 5, wherein the content of the visual information is displayed differently based on whether the flexible display is in the second position or the third position.

8. The display device of claim 5, wherein the current position is the second position, and wherein the controller is further configured to:

output the obtained response while the flexible display is in the second position, wherein the output response comprises audio and first visual information;

receive a second input via the input unit selecting a particular content included in the first visual information;

change the flexible display to the third position in response to the received second input; and output the selected particular content on the flexible display in the third position.

9. The display device of claim 1, wherein when the obtained response does not require display of visual information, the compatible position is any of the first position, second position, or third position.

10. The display device of claim 1, wherein the third position is compatible with all obtained responses such that the position of the flexible display is not changed when the current position is the third position regardless of the obtained response.

11. A display device comprising:

a power supply module;

a housing;

a motor;

flexible display configured to be extended from the housing by operation of the motor, wherein the flexible display may be set to a first position, a second position, or a third position corresponding to different modes of the display device;

an input unit; and a controller configured to:

receive a first input via the input unit and obtain a response to the first input to be output;

determine a current position of the flexible display, the current position corresponding to the first position, second position, or third position;

output the obtained response via flexible display, wherein a position of the flexible display is determined based on the obtained response, and wherein the obtained response is output differently according to the position of the flexible display, wherein the flexible display is fully retracted in the housing in the first position, wherein the first position corresponds to multiple power states of the display device, wherein the power supply module is configured to supply power to a microphone for voice input, but not to a speech recognition engine or to a network module, when the display device is in a first power state corresponding to the first position, wherein the power supply module is configured to supply power to a speech recognition engine and a network module as well as the microphone when the display device is in a second power state corresponding to the first position, wherein the flexible display is partially extended from the housing in the second position, and wherein the flexible display is fully extended from the housing in the third position.

12. The display device of claim 11, wherein the controller is further configured to output the obtained response while the flexible display is in the current position if the current position is compatible with the obtained response.

13. The display device of claim 12, wherein the obtained response is compatible with the current position if a format of audio or visual information of the obtained response can be output while the flexible display is in the current position.

14. The display device of claim 11, wherein if the obtained response is not compatible with the current position of the flexible display, the controller is further configured to change the flexible display to a compatible position for outputting the obtained response and output the obtained response while the flexible display is in the compatible position.

15. The display device of claim 14, wherein when the obtained response comprises visual information which may be displayed on a partial screen of the display device, the compatible position is the second position or the third position.

16. The display device of claim 14, wherein the obtained response is associated with one or more predetermined compatible positions of the flexible display.

17. The display device of claim 14, wherein when the obtained response requires display of information on a full screen of the display device, the compatible position is the third position.

18. The display device of claim 14, wherein when the current position is the second position or the third position, the position of the flexible display is not changed.

19. The display device of claim 11, wherein the current position is the second position, and wherein the controller is further configured to:

output the obtained response while the flexible display is in the second position, wherein the output response comprises audio and first visual information;

receive a second input via the input unit selecting a particular content included in the first visual information;

change the flexible display to the third position in response to the received second input; and output the selected particular content on the flexible display in the third position.

20. The display device of claim 14, wherein when the obtained response does not require display of visual information, the obtained response is compatible with any of the first position, second position, or third position.

21. The display device of claim 14, wherein the third position is compatible with all obtained responses such that the position of the flexible display is not changed when the current position is the third position regardless of the obtained response.

22. A display device comprising:

a power supply module;

a housing;

a motor;

flexible display configured to be extended from the housing by operation of the motor, wherein the flexible display may be set to a first position, a second position, or a third position corresponding to different modes of the display device;

an input unit; and a controller configured to:

receive a first input via the input unit and obtain a response to the first input to be output;

change the flexible display to the third position if a current position of the flexible display is not the third position and the obtained response requires outputting visual information on a full screen of the flexible display, and output the obtained response on the full screen of the flexible display in the third position;

if a current position of the flexible display is the second position, maintain the second position of the flexible display and output visual information of the obtained response via the flexible display;

if a current position of the flexible display is the first position and the obtained response requires outputting visual information, change the flexible display to the second position or the third position and output visual information of the obtained response via the flexible display; and if a current position of the flexible display is the first position and the obtained response does not require outputting visual information, maintain the first position of the flexible display and output audio information of the obtained response, wherein the flexible display is fully retracted in the housing in the first position, wherein the first position corresponds to multiple power states of the display device, wherein the power supply module is configured to supply power to a microphone for voice input, but not to a speech recognition engine or to a network module, when the display device is in a first power state corresponding to the first position, wherein the power supply module is configured to supply power to a speech recognition engine and a network module as well as the microphone when the display device is in a second power state corresponding to the first position, wherein the flexible display is partially extended from the housing in the second position, and wherein the flexible display is fully extended from the housing in the third position.

* * * * *